US007270630B1

(12) United States Patent
Patterson

(10) Patent No.: US 7,270,630 B1
(45) Date of Patent: Sep. 18, 2007

(54) ROWING MACHINE HAVING A FLEX HANDLE ASSEMBLY FOR PREFERENTIALLY ENABLING AN EXTENDED RANGE OF MOTION FOR SELECTED JOINT COMPLEXES

(76) Inventor: Paul Patterson, 87 Ch. Pic Bois, Val Des Monts, Quebec (CA) J8N 6C4

( * ) Notice: Subject to any disclaimer, the term of this patent is extended or adjusted under 35 U.S.C. 154(b) by 544 days.

(21) Appl. No.: 10/060,873

(22) Filed: Jan. 29, 2002

Related U.S. Application Data

(63) Continuation-in-part of application No. 09/925,934, filed on Aug. 9, 2001, now Pat. No. 6,991,589.

(60) Provisional application No. 60/264,764, filed on Jan. 29, 2001.

(51) Int. Cl.
*A63B 21/02* (2006.01)
*A63B 69/06* (2006.01)

(52) U.S. Cl. ..... 482/121; 482/72

(58) Field of Classification Search ..... 482/72, 482/121–130, 95–96
See application file for complete search history.

(56) References Cited

U.S. PATENT DOCUMENTS 4,909,505 A * 3/1990 Tee ..... 482/129
5,851,167 A * 12/1998 Li ..... 482/122
5,865,713 A * 2/1999 Hsu ..... 482/72
6,238,322 B1 * 5/2001 Hsu ..... 482/96
6,692,412 B2 * 2/2004 Chen et al. ..... 482/96
6,921,354 B1 * 7/2005 Shifferaw ..... 482/91

* cited by examiner

*Primary Examiner*—Jerome Donnelly
*Assistant Examiner*—Fenn C. Mathew
(74) *Attorney, Agent, or Firm*—Mike Bush, PLLC

(57) ABSTRACT

Novel apparatus and methods enhance the ability of a rowing machine to provide a full body workout by increasing the range of movement possible during a rowing stroke, thereby producing increased strength, muscle mass and/or range of movement. These benefits are achieved by use of, in conjunction with a rowing machine, a handle assembly uniquely configured such that, when a user of the rowing machine grasps the handle assembly and performs an exercise routine which includes a pull phase of a stroke, the handle assembly defines a space in which the body of the user may be received during the pull phase. As a result, the user may extend the pull phase of the stroke. Still further benefits may be achieved by combining the aforementioned handle assembly with a novel rowing machine apparatus which allows for the rowing motion to occur in multiple planes or stroke axes, thereby combining the increased strength, muscle mass and/or range of movement which may be achieved using the novel handle assembly with the full-body muscular fitness gains that can be realized from the multi-planar rowing machine apparatus combination of gravity and isokinetic air-fan-type resistance to provide full exercise spectrum including strength, muscle mass, and energy system stimulus to major body extensors and flexors.

19 Claims, 37 Drawing Sheets

ROWING MACHINE HAVING A FLEX HANDLE ASSEMBLY FOR PREFERENTIALLY ENABLING AN EXTENDED RANGE OF MOTION FOR SELECTED JOINT COMPLEXES

CROSS REFERENCE TO RELATED APPLICATIONS

This application claims priority from U.S. provisional patent application Ser. No. 60/264,764 filed Jan. 29, 2001.

This application is also a Continuation-In-Part (C-I-P) of U.S. patent application Ser. No. 09/925,934 filed Aug. 9, 2001, now U.S. Pat. No. 6,991,589, entitled "Multi-planar Rowing Machine and Associated Exercise Protocols" and hereby incorporated by reference as if reproduced in its entirety.

BACKGROUND OF THE INVENTION

1. Field of the Invention

The invention relates to rowing machine-type exercise apparatus, both those limited to operation in a single plane generally parallel to the underlying support surface as well as those operable in multiple inclined and declined planes relative to the support surface. In particular, the invention relates to a handle structure which, when in used in combination with a rowing machine-type exercise apparatus, enables a user thereof to enjoy an extended range of motion for a wide range of exercise protocols which preferentially emphasize selected ones of the hand/wrist, elbow and shoulder joint complexes, individually and/or as a continuous kinetic chain.

2. Background

The sedentary lifestyle of modern men and women and corresponding injuries associated with such lifestyles are among the reasons motivating widespread interest in exercise machines. However, the rapid proliferation of exercise machines, many of varied design, have complicated the task of identifying a machine which, when used in conjunction with an appropriate exercise protocol, will enable the efficient acquisition and maintenance of strength, flexibility and energy system fitness. Among the more common exercise machines are stationary bicycles, step machines, and treadmills. All of these can be characterized as "2-limb" exercise machines in that they primarily work the legs of the user. Accordingly, none of these exercise machines are suitable for those seeking full body workouts.

The rowing machine is a "4-limb" exercise machine and is therefore capable of providing a more complete body workout. Broadly speaking, a rowing machine operates by generating resistance to a rowing motion made by the user. Typically, rowing machines are designed such that this rowing motion occurs in the horizontal plane, generally parallel to the surface on which the rowing machine is supported. This will be referred to herein as a horizontal stroke axis. The rowing motion is comprised of two phases—an extension (or "pull") phase and a recoil (or "flex") phase performed along the stroke axis. Presumably to simulate an actual rowing motion, the pull phase is typically loaded (or resisted) while the flex phase is not. When actually rowing a boat, the pull phase is resisted by the water while the flex phase is not since the oar is out of the water.

Rowing machines have been developed with various ways to provide resistance to the rowing motion. Early versions of rowing machines employed a wheel and pulley mechanism to provide resistance to the rowing motion. Later, rowing machines employed a pair of shock absorber-like piston and cylinder mechanisms attached between the frame and respective arms thereof to generate resistance to the user's rowing motion. Additional rowing machine designs have employed an isokinetic wheel-belt resistance system arranged such that the user's pulling on a cable turns a wheel, which in turn is resisted by friction against a variably-tensioned belt.

More recent rowing machines have employed an air-fan type isokinetic system to provide resistance to the user's rowing motion. Such rowing machines typically include a seat that slides unresisted with the user's motion and a rowing handle attached via a cable to a ratchet-type gear inserted into the center of a spinning air-fan type wheel. The ratchet system enables the air-fan wheel to continue to spin via momentum in the flex phase during which the user flexes their body and shortens the cable in preparation for another pull phase. A conventional rowing machine 10, which employs an air-fan type isokinetic system may be seen in FIG. 1, described in more detail below.

By using a typical horizontal rowing machine, the user can obtain low to moderate strength and muscular fitness gains in the leg extensors, the torso extensors, the upper back, the shoulder girdle, the elbow flexors and the forearms. Most of these muscular gains are obtained during the loaded pull phase of the rowing stroke while little if any gains are obtained during the unloaded flex phase. When limited to the horizontal plane, an exercise protocol performed using a typical air-fan type isokinetic rowing machine tends to only reinforce the development of extensor strength in the lower and upper legs and in the lower and upper posterior torso. In particular, in the pull phase of the stroke, the torso extensors actively work and the shoulder girdle actively stabilizes while the upper arms extend during the pull. Conversely, in the flex phase of the stroke, only the weight of the head and torso is used to maintain exercise neutral momentum as the head/torso moves forward during the flex. Accordingly, the attendant muscular fitness gains are limited to the leg extensors (calves and quadriceps), the torso extensors (spinal erectors), the upper back (shoulder retractors), the shoulder girdle, the elbow flexors (biceps) and, by virtue of a fixed wrist isometric handle hold, the forearms. It should also be appreciated that, as the aforementioned exercise protocol for the traditional rowing machine is performed in the horizontal plane, gravity has no appreciable resistive effect during either the flex or pull phases of the stroke. Thus, in contrast with some exercise machines and protocols, gravity does not enhance the fitness effect experienced.

Thus, while the rowing machine is a 4-limb exercise machine, its ability to provide a full body workout suffers from the fact it is generally only capable of producing low to moderate gains in the extensor muscles employed during the pull phase and significantly less (or no) gains in the flexor muscles employed during the flex phase. The resultant strength imbalances created have likely contributed to the reputation of both the traditional rowing machine, and exercise protocols for the traditional rowing machine, as being a less than full-body fitness solution, not significantly better than other fitness machines such as 2-limb machines.

In U.S. patent application Ser. No. 09/925,934, I disclosed a rowing machine uniquely configured to allow the rowing motion to occur in multiple inclined or declined planes. In that application, I further disclosed novel exercise protocols and methods for maximizing the full-body muscular fitness gains that can be realized from use of the multi-planar rowing machine in those planes. While the machines are quite distinct from one another, both the multi-planar rowing machine which I disclosed in the aforementioned application as well as the prior, horizontal rowing machines upon which I sought to improve shared certain features unrelated to the plane of the stroke axis. More specifically, consistent with the traditional view of rowing machines being used to simulate flat-water rowing, heretofore, the handle for virtually all rowing machines designed for usage in the horizontal plane have been designed essentially as a segment of the "oar or oars" which would be normally used to effect flat-water rowing. Accordingly, the handle of rowing machines designed solely for use in the horizontal plane have traditionally been configured in a "bar-shaped" design and, in designing a novel rowing machine configured to permit operation in plural inclined planes, I similarly employed the same bar-shaped handle design used in the prior art.

Typically, the bar-shaped handle of a rowing machine is gripped by a user in a palms-down position in which both the hands and the wrist are pronated. Once gripped in this manner, the user typically maintains this grip on the bar-shaped handle during both the pull and flex phases of a stroke. By using a bar-shaped handle in combination with a traditional flat ground rowing technique, the user is considerably limited as to the range of movement for each of the hand/wrist, elbow and shoulder during a stroke. More specifically, the hand/wrist is isometrically fixed in a pronated position midway between wrist flexion and wrist extension during the rowing stroke with no radial and minimal ulnar deviation possible. The elbow is pronated throughout the rowing stroke with partial elbow flexion and elbow extension occurring during the stroke. Finally, partial shoulder extension and adduction can occur during the rowing stroke.

SUMMARY

In accordance with the present invention, there is provided novel apparatus and methods to further enhance the ability of a rowing machine to provide a full body workout by increasing the range of movement possible during a rowing stroke to include one or more of the following movements: (1) hand/wrist flexion; (2) hand/wrist extension; (3) hand/wrist supination; (4) hand/wrist pronation; (5) hand/wrist ulnar deviation; (6) hand/wrist radial deviation; (7) combined hand/wrist pronation, flexion and ulnar deviation; (8) combined hand/wrist supination, extension and radial deviation; (9) elbow supination (i.e., with hand/wrist); (10) elbow pronation (i.e., with hand/wrist); (11) elbow flexion; (12) elbow flexion plus supination and/or pronation of hand/wrist; (13) elbow extension; (14) elbow extension plus supination and/or pronation of hand/wrist; (15) shoulder extension (i.e., posteriorly); (16) shoulder flexion (i.e., anteriorly); (17) shoulder abduction (i.e., lateral elevation); (18) shoulder external rotation; and (19) shoulder internal rotation. By expanding the hand/wrist/elbow/shoulder complex exercise movement agenda of a training program to include various ones of the nineteen distinct training movements and/or movement combinations listed herein produces increased strength, muscle mass and/or range of movement.

In accordance with one embodiment of the invention, the increased strength, muscle mass and/or enhanced range of movement is achieved by use of, in conjunction with a rowing machine, a handle assembly having a central body member for securing the handle assembly to the rowing machine, a first gripping member, a first non-tensile flexible attachment member for coupling the first gripping member to the central body member, a second gripping member and a second non-tensile flexible attachment member for coupling the second gripping member to the central body member. By configuring the handle assembly in this manner, when a user of the rowing machine grasps the first and second gripping members and performs an exercise routine which includes a pull phase of a stroke, the first non-tensile flexible attachment member, the central body member and the second non-tensile flexible attachment member define a space in which a portion of the user may be received during the pull phase. As a result, the user may extend the pull phase of the stroke In accordance with another embodiment of the invention, a continuous tensile strand is further attached to the general center of the central body member and to each of the first gripping member and the second gripping member. By doing so, resistance to supination/pronation, radial/ulnar deviation, extension/flexion of the hand/wrist, plus extension/flexion of the elbow, and internal/external rotation of the shoulder is achieved.

Still further benefits may be achieved by combining the aforementioned handle assembly with a novel rowing machine apparatus which allows for the rowing motion to occur in multiple planes or stroke axes, thereby combining the increased strength, muscle mass and/or range of movement which may be achieved using the novel handle assembly with the full-body muscular fitness gains that can be realized from the multi-planar rowing machine apparatus combination of gravity and isokinetic air-fan-type resistance to provide full exercise spectrum including strength, muscle mass, and energy system stimulus to major body extensors and flexors. The two-phase resistance provided thereby creates maximum calorie burn per unit of exercise time, and further results in a strength balance in virtually every major leg, arm, and body core extensor and flexor and rotator.

DESCRIPTION OF DRAWINGS

FIG. 6*b*-1 is a schematic view of a multi-planar rowing machine in a declined position with the user at an end point for a heels-off, wrists-even, low pull phase of a stroke.

FIG. 6*b*-2 is a schematic view of a multi-planar rowing machine in a declined position with the user at an extended end point for a heels-off, wrists-even, low pull phase of a stroke.

FIG. 6*c*-1 is a schematic view of a multi-planar rowing machine in a declined position with the user at an end point for a heels-off, wrists-even, mid pull phase of a stroke.

FIG. 6*c*-2 is a schematic view of a multi-planar rowing machine in a declined position with the user at an extended end point for a heels-off, wrists-even, mid pull phase of a stroke.

FIG. 6*d*-1 is a schematic view of a multi-planar rowing machine in a declined position with the user at an end point for a heels-off, wrists-even, high pull phase of a stroke.

FIG. 6*d*-2 is a schematic view of a multi-planar rowing machine in a declined position with the user at an extended end point for a heels-off, wrists-even, high pull phase of a stroke.

FIG. 7*b*-1 is a schematic view of a multi-planar rowing machine in an inclined position with the user at an end point for a heels-down, wrists-even, toes-up, low pull phase of a stroke.

FIG. 7*b*-2 is a schematic view of a multi-planar rowing machine in an inclined position with the user at an extended end point for a heels-down, wrists-even, toes-up, low pull phase of a stroke.

FIG. 7*c*-1 is a schematic view of a multi-planar rowing machine in an inclined position with the user at an end point for a heels-down, wrists-even, toes-up, mid pull phase of a stroke.

FIG. 7*c*-2 is a schematic view of a multi-planar rowing machine in an inclined position with the user at an extended end point for a heels-down, wrists-even, toes-up, mid pull phase of a stroke.

FIG. 7*d*-1 is a schematic view of a multi-planar rowing machine in an inclined position with the user at an end point for a heels-off, wrists-even, toes-up, high pull phase of a stroke.

FIG. 7*d*-2 is a schematic view of a multi-planar rowing machine in an inclined position with the user at an extended end point for a heels-off, wrists-even, toes-up, high pull phase of a stroke.

FIG. 8*b* is a schematic view of a multi-planar rowing machine with the user at an end point for a high pull phase of a stroke using a weighted bar.

FIG. 8*c* is a partially cut-away, expanded side view of the weighted bar mechanism of FIGS. 8*a*–*b*.

DETAILED DESCRIPTION OF THE INVENTION

Figure 1A:
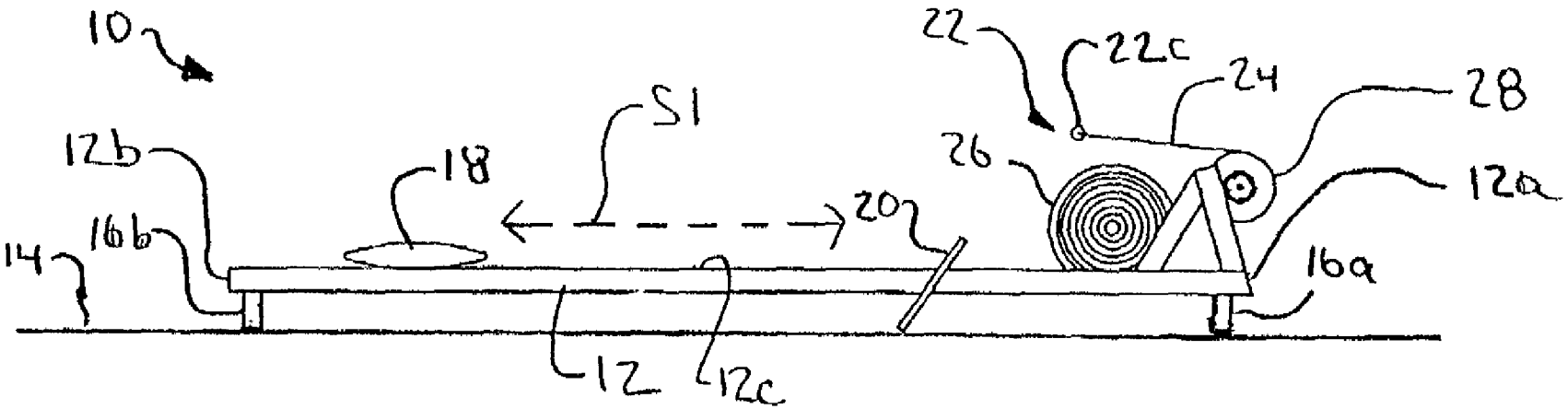
FIG. 1*a* is a side view of a conventional rowing machine operable in a single, horizontal, plane.

Referring now to FIG. 1*a*, the rowing machine 10 will now be described in greater detail. As may now be seen, the rowing machine 10 includes a rail member 12 supportably mounted above a generally horizontal support surface 14, for example a floor, in a generally parallel orientation therewith. The rail member 12 is supported above the support surface 14 by front and rear support beams 16*a* and 16*b*. Each one of the front and rear support beams 16*a* and 16*b* are coupled, on one end thereof, to the rail member 12. As used herein, the terms couple or coupled, mount or mounted, attach or attached refer broadly to either direct or indirect connection. As illustrated in FIG. 1*a*, the front and rear support beams 16*a* and 16*b* are generally orthogonal to the rail member 12. It should be noted, however, that, for many rowing machines, the support beams are at a non-orthogonal angle, for example, 45 degrees, relative to the rail member. It should be further noted that, while only one front support beam 16*a* and one back support beam 16*b* are visible in FIG. 1*a*, a plurality of support beams may be used to enhance the support of the rail member 12 above the support surface 14. Alternatively, rather than using individual or plural support beams, many rowing machines utilize a support structure which includes one or more support struts, typically extending from the rail member, which provide additional support to the main support beams such as those illustrated in FIG. 1*a*. Often, the support beams terminate in feet which engage the underlying support surface. Generally, the feet are used to enhance the balance of the rowing machine by increasing the surface area of the support surface engaged by the rowing machine. In some configurations, the feet may also include rollers to enhance portability of the rowing machine. Conversely, for some rowing machines, the feet are constructed of a material having a high coefficient of friction, thereby discouraging movement of the rowing machine relative to the underlying support surface.

The rowing machine 10 further includes a seat 18, a pair of foot pads 20 (only one of which is visible in FIG. 1*a*), and a bar-shaped handle 22. The seat 18 is slidably attached to the rail member 12 by a sliding mechanism, hidden from view in FIG. 1*a*, which enables the seat 18 to slide along the rail 18 along a stroke axis S1 generally parallel to the support surface 14. Typically, the sliding mechanism includes a slot longitudinally formed along an upper side surface 12*c* of the rail member 12 such that a projection (not visible) extending downwardly from a lower surface of the seat 18 may be slidably inserted therein. As will be more fully described below, when performing exercise protocols, a user seated on the seat 18 will slide towards front surface 12*a* in the flex phase of the rowing motion and towards back surface 12*b* during the pull phase of the rowing motion.

Each one of the foot pads 20 is attached on respective sides of the rail member 12. Of course, only one such foot pad 20, specifically, the right foot pad, is visible in FIG. 1*a*. Furthermore, it should be noted that, oftentimes, the foot pads are attached to the support structure which supports a rowing machine above a surface, particularly, when the support structure is sufficiently extensive to enable any foot pads attached thereto to enjoy proper placement for use thereof. The handle 22 is grasped and pulled by a user during an exercise routine to be more fully described below. The handle 22, which is shown in an artificially elevated position in FIG. 1*a* to enhance the visibility thereof, is coupled to a retractable cable 24, which, in turn is coupled to an air fan wheel 26 via a pulley 28 and a ratchet gear mechanism (not shown) located within the air fan wheel 26.

A user seeking to employ the rowing machine 10 in an exercise routine would first sit on the seat 18. After placing their left and right feet on the left and right foot pads 20, respectively, and grasping the handle 22 such that both the hands and the wrist are pronated, the user would typically begin, from a start point, an exercise routine which includes at least one rowing stroke by either using their legs to push against the foot pads 20, using their arms to pull the handle 22 or both. Either of these actions produces a pulling motion which, in this example, is resisted by the air fan wheel 26. By pushing against the foot pads 20 while grasping the handle 22, the user causes the seat 18 to slide along the stroke axis S1 to produce the pull phase of the rowing motion. After reaching an end point of a stroke, the user returns to the start point in an unresisted flex phase.

Figure 1B:
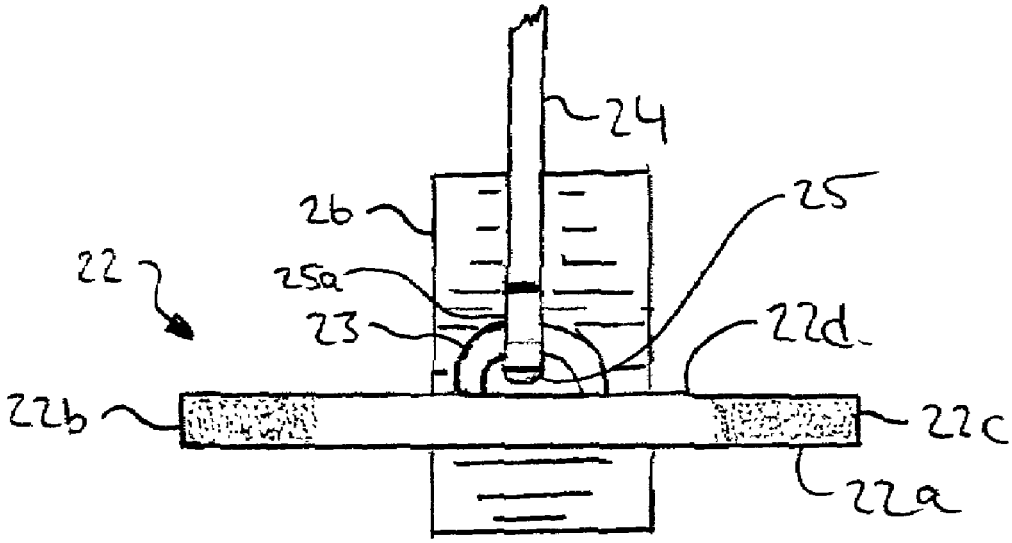
FIG. 1*b* is a partial top view of the rowing machine of FIG. 1*a* which better shows a conventional bar-shaped handle thereof.

Referring next to FIG. 1*b*, the bar-shaped handle 22, which again is shown in an artificially elevated position, will now be described in greater detail. As may now be seen, the handle 22 is a solid, elongated bar having a main body member 22*a* which terminates in first and second ends 22*b* and 22*c* on respective sides thereof. Each of the first and second ends 22*b* and 22*c* are generally orthogonal to the main body 22*a* and generally parallel to one another. The handle 22 is constructed of a hard material, for example, steel, which is not readily compressible. If desired, the portion of the surface of the main body member 22*a* in closest proximity to each of the first and second ends 22*a* and 22*b* may be roughened to enhance the ability of a user to grip the handle 22. Fixedly attached to a front side surface 22*d* of the handle 22 is a ring 23, typically formed of the same material as the handle 22, used to removably secure the handle 22 to the retractable cable 24. As illustrated herein, the ring 23 is formed in a generally semi-circular shape in which both ends of the ring 23 are fixedly attached to the handle 22. Of course, other shapes in which both ends are fixedly attached to the handle 22 are equally suitable for the uses contemplated herein. The ring 23 may be fixedly attached to the handle 22 using a welding process or other suitable technique.

The cable 24 terminates in a ring 25, a section 25*a* of which may be moved between a first position in which the ring is closed (shown in FIG. 1*b*) and a second position in which the ring is open (not shown). Typically, the section 25*a* is spring-loaded such that, in the absence of a force opposing the spring or other biasing means, the ring will be kept in the closed position. To secure the handle 22 to the cable 24, the section 25*a* of the ring 25 is moved into the open position. The handle 22 is then hooked onto the cable 24 by inserting the ring 23 into the now opened ring 25. The section 25*a* is then released, thereby returning to the first position to close the ring 26 and secure the handle 22 to the cable 24. Thus, as may be best seen in FIG. 1*b*, the handle 22, when secured to the cable 24, forms a general "T" shape in which the cable 24 and the handle 22 form the vertical and horizontal members of the "T", respectively.

Figure 2A:
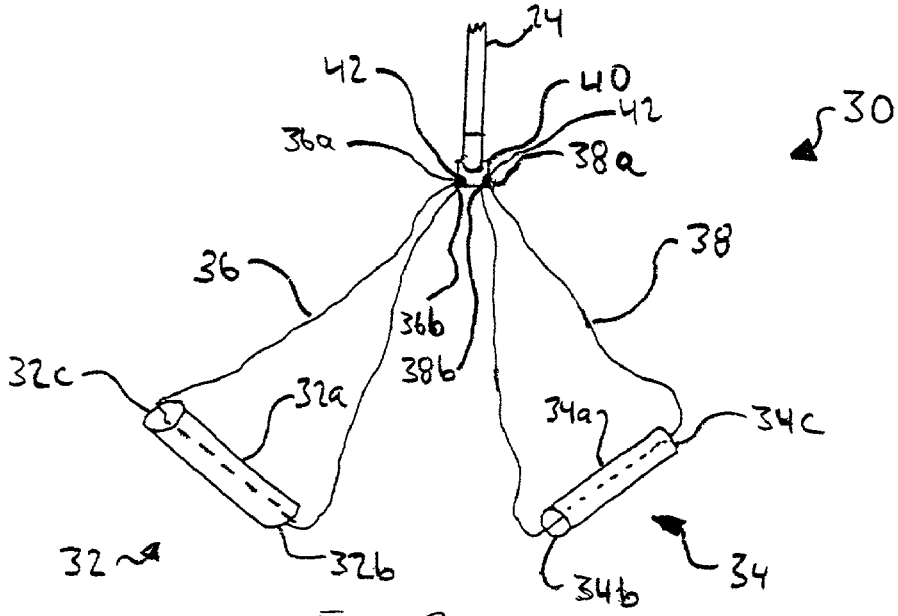
FIG. 2*a* is a top view of a first handle assembly constructed in accordance with the teachings of the present invention.

Referring next to FIG. 2*a*, a handle assembly 30, again shown in an artificially elevated position, constructed in accordance with the teachings of the present invention will now be described in greater detail. As will be more fully described below, the handle assembly 30 is uniquely configured such that, when used in conjunction with a rowing machine, the range of motion which may be achieved during the pull phase of a stroke is greatly improved, thereby achieving a wide array of benefits when used in place of a conventionally configured bar-shaped handle such as the handle 22. As may now be seen, the handle assembly 30 of the present invention is configured to include first and second gripping members 32 and 34, each having a main body portion 32*a*, 34*a* which terminates in first and second ends 32*b* and 32*c*, 34*b* and 34*c* on respective sides thereof. Each of the first and second ends 32*b* and 32*c*, 34*b* and 34*c* are generally orthogonal to the main body 32*a*, 34*a* and generally parallel to one another. Preferably, each of the first and second gripping members 32 and 34 are formed to have a generally tubular shape. For such a shape, the main body portion 32*a*, 34*a* would be a sidewall which defines an interior passageway extending from the first end 32*b*, 34*b* to the second end 32*c*, 34*c*. Each gripping member 32, 34 is formed from a rigid, relatively incompressible material such as wood, metal or plastic, for example, using a cutting, molding or other suitable process. While the length of the gripping members 32, 34 may be readily varied without departing from the scope of the present invention, a length of between 4½ and 5 inches is suitable for the uses contemplated herein. Similarly, while the diameter of the gripping members may be varied without departing from the scope of the present invention, a diameter of between ¾ and 1 inch, is suitable for the uses contemplated herein.

Each gripping member 32, 34 is secured to the retractable cable 24 using a respective flexible attachment member 36, 38. Alternately, the flexible attachment members 36, 38 may be formed of either a tensile material such as surgical tubing or a non-tensile material such as a steel cable or nylon. As illustrated herein, however, both of the flexible attachment members 36, 38 are formed of a non-tensile material. To attach the gripping members 32, 34 to the retractable cable 24, a first end 36*a*, 38*a* is attached to the retractable cable 34. A second end 36*b*, 36*c* is threaded through the interior passageway extending between the first and ends 32*b* and 32*c*, 34*b* and 34 of the gripping members 32, 34 and then attached to the retractable cable 24.

A securing member 40 is used to attach the first and second ends 36*a* and 36*b*, 38*a* and 38*b* to the retractable cable 24. As illustrated in FIG. 2*a*, the securing member 40 is a solid ring, typically formed of steel or another hardened material. In the embodiment illustrated in FIG. 2*a*, the retractable cable 24 is looped through an opening in the securing member 40 and then attached to itself, typically using a welding or other binding process which permanently secures the securing member 40 to the retractable cable 24. In an alternate embodiment of the invention not shown in the drawings, the securing member 40 may have a movable latch which allows the securing member 40 to be removably hooked onto a loop formed on the end of the retractable cable 24. Finally, in still another embodiment of the invention not shown in the drawings, the securing member 40 may be the solid ring illustrated in the drawings while the loop formed in the retractable cable has a movable latch incorporated therein which allows the securing member 40 to be removably hooked onto the loop formed on the end of the retractable cable 24.

Fixedly attached to the securing member 40 are plural clamp structures 42, only two of which are visible in FIG. 2*a*. Each of the clamp structures 42 are sized to receive a length of one of the non-tensile flexible attachment members 36, 38. Upon inserting a suitable length of one of the non-tensile flexible attachment members 36, 38 into the clamp structure 42 and tightening the clamp structure 42, the length of non-tensile flexible attachment member 36, 38 inserted thereinto will be fixedly secured to the securing member 40. For ease of illustration, FIG. 2*a* shows the securing member 40 as including only two clamp structures 42. For this embodiment, the first ends 36*a*, 38*a* of the first and second non-tensile flexible attachment members 36 and 38 would be permanently secured to the securing member, for example, using either a welding or other binding process. The first and second gripping members 32 and 34 would be coupled to the retractable cable 24 by inserting the second end 36*b*, 38*b* through the interior passageway extending through the gripping member 32, 34 and then clamping the second end 36*b*, 38*b* to the support member 40 using the clamping structures 42. In another embodiment, the securing member 40 would include four clamp structures, one to clamp the respective ends 36*a*, 36*b*, 38*a*, 38*b* of the first and second non-tensile flexible attachment members 36 and 38.

It is fully contemplated that a wide variety of clamps are suitable for use as the clamping structures 42. One such clamp would be a tooth and ratchet mechanism having a lockable jaw for firmly gripping the first and second non-tensile flexible attachment members 36 and 38, a ratchet for pulling an additional length of the first and second non-tensile flexible attachment members 36 and 38 through the jaw and a release mechanism for releasing the jaw. Such a clamp would be particularly well suited for the uses contemplated therein since it would allow for the length of the first and second non-tensile flexible attachment members 36 and 38 to be readily varied, for example, to adjust the separation of the first and second griping members 32 and 34 from the retractable cable 24 to accommodate the personal preferences of a new user. Furthermore, while the length of the first and second non-tensile flexible attachment members 36 and 38 may be varied while remaining within the scope of the present invention, a length of between 18 and 23 inches is suitable for the uses contemplated herein. By selecting such a length for each of the first and second non-tensile flexible attachment members 36 and 38, the distance separating the securing member 40 from the gripping members 32 and 34 will be variable between 6 and 10 inches. Furthermore, each of the first and second non-tensile flexible attachment members 36 and 38 should be coupled to the securing member 40 such that each of the first and second gripping members 32 and 34 are separated from the securing member by roughly the same distance. Again, while the distance separating each of the first and second gripping members 32 and 34 from the securing member 40 may be readily varied while remaining within the scope of the invention, when the first and second gripping members 32 and 34 are held at a general 60 degree angle in the same plane as the retractable cable 24, a separation distance between 7 and 9 inches is suitable for the uses contemplated herein. As may be further seen in FIG. 2*a*, when used in an exercise routine, the first and second gripping members 32 and 34 are maintained at roughly a 60 degree angle, relative to the retractable cable 24, to form a general "Y" shaped handle structure in which the retractable cable 24 forms the vertical member of the Y while the gripping members 32, 34 (and associated non-tensile flexible attachment members 36, 38) form respective angled members of the Y.

Figure 2B:
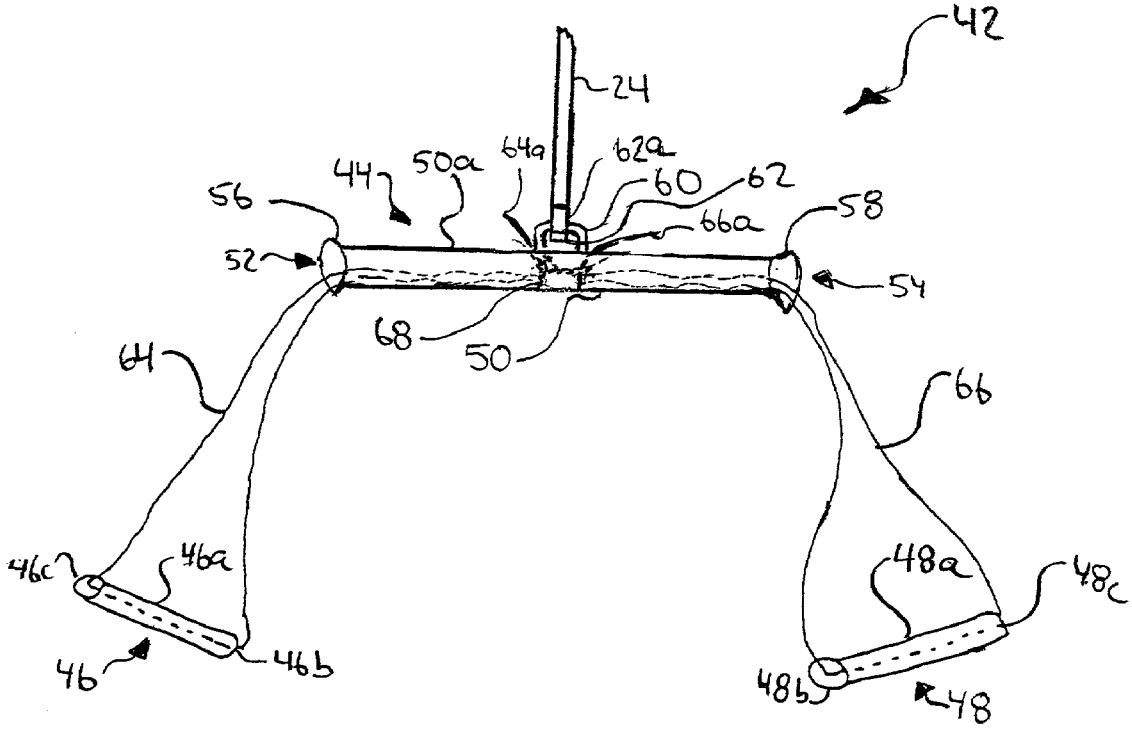
FIG. 2*b* is a top view of a second handle assembly constructed in accordance with the teachings of the present invention.

Referring next to FIG. 2*b*, another handle assembly 42, again shown in an artificially elevated position, constructed in accordance with the teachings of the present invention will now be described. Like the handle assembly 30, the handle assembly 42 is uniquely configured such that, when used in conjunction with a rowing machine, the range of motion which may be achieved during the pull phase of a stroke is greatly improved, thereby achieving a wide array of benefits when used in place of a conventionally configured bar-shaped handle such as the handle 22. Unlike the handle assembly 30, the handle assembly 42 is further uniquely configured to permit greater flexibility in the type of stroke which may be employed when the handle structure is coupled to a rowing machine.

More specifically, and as may be clearly seen in FIG. 2*b*, the handle structure 42 includes a bar member 44, a first gripping member 46 and a second gripping member 48. The bar member 44, which is preferably formed from a hardened, relatively incompressible, material such as steel, has a generally tubular sidewall 50 which defines a generally cylindrical interior passageway which extends between first and second openings 52 and 54 of the bar member 44. The tubular sidewall 50 further includes a widened lip 56, 58 formed on opposite ends thereof. As a result therefore, the diameter of the generally circular openings 52 and 54 are slightly greater than the diameter of the generally cylindrical passageway extending therebetween. As before, while the bar member may be dimensioned variously while remaining within the scope of the present invention, configuring the bar member 44 such that the distance separating the first end 52 from the second end 54 is between 14 and 16 inches while the interior passageway extending between the first and second ends 52 and 54 has a diameter between 1½ and 2 inches is suitable for the uses contemplated herein.

Fixedly attached to a front side surface 50*a* of the tubular sidewall 50 of the bar member 44 is a ring 60, typically formed of the same material as the tubular sidewall 50, used to removably secure the bar member 44 to the retractable cable 24. The ring 60 may be formed in the generally semi-circular shape illustrated herein or another suitable shape in which both ends of the ring 60 are fixedly attached to the bar member 44. The ring 60 may be fixedly attached to the tubular sidewall 50 of the bar member 44 using a welding process or other suitable securing technique. The cable 24 terminates in a ring 62, a section 62*a* of which is moveable between a first position (shown in FIG. 2*b*) in which the ring 62 is closed and a second position in which the ring 62 is open. Typically, the section 62*a* is spring-loaded such that, in the absence of a force opposing the spring or other biasing means, the ring 62 will be kept in the closed position. To secure the bar member 44 to the cable 24, the section 62*a* of the ring 62 is moved into the open position. The bar member 44 is then hooked onto the cable 24 by inserting the ring 60 into the now opened ring 62. The section 62*a* is then released, thereby returning to the first position to close the ring 60 and secure the bar member 44 to the cable 24. Of course, it should be fully contemplated that the rings 60 and 62 are fully interchangeable. In other words, the ring 60 may have the moveable section while the ring 62 does not.

As may be further seen in FIG. 2*b*, attached to the bar member 44 are the first and second gripping members 46 and 48. Each one of the first and second gripping members 46 and 48 is comprised of a generally tubular sidewall 46*a*, 48*a* which defines a generally cylindrical interior passageway which extends between first and second ends 46*b*, 48*b* and 46*c*, 48*c*. Each of the first and second ends 46*b*, 48*b* and 46*c*, 48*c* are generally orthogonal to the tubular sidewall 46*a* and generally parallel to one another. Each of the first and second gripping member 46 and 48 is formed from a rigid, relatively incompressible material such as wood, metal, plastic, or the like, for example, using a cutting, molding or other suitable forming process. While the length of the first and second gripping members 46 and 48 may be readily varied without departing from the scope of the present invention, a length of between 4½ and 5 inches is suitable for the uses contemplated herein. Similarly, while the diameter of the first and second gripping members 46 and 48 may also be readily varied without departing from the scope of the present invention, a diameter of between ¾ and 1 inch is suitable for the uses contemplated herein.

Each of the first and second gripping members 46 and 48 are secured to the bar member 44 using a respective flexible attachment member 64, 66. Alternately, the flexible attachment members 64, 66 may be formed of either a tensile material such as surgical tubing or a non-tensile material such as a steel cable or nylon. To attach the first and second gripping members 46 and 48 to the bar member 44, one end of the respective flexible attachment member 64, 66 is secured to the bar member 44. A second end is threaded through the interior passageway extending between the first and second ends 46*b* and 46*c*, 48*b* and 48*c* of the corresponding one of the first and second gripping members 46 and 48. The second end of the respective flexible attachment members 64, 66 is then secured to the bar member 44.

Formed along the interior side surface of the tubular sidewall 50 in the general center thereof, is a securing structure 68 used to adjustably attach the flexible attachment members 64 and 66 to the bar member 44. A first end (not visible) of each of the first and second flexible attachment members 64 and 66 is fixedly secured to the securing structure 68. For example, if the flexible attachment members 64 and 66 are steel cables, the first ends thereof may be welded to the securing structure 68. Alternately, if the flexible attachment members 64 and 66 are surgical tubing or nylon cords, the first ends thereof may be knotted, tied, clamped or otherwise secured to the securing structure 68. The second ends of the flexible attachment members 64 and 66, on the other hand, are adjustably secured to the securing structure 68. For example, the securing structure 68 may include first and second clamps (not visible) for adjustably securing the second end of the first and second flexible attachment members 64 and 66, respectively. For example, a clamp which includes a lockable jaw for firmly gripping a length of a flexible attachment member inserted therein, a tooth and ratchet mechanism for re-locking the jaw each time an additional length of the flexible attachment member is pulled through and a release mechanism for unlocking the jaw, thereby releasing the flexible attachment member will be suitable for the purposes contemplated herein.

It is fully contemplated that the length of the first and second flexible attachment members 64 and 66 as well as the distance separating the first and second gripping members 46 and 48 from the bar member 44 may be readily varied without departing from the scope of the invention. It is noted, however, a length of between 18 and 23 inches is a suitable length for each of the flexible attachment members 64 and 66. Furthermore, when the first and second gripping members 46 and 48 are maintained at a roughly 60 degree angle relative to the first and second ends 52 and 54 of the bar member 44, a separation distance of between 6 and 8 inches is suitable for the uses contemplated herein. Preferably, the distance separating the first and second gripping members 46 and 48 from the bar member 44 is adjustable. To adjust the separation distance, after passing through the lockable jaw of the securing member, the second end 64*a*, 64*b* of the flexible attachment members 64, 66 pass through an access aperture (not visible) in the tubular sidewall 50. To shorten the separation distance, the user pulls the second ends 64*a*, 64*b*. In turn, an additional length of the flexible attachment members 64, 66 are pulled into the lockable jaw, which, upon the automatic relocking thereof, shortens the separation distance.

Of course, to prevent one end of the first and second gripping members 46 and 48 from becoming noticeably closer to the bar member than the other end thereof, it may be desirable to provide the securing structure with four clamping structures, one for each end of the first flexible attachment member 64 and one for each end of the second flexible attachment member 66. In such a configuration, it may also be desirable to affix the two ends of each of the first and second flexible attachment members 64 and 66 together, for example, using a two-cord pull or other coupling device so both ends of the flexible attachment members 64, 66 are retracted equal distances. Similarly, it may also be desirable to couple the release mechanisms together so that the ends are extended equal distances.

As may be further seen in FIG. 2*b*, when used in an exercise routine, the first and second gripping members 46 and 48 are maintained at a roughly 60 degree angle, relative to the ends 52 and 54 of the bar member 44, to form a general "U" shaped handle assembly in which the bar member forms the base of the U while the first and second gripping members 44 and 46 (and associated flexible attachment members 64 and 66) form respective angled members of the U.

Figure 2C:
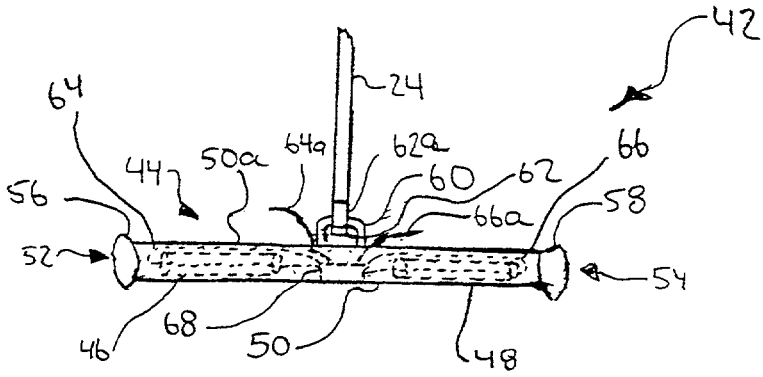
FIG. 2*c* is a top view of the handle assembly of FIG. 2*a* which shows both gripping thereof in a stored position.

Further advantages of the handle assembly 42 may be seen by reference to FIG. 2*c*. As may now be seen, in addition to the numerous advantages to be more fully described below which may be derived by performing exercise routines with the first and second gripping members 46 and 48 positioned in the extended position illustrated in FIG. 2*b*, it should be further noted that the handle assembly 42 may be readily converted to closely resemble a conventional bar such as the bar 22 by inserting each of the gripping members 46, 48 into the interior passageway defined by the tubular member 50. More specifically, the first gripping member 46 and the associated flexible attachment member 64 should be fully inserted into the passageway through the opening 52. Similarly, the second gripping member 48 and the associated flexible attachment member 66 should be fully inserted into the passageway through the opening 54. Once the gripping members 46 and 48 are inserted into the bar member 44, an alternate exercise routine, typically less rigorous than those performed with the gripping members 46, 48 in the extended position of FIG. 2*b*, may be performed. Furthermore, even if a user does not wish to perform an alternate exercise routine with the handle structure 42 reconfigured to closely resemble the bar 22 of FIGS. 1*a*–*b*, the handle assembly 42 is still useful in that it permits the gripping members 46, 48 to be conveniently stored inside the bar member 50 when not in use.

Figure 2D:
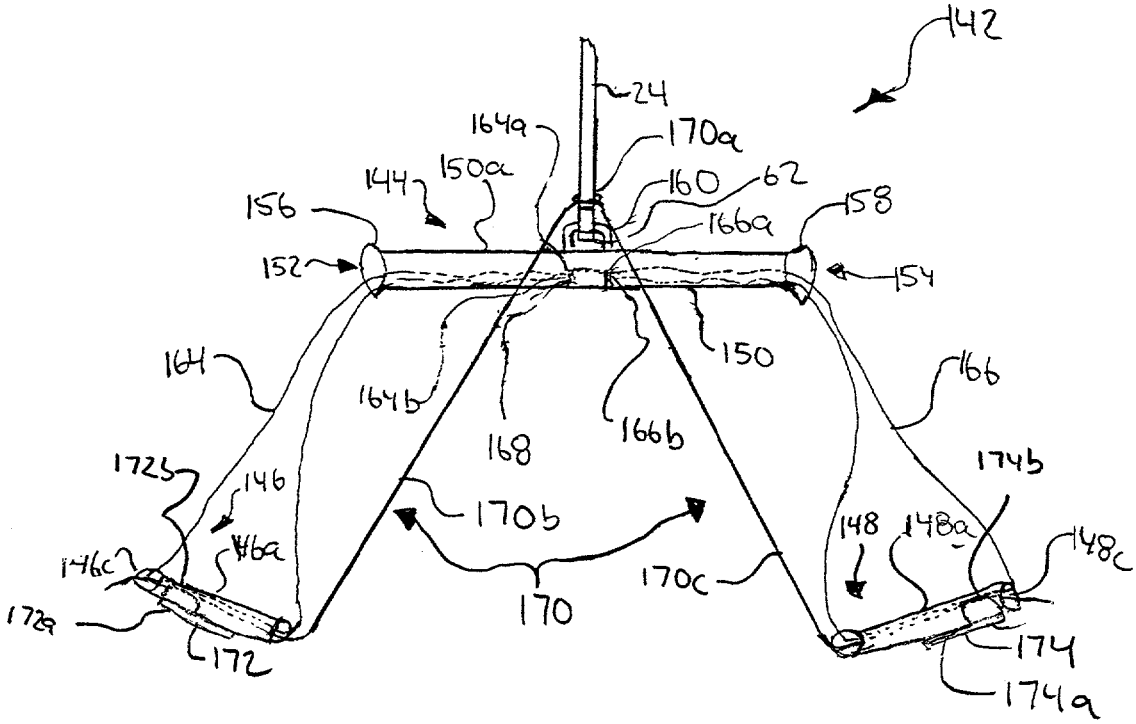
FIG. 2*d* is a top view of a third handle assembly constructed in accordance with the teachings of the present invention.

Referring next to FIG. 2*d*, yet another handle assembly 142, again shown in an artificially elevated position, constructed in accordance with the teachings of the present invention will now be described. Like the handle assemblies 30 and 42, the handle assembly 142 is uniquely configured such that, when used in conjunction with a rowing machine, the range of motion which may be achieved during the pull phase of a stroke is greatly improved, thereby achieving a wide array of benefits when used in place of a conventionally configured bar-shaped handle such as the handle 22. Again unlike the handle assembly 30, the handle assembly 142 is further uniquely configured to permit greater flexibility in the type of stroke which may be employed when the handle structure is coupled to a rowing machine. The handle assembly 142 is further enhanced over the handle assembly 42 in that the handle assembly 142 is configured for greater ease of use when adjusting the distance separating the gripping members from the bar member.

More specifically, and as may be clearly seen in FIG. 2*d*, the handle structure 142 includes a bar member 144, a first gripping member 146 and a second gripping member 148. The bar member 144, which is preferably formed from a hardened, relatively incompressible, material such as steel, has a generally tubular sidewall 150 which defines a generally cylindrical interior passageway which extends between first and second openings 152 and 154 of the bar member 144. The tubular sidewall 150 further includes a widened lip 156, 158 formed on opposite ends thereof. As a result therefore, the diameter of the generally circular openings 152 and 154 are slightly greater than the diameter of the generally cylindrical passageway extending therebetween. As before, while the bar member 144 may be dimensioned variously while remaining within the scope of the present invention, configuring the bar member 144 such that the distance separating the first end 152 from the second end 154 is between 14 and 16 inches while the interior passageway extending between the first and second ends 152 and 154 has a diameter between 1½ and 2 inches is suitable for the uses contemplated herein.

Fixedly attached to a front side surface 150*a* of the tubular sidewall 150 of the bar member 144 is a ring 160, typically formed of the same material as the tubular sidewall 150, used to removably secure the bar member 144 to the retractable cable 24. The ring 160 may be formed in the generally semi-circular shape illustrated herein or another suitable shape in which both ends of the ring 160 are fixedly attached to the bar member 144. The ring 160 may be fixedly attached to the tubular sidewall 150 of the bar member 144 using a welding process or other suitable securing technique. The cable 24 terminates in a ring 62, a section 62*a* of which is moveable between a first position (shown in FIG. 2*b*) in which the ring 62 is closed and a second position (not shown) in which the ring 62 is open. Typically, the section 62*a* is spring-loaded such that, in the absence of a force opposing the spring or other biasing means, the ring 62 will be kept in the closed position. To secure the bar member 144 to the cable 24, the section 62*a* of the ring 62 is moved into the open position. The bar member 144 is then hooked onto the cable 24 by inserting the ring 160 into the now opened ring 62. The section 62*a* is then released, thereby returning to the first position to close the ring 160 and secure the bar member 144 to the cable 24. Of course, it should be fully contemplated that the rings 160 and 62 are fully interchangeable. In other words, the ring 160 may have the moveable section while the ring 62 does not.

As may be further seen in FIG. 2*d*, attached to the bar member 144 are the first and second gripping members 146 and 148. Each one of the first and second gripping members 146 and 148 is comprised of a generally tubular sidewall 146*a*, 148*a* which defines a generally cylindrical interior passageway which extends between first and second ends 146*b*, 148*b* and 146*c*, 148*c*. Each of the first and second ends 146*b*, 148*b* and 146*c*, 148*c* are generally orthogonal to the generally tubular sidewall 146*a* and generally parallel to one another. Each of the first and second gripping member 146 and 148 is formed from a rigid, relatively incompressible material such as wood, metal, plastic, or the like, for example, using a cutting, molding or other suitable forming process. While the length of the first and second gripping members 146 and 148 may be readily varied without departing from the scope of the present invention, a length of between 4½ and 5 inches is suitable for the uses contemplated herein. Similarly, while the diameter of the first and second gripping members 146 and 148 may also be readily varied without departing from the scope of the present invention, a diameter of between ¾ and 1 inch is suitable for the uses contemplated herein.

Each of the first and second gripping members 146 and 148 are secured to the bar member 144 using a respective non-tensile flexible attachment member 164, 166. Alternately, the non-tensile flexible attachment members 164, 166 may be formed of any of the various commercially available non-tensile materials, for example, steel cable or nylon. To attach the first and second gripping members 146 and 148 to the bar member 144, one end of the respective non-tensile flexible attachment member 164, 166 is secured to the bar member 144. A second end is threaded through the interior passageway extending between the first and second ends 146*b* and 146*c*, 148*b* and 148*c* of the corresponding one of the first and second gripping members 146 and 148. The second end of the respective non-tensile flexible attachment members 164, 166 is then secured to the bar member 144.

Formed along the interior side surface of the tubular sidewall 150 in the general center thereof, is a securing structure 168 used to fixedly attach the non-tensile flexible attachment members 164 and 166 to the bar member 144. A first end 164*a*, 166*a* of each of the first and second non-tensile flexible attachment members 164 and 166 is fixedly secured to the securing structure 168. For example, if the non-tensile flexible attachment members 164 and 166 are steel cables, the first ends thereof may be welded to the securing structure 168. Alternately, if the non-tensile flexible attachment members 164 and 166 are nylon cords, the first ends thereof may be knotted, tied, clamped or otherwise secured to the securing structure 168. From the first end 164*a*, 166*a*, the first and second non-tensile flexible attachment members 164 and 166 exit through: (a) respective ends 152, 154 of the bar member 144; (b) interior passageways of the gripping members 146 and 148, respectively; and (c) respective ends 152, 154 of the bar member 144. The second end 164*b*, 166*b* of the first and second non-tensile flexible attachment members 164 and 166 are then fixedly secured to the securing structure 168, typically in the same manner as the first ends 164*a*, 166*b* were secured thereto. Thus, unlike the embodiment of the invention illustrated in FIGS. 2*b*–2*c*, in accordance with the embodiment illustrated in FIG. 2*d*, the separation distance between the bar member 144 and the gripping members 146, 148 cannot be shortened and/or lengthened by adjusting the securement of one or more of the ends 164*a* and 164*b*, 166*a* and 166*b* of the non-tensile flexible attachment members. As a result, the design of the securing structure 168 is simplified considerably. However, if desired, the securing structure may be constructed in the manner previously described with respect to FIG. 2*b* so that the securement of one or both ends of the non-tensile flexible attachment members 164 and 166 may be adjusted in the aforedescribed manner.

As may also be seen in FIG. 2*d*, the handle assembly 142 further includes a tensile flexible attachment member 170. One suitable material which may be used to form the tensile flexible attachment member 170 would be surgical tubing. The tensile flexible attachment member 170 is attached to the retractable cable 24 at a general center point 170*a* thereof. For example, as illustrated in FIG. 2*d*, the tensile flexible attachment member 170 is tightly looped around the retractable cable 24 at a point immediately above the ring 62 used to removably couple the bar member 144 to the retractable cable 24. Of course, the tensile flexible attachment member 170 can be suitably attached to a number of locations and/or using a number of coupling techniques. For example, if desired, the tensile flexible attachment member 170 may include a ring, similar to the ring 160, at the general center thereof, which enables the tensile flexible attachment member 170 to be removably coupled to the retractable cable 24, for example, using a hooking process. In another example, the tensile flexible attachment member 170 may have a clip or other hooking structure formed at the general center 170*a* thereof which enables the tensile flexible attachment member 170 to be hooked to the ring 160 or other attachment structure located in the general center of the outer side surface of the bar member 144.

From the general center 170*a* thereof, the tensile flexible attachment member 170 includes first and second segments 170*b* and 170*c*. From the general center 170*a*, the first segment 170*b* extends through the interior passageway of the first gripping member 144 and projects outwardly from the other side thereof. Similarly, the second segment 170*b* extends through the interior passageway of the second gripping member 146 and similarly projects outwardly from the other side thereof. Within the interior passage thereof, the first segment 170*a* of the tensile flexible attachment member 170 is adjustably secured to the first gripping member 146 by locking member 172. Likewise, the second segment 170*c* of the tensile flexible attachment member 170 is adjustably secured to the second gripping member 148 within the interior passageway thereof by locking member 174. By adjustably securing the first and second segments 170*b* and 170*c* to the first and second gripping members 146 and 148, the distance separating the first and second gripping members 146 and 148 from the bar member 144 may be adjusted in accordance with each individual user's preference.

The first and second locking members 172 and 174 may be variously configured and still suitably achieve the desired adjustable securement of the first and second segments 170*b* and 170*c* of the tensile flexible attachment member 170 to the first and second gripping members 146 and 148. For example, in FIG. 2*d*, each of the first and second locking members 172 and 174 are pivotably mounted to an exterior side surface of the first and second gripping members 144 and 146 by mounting means (not shown). Each locking member 172, 174 includes a lever portion 172*a*, 174*a* and a cam portion 172*b*, 174*b*. For each locking member 172, 174, the lever portion 172*a*, 174*a* extends along the exterior side surface of the corresponding gripping member 146, 148 while the cam portion 172*b*, 174*b* projects through an aperture in the gripping member 146, 148. Each locking member 172, 174 is pivotable between a first position shown in FIG. 2*d* and a second position (not shown). In the first position, the lever portion 172*a*, 174*a* is generally parallel to the exterior side surface of the gripping member 146, 148 and the cam portion 172*b*, 174*b* presses the segment 170*b*, 170*c* of the tensile flexible attachment member 170 extending through the interior passageway against the interior side surface of the gripping member 146, 148. In the second position, the lever portion 172*a*, 174*a* is generally orthogonal to the exterior side surface of the gripping member 146, 148 and the cam portion 172*b*, 174*b* no longer presses the segment 170*b*, 170*c* of the tensile flexible attachment member 170 extending through the interior passageway against the interior side surface of the gripping member 146, 148. Thus, to adjust the separation distance between the gripping members 146, 148 and the bar member 144, for example, to shorten the separation distance, each lever 172, 174 should be pivoted from the first position to the second position, an additional length of the first and second segments 170*b*, 170*c* pulled through the gripping members 146, 148 and the lever members 172, 174 pivoted back to the first position.

It is fully contemplated that the length of the first and second non-tensile flexible attachment members 164 and 166 as well as the distance separating the first and second gripping members 146 and 148 from the bar member 144 may be readily varied without departing from the scope of the invention. It is noted, however, a length of between 18 and 23 inches is a suitable length for each of the non-tensile flexible attachment members 164 and 166. Furthermore, when the first and second gripping members 46 and 48 are maintained at a roughly 60 degree angle relative to the first and second ends 152 and 154 of the bar member 144, a separation distance of between 6 and 8 inches is suitable for the uses contemplated herein. Accordingly, the tensile flexible attachment member 170 should be appropriately sized such that the desired separation distance is achieved. However, the length of the tensile flexible attachment member 170 may be varied since the distance separating the first and second gripping members 146 and 148 from the bar member 144 is readily adjustable as hereinabove described It is further contemplated that the thickness of the tensile flexible attachment member 170 may also be varied. For example, if surgical tubing is employed as the tensile flexible attachment member 170, there are at least 4 different thicknesses of surgical tubing which would be suitable for use. Selection of the thickness of the tensile flexible attachment member 170 would be varied based upon the ability of the intended user and/or the intensity of the exercise protocols to be employed using a rowing machine having the handle assembly 142 associated therewith. More specifically, as the thickness of the tensile flexible attachment member 170 is increased, the gripping members 146 and 148 would be more closely aligned with the general center 170*a* of the tensile flexible attachment member 170. Conversely, as the thickness of the tensile flexible attachment member 170 is decreased, the gripping members 146 and 148 would be more closely aligned with the openings 152, 154 in the bar member 144. Generally, for novice users, the thickness of the tensile flexible attachment member 170 should be selected such that the gripping members 146 and 148 are closely aligned with the openings 152 and 154 while, for more experienced users, the thickness of the tensile flexible attachment member 170 should be selected such that the gripping members 146 and 148 are at roughly a 45 degree angle relative to the general center 170*a* of the tensile flexible attachment member 170.

As may be further seen in FIG. 2*d*, when used in an exercise routine, the first and second gripping members 146 and 148 are maintained at a roughly 60 degree angle, relative to the ends 152 and 154 of the bar member 144, to form a general "U" shaped handle assembly in which the bar member forms the base of the U while the first and second gripping members 144 and 146 (and associated non-tensile flexible attachment members 164 and 166) form respective angled members of the U.

Further advantages of the handle assembly 142 shall now be described. More specifically, in addition to the numerous advantages to be more fully described below which may be derived by performing exercise routines with the first and second gripping members 146 and 148 positioned in the extended position illustrated in FIG. 2*b*, it should be further noted that the handle assembly 142 may be readily converted to closely resemble a conventional bar such as the bar 22 by inserting each of the gripping members 146, 148 into the interior passageway defined by the tubular member 150. More specifically, the first gripping member 146 and the associated non-tensile flexible attachment member 164 should be fully inserted into the passageway through the opening 152. Similarly, the second gripping member 148 and the associated non-tensile flexible attachment member 166 should be fully inserted into the passageway through the opening 154. Once the gripping members 146 and 148 are inserted into the bar member 144, the handle assembly 142 would appear very similar to the handle assembly 42 as illustrated in FIG. 2*c* except, of course, that at least part of the tensile flexible attachment member 170 would remain outside the tubular member 150. Once reconfigured in this manner, an alternate exercise routine, typically less rigorous than those performed with the gripping members 146, 148 in the extended position of FIG. 2*b*, may be performed. Furthermore, even if a user does not wish to perform an alternate exercise routine with the handle structure 142 reconfigured to closely resemble the bar 22 of FIGS. 1*a–b*, the handle assembly 142 is still useful in that it permits the gripping members 146, 148 to be conveniently stored inside the bar member 150 when not in use.

Figure 3A:
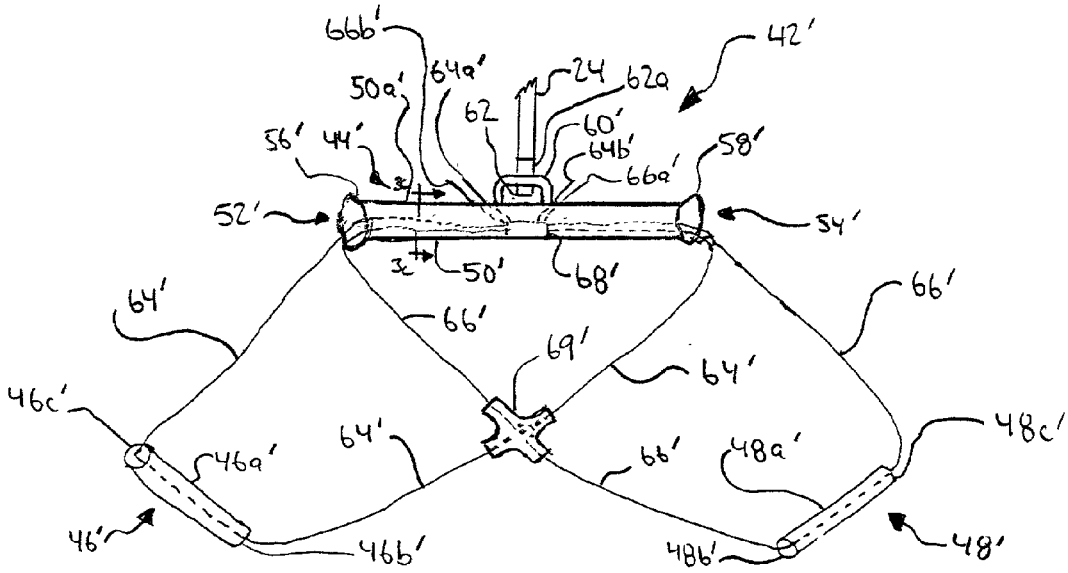
FIG. 3*a* is a top view of a fourth handle assembly constructed in accordance with the teachings of the present invention.

Referring next to FIG. 3*a*, still yet another handle assembly 42', again shown in an artificially elevated position, constructed in accordance with the teachings of the present invention will now be described. Like the handle assemblies 30 and 42, the handle assembly 42' is uniquely configured such that, when used in conjunction with a rowing machine, the range of motion which may be achieved during the pull phase of a stroke is greatly improved, thereby achieving a wide array of benefits when used in place of a conventionally configured bar-shaped handle such as the handle 22. Similar in structure to the handle structure 42, the handle assembly 42' shares therewith a unique configured to permit greater flexibility in the type of stroke which may be employed when the handle assembly 42' is coupled to a rowing machine.

More specifically, and as may be clearly seen in FIG. 3*a*, the handle assembly 42' a includes a bar member 44', a first gripping member 46' and a second gripping member 48'. The bar member 44', which is preferably formed from a hardened, relatively incompressible, material such as steel, has a generally tubular sidewall 50' which defines a generally cylindrical interior passageway which extends between first and second openings 52' and 54' of the bar member 44'. The tubular sidewall 50' further includes widened lips 56', 58' formed on opposite ends thereof. As a result therefore, the diameter of the generally circular openings 52' and 54' are slightly greater than the diameter of the generally cylindrical passageway extending therebetween. As before, while the bar member 44' may be dimensioned variously while remaining within the scope of the present invention, configuring the bar member 44' such that the distance separating the first end 52' from the second end 54' is between 14 and 16 inches while the interior passageway extending between the first and second ends 52' and 54' has a diameter between 1½ and 2 inches is suitable for the uses contemplated herein.

Fixedly attached to a front side surface 50*a'* of the tubular sidewall 50' of the bar member 44' is a ring 60', typically formed of the same material as the tubular sidewall 50', for removably securing the bar member 44' to the retractable cable 24. The ring 60' may be formed in the generally semi-circular shape illustrated herein or another suitable shape in which both ends of the ring 60' are fixedly attached to the bar member 44'. The ring 60' may be fixedly attached to the tubular sidewall 50' of the bar member 44' using a welding process or other suitable securing technique. The cable 24 terminates in a ring 62, a section 62*a* of which is moveable between a first position (shown in FIG. 3*a*) in which the ring 62 is closed and a second position in which the ring 62 is open. Typically, the section 62*a* is spring-loaded such that, in the absence of a force opposing the spring or other biasing means, the ring 62 will be kept in the closed position. To secure the bar member 44' to the cable 24, the section 62*a* of the ring 62 is moved into the open position. The bar member 44' is then hooked onto the cable 24 by inserting the ring 60 into the now opened ring 62. The section 62*a* is then released, thereby returning to the first position to close the ring 60 and secure the bar member 44' to the cable 24. Of course, it should be fully contemplated that the rings 60' and 62 are fully interchangeable. In other words, rather the above-described configuration, the ring 60' may be configured to have the spring-loaded moveable section which may be opened to permit the ring 62 to be hooked thereto.

As may be further seen in FIG. 3*a*, attached to the bar member 44' are the first and second gripping members 46' and 48'. Each one of the first and second gripping members 46' and 48' is comprised of a generally tubular sidewall 46*a*', 46*b*' which defines a generally cylindrical interior passageway which extends between first and second ends 46*b*', 48*b*' and 46*c*', 48*c*'. Each of the first and second ends 46*b*', 48*b*' and 46*c*', 48*c*' are generally orthogonal to the tubular sidewall 46*a*', 48*a*' and generally parallel to one another. Each of the first and second gripping member 46' and 48' is formed from a rigid, relatively incompressible material such as wood, metal, plastic, or the like, for example, using a cutting, molding or other suitable forming process. While the length of the first and second gripping members 46' and 48' may be readily varied without departing from the scope of the present invention, a length of between 4½ and 5 inches is suitable for the uses contemplated herein. Similarly, while the diameter of the first and second gripping members 46' and 48' may also be readily varied without departing from the scope of the present invention, a diameter of between ¾ and 1 inch is suitable for the uses contemplated herein.

Each of the first and second gripping members 46' and 48' are secured to the bar member 44' using a respective flexible attachment member 64', 66' attached, on both ends thereof, to a securing structure 68'. Alternately, the flexible attachment members 64', 66' may be formed of either a tensile material such as surgical tubing or a non-tensile material such as a steel cable or nylon. The securing structure 68' is formed along the interior side surface of the tubular sidewall 50 in the general center thereof and is, therefore, shown in phantom in FIG. 3*a*. The securing structure 68' includes first, second, third and fourth clamps (not shown) for adjustably securing the first end of the first flexible attachment member 66', the second end of the first flexible attachment member 66', the first end of the second flexible attachment member 66' and the second end of the second flexible attachment member 66', respectively. It is contemplated that clamping devices of various designs are suitable for the uses contemplated herein. For example, a clamp which includes a lockable jaw for firmly gripping a length of a flexible attachment member inserted therein, a tooth and ratchet mechanism for re-locking the jaw each time an additional length of the flexible attachment member is pulled through the jaw and a release mechanism for unlocking the jaw, thereby releasing the flexible attachment member is suitable for the purposes contemplated herein.

The flexible attachment members 64', 66' may be attached to the securing structure 68' using a wide variety of techniques, one of which is be disclosed herein for illustrative purposes. A first end 64*a*' of the first flexible attachment member 64' is inserted through the first end 52' of the bar member 44' and into the interior passageway defined by the tubular member 50'. The first end 64*a* of the first flexible attachment member 64' is fed through the interior passageway until coming into proximity with the securing structure 68'. Using an access aperture (not shown), the first end 64*a* of the first flexible attachment member 64' is then fed through the jaw of a first clamp of the securing structure 68 and pulled through the access aperture until it protrudes a short distance from the bar member 44' as shown in FIG. 3*a*.

After securing the first end 64*a* of the first flexible attachment member 64' to the securing member 68', a second end 64*b* of the first flexible attachment member 64 is inserted through a second opening 46*c*' in the first gripping member 46*a*', fed through the interior passageway and out the first opening 46*b*' thereof. From there, the second end 64*b* of the first flexible attachment member 64' is fed through a first interior passageway (not shown) in a clasp member 69', the second opening 54' and the interior passageway defined by the tubular sidewall 50' until coming into proximity with the securing structure 68'. Using a second access aperture (not shown), the second end 64*b* of the first flexible attachment member 64' is then fed through the jaw of a second clamp of the securing structure 68 and pulled through the access aperture until it protrudes a short distance from the bar member 44' as shown in FIG. 3*a*.

The second gripping member 48' is attached using a similar technique. More specifically, a first end 66*a*' of the second flexible attachment member 66' is inserted through the second end 54' of the bar member 44' and fed through the interior passageway defined by the tubular member 50' until coming in proximity to the securing structure 68'. Using the same access aperture used to secure the second end 64*b* of the first flexible attachment member 64', the first end 66*a*' of the second flexible attachment member 66' is then fed through the jaw of a third clamp of the securing structure 68' and pulled through the access aperture until it protrudes a short distance from the bar member 44' as shown in FIG. 3*a*. A second end 66*b* of the second flexible attachment member 66 is then fed through a second opening 48*c*' in the second gripping member 48*a*', the interior passageway defined by the main body portion 48*a*', the first opening 48*b*', a second interior passageway (not shown) in the clasp member 69', the first opening 54' and the interior passageway defined by the tubular sidewall 50' until coming into proximity with the securing structure 68'. Using the access aperture previously used to secure the first end 64*a*' of the first flexible attachment member 64', the second end 66*b*' of the second flexible attachment member 66' is then fed through the jaw of a fourth clamp of the securing structure 68 and pulled through the access aperture until it protrudes a short distance from the bar member 44' as shown in FIG. 3*a*. It should be noted that, for illustrative convenience, in FIG. 3*a*, the portion of the second flexible attachment member 66' passing through the second interior passageway within the clasp member 69' is illustrated as "jumping" over that portion of the first flexible attachment member 64' passing through the first interior passageway within the clasp member 69'. In fact, the respective interior passageways through which the first and second flexible attachment members 64' and 66' pass are formed along respective planes generally parallel to a top side surface of the clasp member 69'. As a result, a first one of the first and second flexible attachment members 64' and 66' simply passes over the other.

It is fully contemplated that the length of the first and second flexible attachment members 64' and 66' as well as the distance separating the first and second gripping members 46' and 48' from the bar member 44' may be readily varied without departing from the scope of the invention. It is noted, however, a length of between 18 and 23 inches is a suitable length for each of the flexible attachment members 64' and 66'. Furthermore, when the first and second gripping members 46 and 48 are maintained at a roughly 45 degree angle relative to the first and second ends 52 and 54 of the bar member 44, a separation distance of between 6 and 8 inches is suitable for the uses contemplated herein.

As may be further seen in FIG. 3*a*, when used in an exercise routine, the first and second gripping members 46' and 48' are maintained at a roughly 60 degree angle, relative to the ends 52' and 54' of the bar member 44, to form, in a manner similar to that formed using the handle assembly 42 illustrated in FIG. 2*b*, a general "U" shaped handle assembly in which the bar member 44' forms the base of the U while the first and second gripping members 46' and 46' (and associated flexible attachment members 64' and 66') form respective angled members of the U.

Figure 3B:
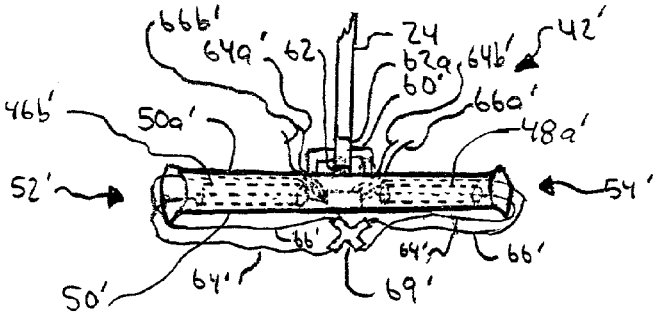
FIG. 3*b* is a top view of the handle assembly of FIG. 3*a* which shows both gripping members thereof in a stored position.

Referring next to FIG. 3*b*, further advantages of the handle assembly 42' will now be described in greater detail. As may now be seen, in addition to the numerous advantages to be more fully described below which may be derived by performing exercise routines with the first and second gripping members 46' and 48' positioned in the extended position illustrated in FIG. 3*a*, it should be further noted that the handle structure 42' may be readily converted to closely resemble a conventional bar such as the bar 22 by inserting each of the gripping members 46', 48' into the interior passageway defined by the tubular member 50'. More specifically, the first gripping member 46' should be fully inserted into the passageway through the opening 52' such that the second end 46*c*' first enters the interior passageway. Similarly, the second gripping member 48' should be fully inserted into the passageway through the opening 54' such that the second end 48*c*' first enters the passageway. Unlike the prior embodiment of the handle assembly 42, it should be acknowledged that a portion of both the first and second flexible attachment members 64' and 66', specifically, the length that passes through the clasp member 69' will remain outside of the bar member 44' even when both of the gripping members 46' and 48' are fully inserted herein.

Once the first and second gripping members 46' and 48' are inserted into the bar member 44', an alternate exercise routine, typically less rigorous than those performed with the first and second gripping members 46' and 48' in the extended position of FIG. 3*a*, may be performed. Furthermore, even if a user does not wish to perform an alternate exercise routine with the handle assembly 42' reconfigured to closely resemble the bar 22 of FIGS. 1*a–b*, the handle structure 42' is still useful in that it permits the first and second gripping members 46' and 48' to be conveniently stored inside the bar member 50' when not in use. To further enhance the convenience of storing the first and second gripping members 46' and 48' inside the bar member 50', the bar member 50' is provided with additional structure for receiving the first and second flexible attachment members 64' and 66' within the bar member 50'.

Figure 3C:
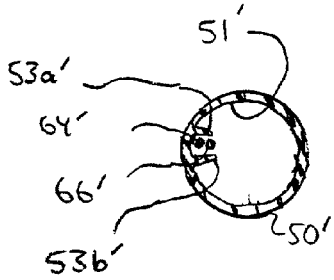
FIG. 3*c* is a cross-sectional view of the handle assembly of FIG. 3*a* taken along lines 3*c*—3*c* thereof.

This additional structure can best be seen by reference to FIG. 3*c*. As may now be seen, formed along an interior side surface 51' of the generally tubular bar member 50' are first and second projections 53*a*' and 53*b*', both of which project into the interior passageway defined by the interior side surface 51' of the generally tubular bar member 50' and laterally extend along the generally tubular bar member 50'. The first and second projections 53*a*' and 53*b*' collectively form a channel for receiving the flexible attachment members 64' and 66'. As the interior passageway must still accommodate the gripping members 46' and 48', further modifications may be necessary. For example, to compensate for the channel, a complementary detent may be formed in each one of the gripping members 46' and 48'. Of course, other structures, for example, indentations or depressions, are equally suitable for retaining the flexible attachment members 64' and 66' within the interior passageway.

Heretofore, rowing machines have been designed as single plane rowing machines configured such that the stroke axis thereof is located in a plane generally parallel to the surface on which the rowing machine apparatus is supported. The rowing machine 10 illustrated in FIG. 1*a* is one such apparatus. In contrast, the present invention is directed to a rowing machine configured for operation in multiple planes, including planes in which the stroke axis is not generally parallel to the surface on which the rowing machine is supported. These planes include what are hereafter referred to as "declined" and "inclined" planes. When a rowing machine is operated in the declined plane, the distance separating the stroke axis from the support surface increases during the pull phase of a stroke and decreases during the flex phase thereof. Conversely, when a rowing machine is operated in the inclined plane, the distance separating the stroke axis from the support surface decreases during the pull phase of a stroke and increases during the flex phase thereof.

The present invention is further directed to a handle assembly suitable for use with either a conventional rowing machine limited to operation in a single plane generally parallel to the plane on which the rowing machine is supported or with a rowing machine configured for operation in one or more of the aforedefined inclined or declined planes in which the stroke axis is not generally parallel to the surface on which the rowing machine is supported. Whereas use of a bar-type handle with a rowing machine limited the final position of the pull phase of the stroke to a position where the bar-type handle rests against the waist (for a low-pull phase), chest (for a mid-pull phase), or neck (for a high-pull phase), when a handle structure having either a general Y or general U shaped configuration is used in conjunction with the same rowing machine, the user may extend the pull phase of a stroke since the gripping members held by the user no longer directly act as the limiter on the displacement of the handle assembly. Thusly, the pulling distance for a stroke is lengthened by 6 to 10 inches. As a result, additional time to develop higher power peak and more total work, i.e., calorie burn, is available. Typically, this would raise watt output by 15–25 percent for each stroke. Furthermore, as previously noted, unlike exercise protocols having a limited pull stroke, an exercise protocol characterized by an extended pull stroke enables a user to enjoy an extended range of motion, thereby enabling the user to preferentially emphasize selected ones of the hand/wrist, elbow and shoulder joint a complexes, individually and/or as a continuous kinetic chain.

Figure 4A:
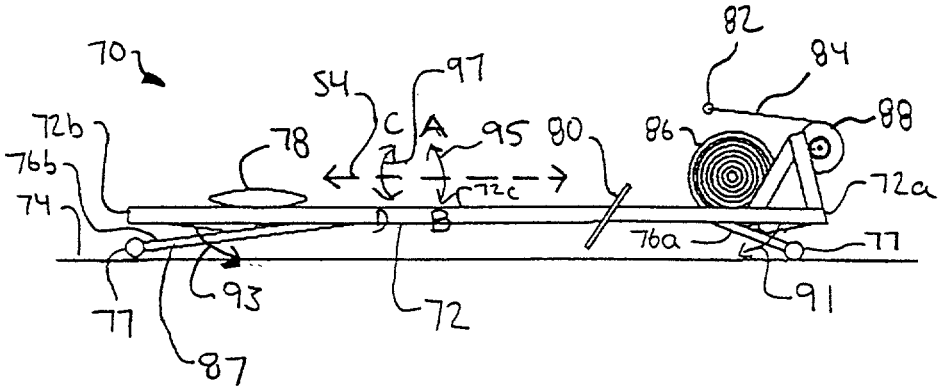
FIG. 4*a* is a side view of a rowing machine configured for operation in plural inclined and plural declined positions.
Figure 4B:
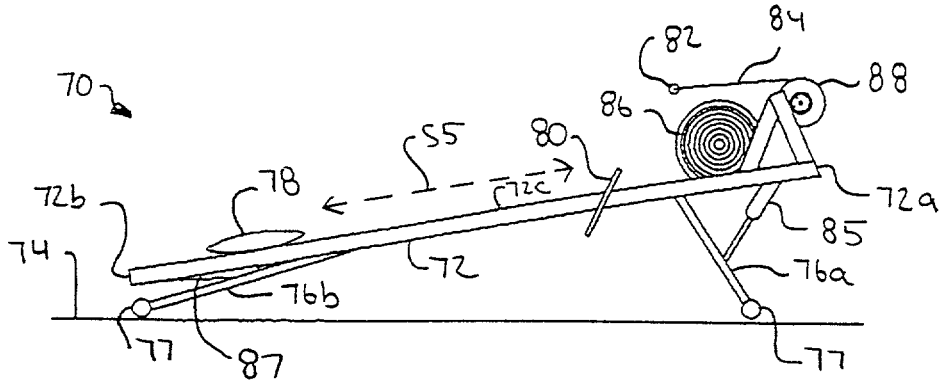
FIG. 4*b* is a side view of the rowing machine of FIG. 4*a* in a full-inclined position.
Figure 4C:
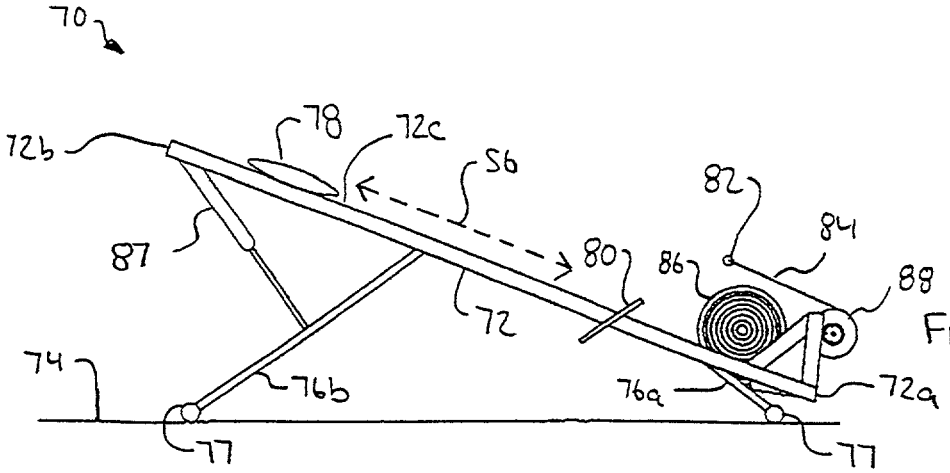
FIG. 4*c* is a side view of the rowing machine of FIG. 4*a* in a full-declined position.

Referring next to FIGS. 4*a–c*, a rowing machine 70 configured for operation in plural inclined and plural declined planes shall now be described in greater detail. For purposes of better continuity with the disclosure of U.S. patent application Ser. No. 09/925,934, the parent of the present application and previously incorporated by reference, it should be noted that, as illustrated in FIGS. 4*a–c*, the handle used with the rowing machine is a bar-shaped similar to that illustrated in FIGS. 1*a–b*. It should be clearly understood, however, that the disclosed handle may be readily replaced with one of the novel handle assemblies described and illustrated with respect to FIGS. 2*a*–3*b*. The multi-planar rowing machine 70 includes a rail member 72 supportably mounted above a generally horizontal support surface 74, for example, a floor. The rail member 72 is supported above the support surface 74 by a pair of front support beams 76*a* and a pair of rear support beams 76*b*, only one of each of which is visible in FIGS. 4*a–c*. The multi-planar rowing machine 70 further includes a seat 78, a pair of foot pads 80 (only one of which is visible in FIGS. 4*a–c*), and a bar 22. The seat 78 is slidably attached to the rail member 72 by a sliding mechanism, hidden from view in FIGS. 4*a–c*, which enables the seat 78 to slide along the rail 78. Typically, the sliding mechanism includes a slot longitudinally formed along an upper side surface 72*c* of the rail member 72 such that a projection (not visible) extending downwardly from a lower side surface of the seat 78 may be slidably inserted therein. Each one of the foot pads 80 (only one of which is visible in FIGS. 4*a–c*) is coupled to a respective side of the rail member 72. The bar 82, which is typically grasped and pulled by a user during an exercise routine, is shown in an artificially elevated position in FIGS. 4*a–c* to enhance the visibility thereof. The bar 82 is coupled to a retractable cable 84, which, in turn is coupled to an air fan wheel 86 via a pulley 88 and a ratchet gear mechanism (not shown) located within the air fan wheel 86.

The front support beams 76*a* are pivotably coupled to the rail member 72 such that the front support beam 76*a* is freely pivotable between a first position illustrated in FIGS. 4*a* and 4*c* and a second position illustrated in FIG. 4*b*. Similarly, each one of the back support beams is pivotably coupled to the rail member 72 such that the back support beam 76*b* is freely pivotable between a first position illustrated in FIGS. 4*a* and 4*b* and a second position illustrated in FIG. 4*c*. It is generally preferred that the ratio of the distance that a back end 72*b* of the multi-planar rowing machine 70 may be elevated above the full-horizontal position relative to the distance that a front end 72*a* may be elevated above the full-horizontal position is approximately 2:1. Accordingly, to achieve this objective, and as illustrated in FIGS. 4*a–*4*c*, the back support beam 76*b* would have a length roughly twice that of the front support beam 76*a*.

In this embodiment, movement of the front support beam 76*a* between these positions is accomplished by a piston 85 mounted between the rail member 72 and the front support beam 76*a* at an acute angle thereto. The piston 85 is configured to selectively expand and/or retract to any point between a fully retracted position illustrated in FIGS. 4*a* and 4*c* and a fully expanded position illustrated in FIG. 4*b*. Again, to achieve the aforementioned 2:1 ratio, the piston 87 should be expandable to twice the length of the piston 85. It is contemplated that a variety of techniques may be used to drive the piston 85 between the fully expanded and the fully retracted positions. For example, a compressed air source (not shown) coupled to the piston 85 may be opened to initiate a flow of air into an interior chamber of the piston 85, thereby causing the piston 85 to expand from the position illustrated in FIG. 4*a* into the position illustrated in FIG. 4*b*. Conversely, a relief valve (also not shown) in communication with the interior chamber of the piston 85 may be opened to initiate a flow of air out of the interior chamber of the piston, thereby causing the piston 85 to retract from the position illustrated in FIG. 4*b* into the position illustrated in FIG. 4*c*.

Similarly, each one of the back support beams 76*b* is pivotably mounted to the rail member 72 such that the back support beam 76*b* is freely pivotable between a first position illustrated in FIGS. 4*a* and 4*b* and a second position illustrated in FIG. 4*c*. In this embodiment, movement of the back support beam 76*b* between these positions is accomplished by a piston 87 mounted between the rail member 72 and the back support beam 76*b* at an acute angle thereto. Like the piston 85, the piston 87 is configured to selectively expand and/or retract to any point between a fully retracted position illustrated in FIGS. 4*a* and 4*b* and a fully expanded position illustrated in FIG. 4*c* using any one of a variety of techniques. Accordingly, the pistons 85 and 87 may be variously configured as the aforedescribed pneumatic pistons or as hydraulic pistons. Furthermore, the pistons 85 and 87 may variously be manually or automatically actuated, for example, using one or more control knobs or an electronic console. Of course, various other mechanisms could be used to perform the adjustment of the support beams 76*a* and 76*b*, including hydraulic, pneumatic, electrical motors, etc.

In FIG. 4*a*, the multi-planar rowing machine 70 is in a full-horizontal position achieved by arranging each of the front support beams 76*a* and the back support beams 76*b* into the first position by driving the pistons 85 and 87 into the fully retracted position. Use of the multi-planar rowing machine 70 in the full-horizontal position would produce a rowing motion in which both the pull and flex phases of each stroke are along a stroke axis S4 located within a single plane generally horizontal and parallel with the support surface 74. To operate the multi-planar rowing machine 70 in a selected inclined position, the user would cause piston 85 to expand. As the piston 85 expands, the front support beam 76*a* would pivot, along pivot axis 91, from the first position illustrated in FIG. 4*a* towards the second position illustrated in FIG. 4*b*. As the front support beam 76*a* pivots, the front end 72*a* of the multi-planar rowing machine 70 begins to elevate, thereby pivots the stroke axis S4, in direction A along pivot axis 95, towards stroke axis S5. By allowing the piston 85 to fully expand, the user may elevate the front end 72*a* of the multi-planar rowing machine 70 to the fully inclined position illustrated in FIG. 4*b* in which the pull and flex phases are along an inclined stroke axis, specifically the stroke axis S5, and the front end 72*a* is elevated (approximately 16-inches for the preferred embodiment) above the full horizontal position illustrated in FIG. 4*a*.

To operate the multi-planar rowing machine 70 in a selected declined position, the user would cause the piston 87 to expand (if the multi-planar rowing machine 70 is in the full-horizontal position illustrated in FIG. 4*a*) or cause the piston 85 to retract and the piston 87 to expand (if the multi-planar rowing machine 70 is in an inclined position such as the full-inclined position illustrated in FIG. 4*b*). If the multi-planar rowing machine 70 is in the full-horizontal position, as the piston 87 expands, the back support beam 76*b* would pivot, along pivot axis 93, from the first position illustrated in FIG. 4*a* towards the second position illustrated in FIG. 4*c*. As the back support beam 76*b* pivots, the back end 72*b* of the multi-planar rowing machine 70 begins to elevate, thereby pivoting the stroke axis S4, in direction C along pivot axis 97, towards stroke axis S6. By allowing the piston 87 to fully expand, the user may elevate the back end 72*a* of the multi-planar rowing machine 70 to the fully declined position illustrated in FIG. 4*c* in which the pull and flex phases are along a declined stroke axis, specifically, the stroke axis S6, and the back end 72*b* is elevated (approximately 32-inches for the preferred embodiment) above the full-horizontal position illustrated in FIG. 4*a*. If the multi-planar rowing machine 70 is in an inclined position such as the full-inclined position illustrated in FIG. 4*b*, the user would need to both retract the piston 85 and expand the piston 87. It is contemplated that the retraction of the piston 85 and expansion of the piston 87 may either be executed in sequence or, if desired, simultaneously. If executed in sequence, by retracting the piston 85 first, the user would first cause the front support beam 76*a* to pivot, in the opposite direction along the pivot axis 91, from the second position illustrated in FIG. 4*a* to the first position illustrated in FIGS. 4*a* and 4*c*. In turn, the stroke axis of the multi-planar rowing machine 70 would pivot, in direction B along the pivot axis 95, from the stroke axis S5 towards the stroke axis S6. The user would then cause the piston 87 to expand in the manner previously described. Finally, from the full-declined position illustrated in FIG. 4*c*, the user may return the multi-planar rowing machine 70 to the full-horizontal position by retracting the piston 87, thereby causing the back support beam 76 to pivot, in the opposite direction along the pivot axis 93, from the second position illustrated in FIG. 4*c* to the first position illustrated in FIGS. 4*a* and 4*b*. In turn the stroke axis of the multi-planar rowing machine 70 would pivot in direction D along the pivot axis 97, from the stroke axis S6 towards the stroke axis S4.

By utilizing a pair of pistons 85 and 87 to pivot the front and back support beams 76*a* and 76*b*, the user may operate the multi-planar rowing machine 70 in virtually an unlimited number of inclined positions ranging between the full-horizontal position of FIG. 4*a* and the full-inclined position of FIG. 4*b* as well as a virtually unlimited number of declined positions ranging between the full-horizontal position of FIG. 4*a* and the full-declined position of FIG. 4*c*.

Figure 5A:
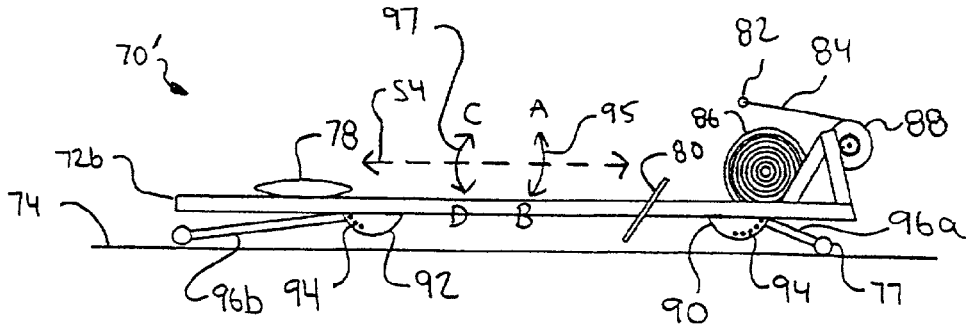
FIG. 5*a* is a side view of an alternate embodiment of a rowing machine configured for operation in plural inclined and declined positions.
Figure 5B:
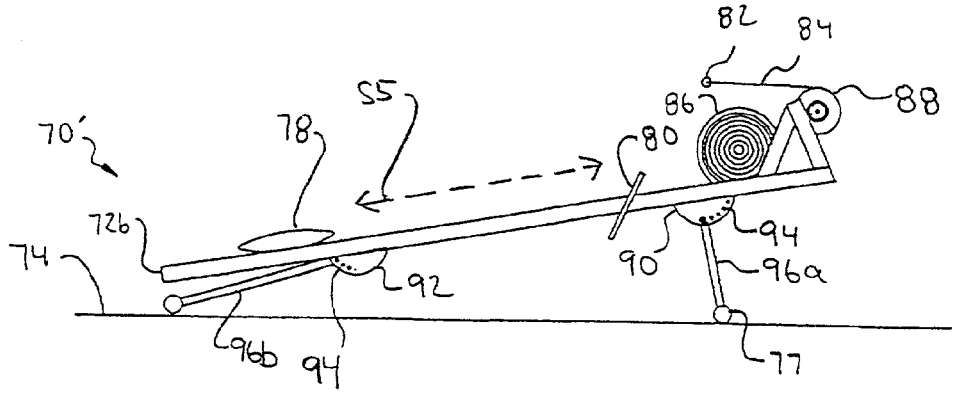
FIG. 5*b* is a side view of the rowing machine of FIG. 5*a* in a full-inclined position.
Figure 5C:
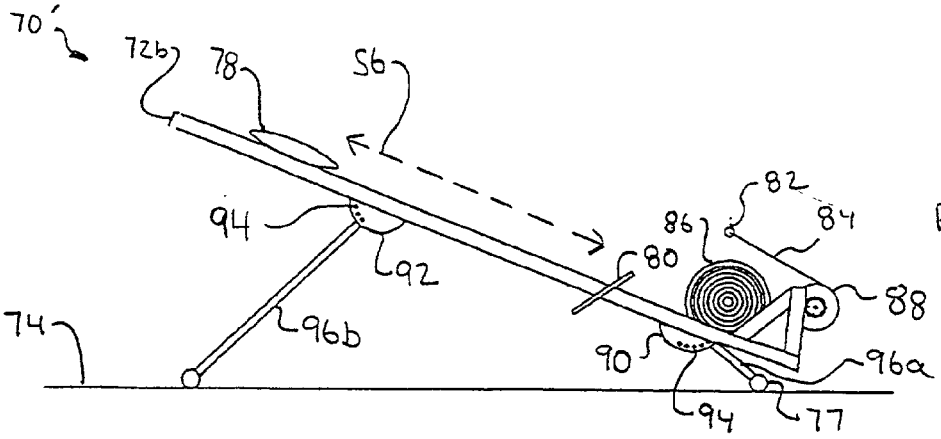
FIG. 5*c* is a side view of the rowing machine of FIG. 5*a* in a full-declined position.

Referring next to FIGS. 5*a–c*, an alternate embodiment of the multi-planar rowing machine 70, hereafter referred to as multi-planar rowing machine 70', will now be described in greater detail. It should be again noted that, for purposes of better continuity with the disclosure of U.S. patent application Ser. No. 09/925,934, the parent of the present application and previously incorporated by reference, as illustrated in FIGS. 5*a–c*, the handle used with the rowing machine is a bar-shaped similar to that illustrated in FIGS. 1*a–b*. It should be clearly understood, however, that the disclosed handle may be readily replaced with one of the novel handle assemblies described and illustrated with respect to FIGS. 2*a*–3*b*. The multi-planar rowing machine 70' operates in a manner similar to the multi-planar rowing machine 70. Here, however, the multi-planar rowing machine 70' is limited to operation in a discrete number of inclined positions and a discrete number of declined positions. More specifically, for the multi-planar rowing machine 70', the piston-driven-type support structure of the multi-planar rowing machine 70 has been replaced by a pin-and-socket-type support structure. The pin-and-socket type support structure includes a front flange member 90 and a back flange member 92, both coupled to the rail member 72 or another portion of the support structure for the rowing machine 70' not visible in FIGS. 5*a–c*. A series of apertures 94 are formed in each of the front and back flange members 90 and 92. Preferably, the apertures 94 formed on each of the front and back flange members 90 and 92 are formed in a generally circular-spaced relationship. Front and back support members 96*a* and 96*b* are pivotably coupled to the front and back flange members 90 and 92, respectively. The front support member 96*a* is pivotable between a first position illustrated in FIG. 5*a* and a second position illustrated in FIG. 5*b* and secured in a selected one of these (or an intermediate) position by a first locking pin (not shown) which extends through the front support member 96*a* and into one of the apertures 94. Similarly, the back support member 96*b* is pivotable between a first position illustrated in FIG. 5*a* and a second position illustrated in FIG. 5*c* and secured in a selected one of these (or an intermediate position) by a second locking pin (also not shown) which extends through the back support member 96*b* and into one of the apertures 94. To pivot the front and second support members 96*a* and 96*b* between positions, the corresponding locking pin is removed. The exercise machine 70' is then repositioned until the aperture in the support member 96*a* or 96*b* being pivoted aligns with the selected one of the apertures 94. The locking pin is then re-inserted through the support member 96*a* or 96*b* and the selected aperture to secure the support member 96*a* or 96*b* in the selected position.

Having described and illustrated various multi-planar exercise apparatus, specifically, a multi-planar rowing machine uniquely configured for selective operation in either inclined or declined positions, various exercise protocols suitable for use with the multi-planar exercise apparatus shall now be described in greater detail. The protocols shall be described with respect to a series of schematic diagrams, of which FIGS. 6*a* through 6*m* and 8*a* through 8*c* disclose exercise protocols for use in conjunction with a multi-planar rowing machine 100 in the declined position while FIGS. 7*a* through 7*e* and 9*a* through 9*e* disclose exercise protocols for use in conjunction with a multi-planar rowing machine 100 in the inclined position. Generally, however, it should be noted that the exercise-stimulus effect of performing an exercise protocol using the multi-planar rowing machine 100 in either the declined position or the inclined position is significant. More specifically, the combination of isokinetic resistance and resistance due to gravity resulting from having to "flex" uphill against gravity and "pull" downhill while stabilizing the torso in the inclined position and "pull" uphill against gravity and "flex" downhill in the declined position has created a new exercise potential heretofore unknown for rowing machines. As a result, the exercise protocols disclosed herein produce significant resistance to both flexors and extensors in the three major body segments—trunk, upper leg and lower leg. Furthermore, it should be noted that the elbow flexors (or biceps) are constantly stimulated by the action of rowing in either the inclined or declined positions while the elbow extensors (or triceps) act as antagonists to the biceps or as unresisted elbow extensors during a flex phase of a stroke in either the inclined or declined positions.

By using, in conjunction with a rowing machine, a general Y-shaped handle structure 30 or a general U-shaped handle assembly 42, 42' or, as illustrated in each one of FIGS. 6*a* through 9*e*, the general U-shaped handle assembly 142 of FIG. 2*d*, a much expanded range of exercise movement options are enabled. For the hand/wrist, they including include: a) full anatomic range of motion supination; b) full anatomic range of motion pronation; c) simultaneous full range of motion supination plus extension plus radial deviation; and d) simultaneous full range of motion pronation plus flexion plus ulnar deviation. For the elbow, they include: a) flexion of elbow plus pronation of hand/wrist; and b) flexion of elbow plus supination of hand/wrist. Finally, for the shoulder, they include: a) expanded range of motion of shoulder extension with hand/wrist supinated and shoulder fully depressed/adducted; b) expanded range of motion of shoulder extension with hand/wrist pronated and with shoulder fully depressed/adducted; c) expanded range of motion of shoulder extension with the shoulder partially abducted and in any position supination or pronation of hand/wrist elbow; and d) expanded range of motion of shoulder extension with the shoulder fully abducted and in any position of supination or pronation of hand/wrist/elbow.

Furthermore, by using a general Y-shaped handle structure 30 or a general U-shaped handle structure 42, 42' or 142 with a rowing machine, the user may address bilateral, i.e., side-to-side, training issues of not only the left arm and shoulder girdle to right arm and shoulder girdle, but also, by virtue of accessing a left arm-dominant pull option alternated with accessing a right arm-dominant pull option, the bilateral strength of the left and right shoulder girdles tend to become balanced. Heretofore, the rowing machine has not been particularly well suited for addressing bilateral strength issues such as these.

The aforementioned expanded range of motion of shoulder extension in a variety of positions is achieved in that both the Y-shaped handle structure 30 or the general U-shaped handle structure 42, 42' or 142 allows the torso of the user to be inserted into the space created by the Y or U shape. Whereas, with a traditional bar-shaped handle, the bar would have blocked further movement of the hands past the end point where the bar contacts the torso, with the Y or U shaped handle structures, movement of the hands during the pull stroke may continue to an extended end point.

Finally, it should be noted that the handle structure utilized in the exercise protocols disclosed herein is a general U-shaped handle structure which permits the user to continue the pull phase of a stroke from the end point which would normally result from use of a conventional bar-shaped handle to an extended end point. While these exercise protocols are described in conjunction with the general U-shaped handle structure, apart from minor variations in the additional length of the pull phase resulting from the particular shape of the handle structure, the exercise protocols are equally suitable for use with the general Y-shaped handle structure.

In the foregoing schematic diagrams, the rowing machine has been greatly simplified for ease of clarity and illustration. More specifically, the multi-planar rowing machine 100 appears as a simple quadrilateral in which a lowermost boundary 100*b* represents that portion of the multi-planar rowing machine 100, which rests on a support surface 102, and an uppermost boundary 100*a* represents a stroke axis for the multi-planar rowing machine 100. A front side boundary 100*c* of the quadrilateral being illustrated as generally orthogonal to the lowermost boundary 100*b* indicates that a front end of the multi-planar rowing machine 100 is unelevated. Conversely, the front side boundary 102*c* of the quadrilateral being illustrated at an acute angle relative to the lowermost boundary 102*b* indicates that the front end of the multi-planar rowing machine 100 is elevated. Similarly, a back side boundary 100*d* of the quadrilateral being illustrated as generally orthogonal to the lowermost boundary 100*b* indicates that a back end of the multi-planar rowing machine 100 is unelevated. Conversely, the back side boundary 100*d* of the quadrilateral being illustrated at an acute angle relative to the lowermost boundary 102*b* indicates that the back end of the multi-planar rowing machine 100 is elevated. Components of the multi-planar rowing machine 100 deemed relevant to various ones of the exercise protocols disclosed herein are also schematically illustrated in FIGS. 6*a–m*, 7*a–e*, and 8*a–b*. These components include a pair of foot pads 104 and 106, a handle assembly 107 (which is identical to the handle assembly 142 of FIG. 2*d*), and a cable 110. In turn, the handle assembly 107 includes a bar member 108*a*, a cable attachment 108*b*, for example, a ring, a first gripping member 108*c*, a second gripping member 108*d*, a first non-tensile flexible attachment member 108*e*, a second non-tensile flexible attachment member 108*f* and a tensile flexible attachment member 108*g*. All other components of the multi-planar rowing machine 100 have been omitted from FIGS. 6*a* through 9*e* for ease and clarity of illustration.

In its broadest sense, the exercise protocol would be to perform at least one stroke with the multi-planar rowing machine 100 in the declined position illustrated in FIGS. 6*a* through 6*m* or in the inclined position illustrated in FIGS. 7*a* through 7*e*. In another, the exercise protocol would be to perform a combination of at least one stroke with the multi-planar rowing machine 100 in the inclined position and at least one stroke with the multi-planar rowing machine 100 in the declined position. In still another, the exercise protocol would be to perform at least one stroke with the multi-planar rowing machine 100 in the inclined position while holding the first and second gripping members 108*c* and 108*d* in the extended position illustrated in FIGS. 6*a* through 6*d*-1 and at least one stroke while holding the bar member 108 in which the first and second gripping members 108*c* and 108*d* have been inserted and/or at least one stroke with the multi-planar rowing machine 100 in the declined position while holding the first and second gripping members 108*c* and 108*d* in the extended position and at least one stroke while holding the bar member 108 in which the first and second gripping members 108*c* and 108*d* have been inserted. Finally, in still another, the exercise protocol would be to perform plural strokes of any of the aforementioned combinations as part of a low intensity aerobic workout, a high intensity anaerobic workout, or a moderate intensity mixed aerobic/anaerobic workout.

Whether performed in the inclined or declined position, each stroke is comprised of two phases—a "pull" phase and a "flex" phase. The start of the pull phase of a stroke performed with the multi-position rowing machine 100 in the declined position may be seen by reference to FIG. 6*a*. Here, the multi-planar rowing machine, and the stroke axis 100*a*, are in a declined position. As previously mentioned, if the user 112 has frequently used the multi-planar rowing machine 100 (or if the user 112 is in good physical condition), a back end of the multi-planar rowing machine 100 should elevated thirty-two inches above the full-horizontal position illustrated in phantom in FIG. 6*a*.

Figure 6A:
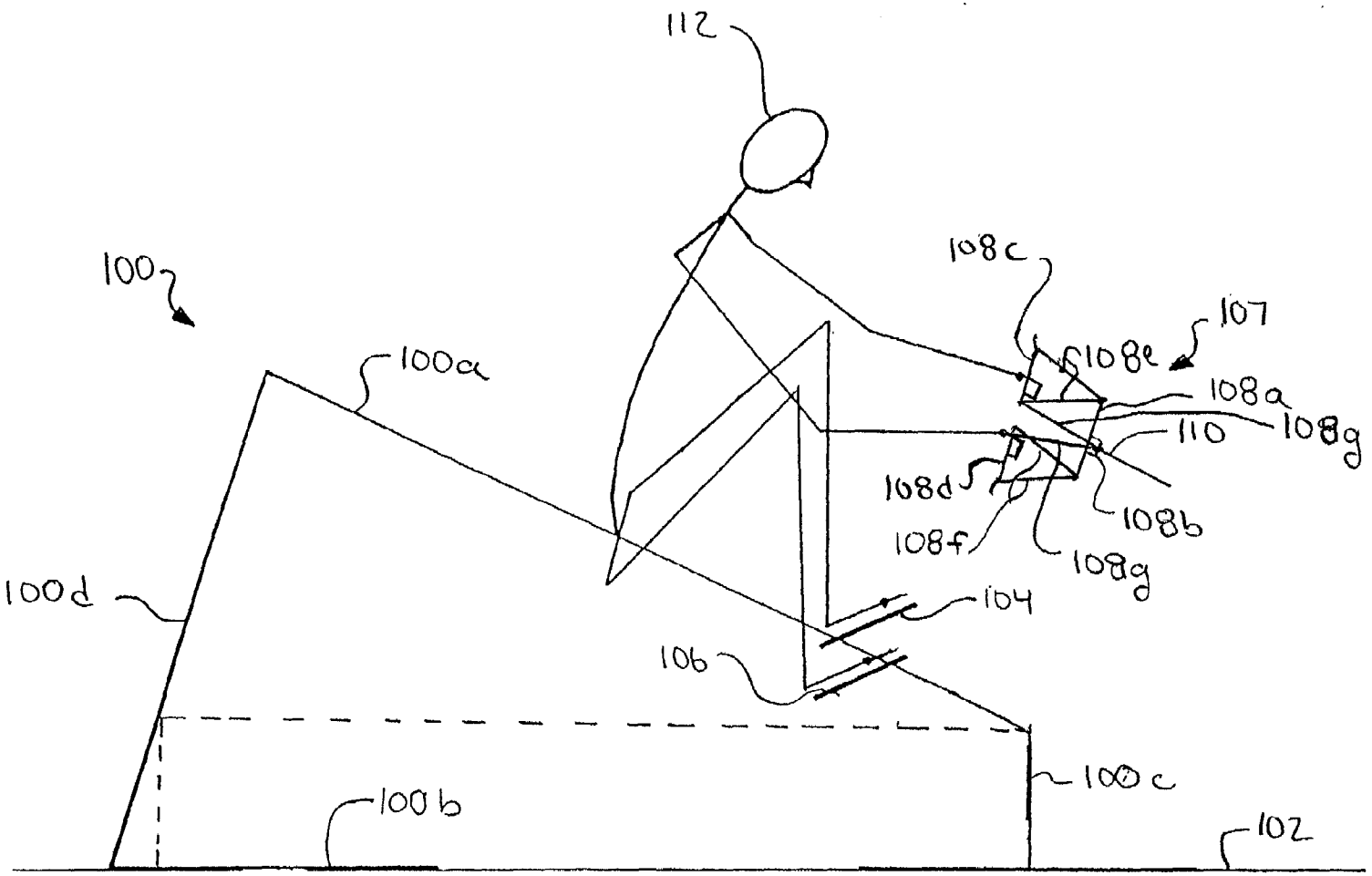
FIG. 6*a* is a schematic view of a multi-planar rowing machine in a declined position and a user at a start point for a pull phase of a stroke.
Figures 1, 9B:
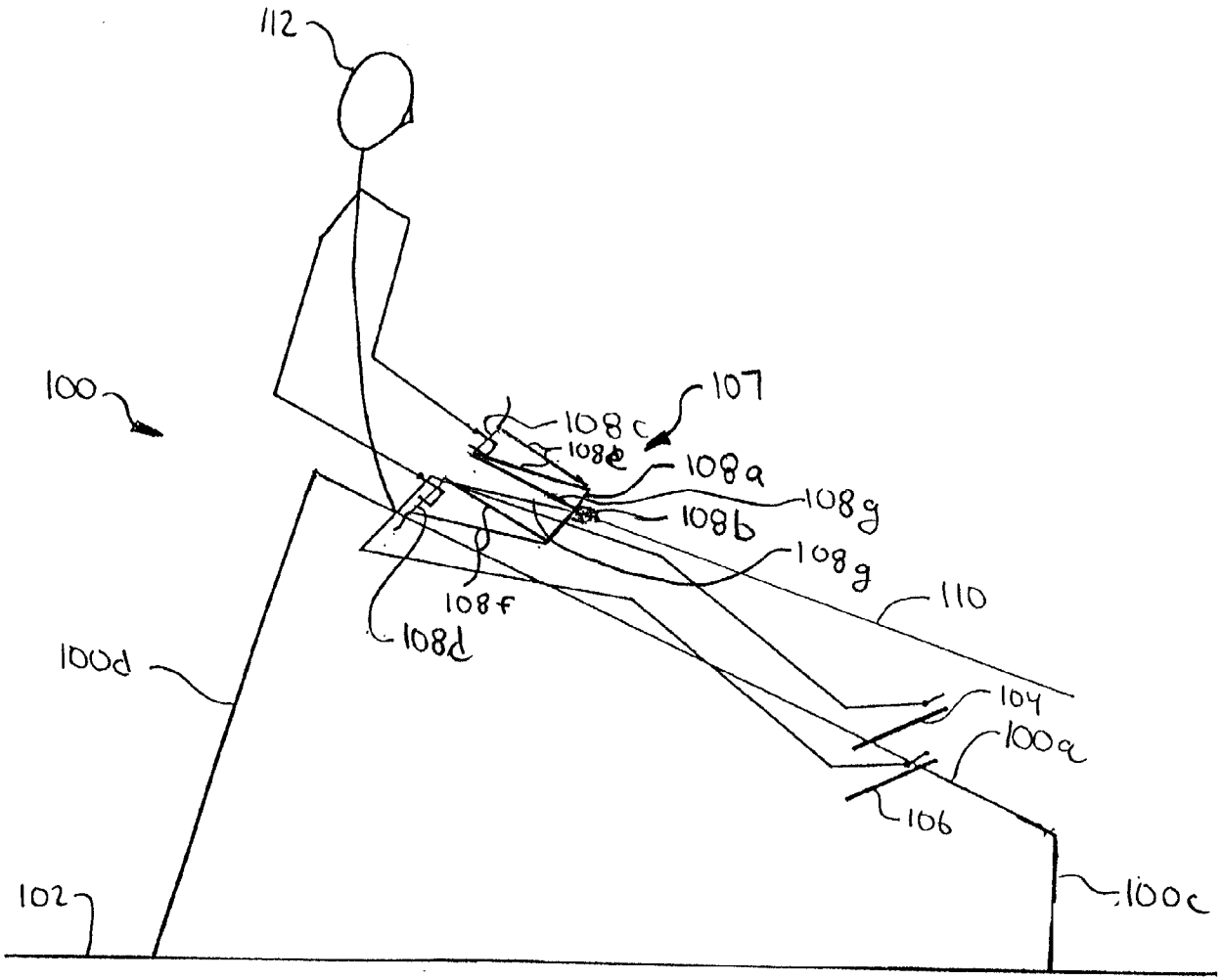
Figures 2, 6B:
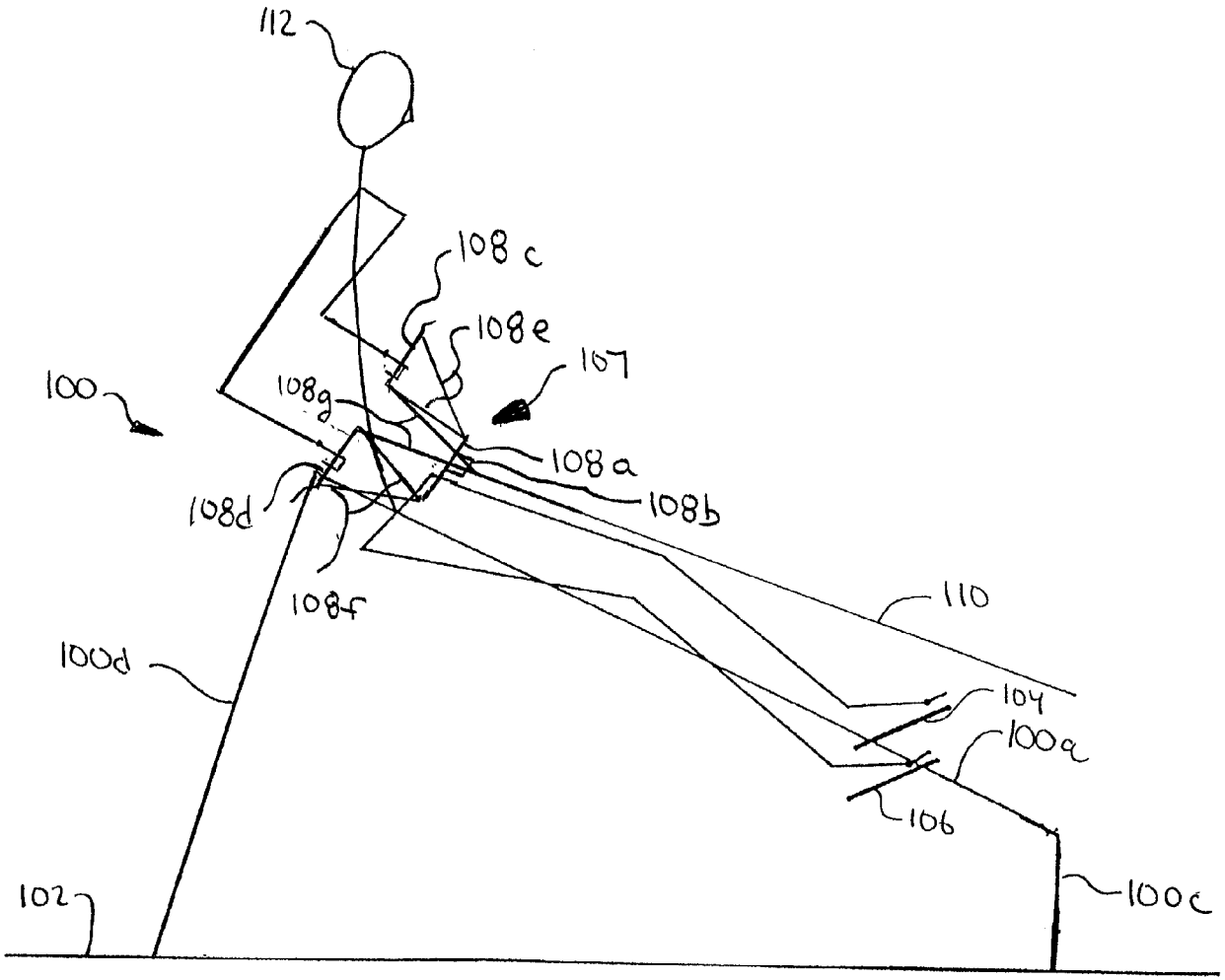

The major body segments trained by performing a selected exercise protocol with the multi-planar rowing machine 100 in the declined position, include the gastrocnemius/soleus of the calf, the quadriceps of the thigh and the spinal erectors of the torso with emphasis on the latissimus dorsi; pectoralis major and minor; teres major and minor subscapularis, supra-spinatus and infra-spinatus of the rotator cuff; and deltoid muscles. Starting from the exercise position illustrated in FIG. 6*a* with legs retracted, feet firmly planted on foot pads 104 and 106 in a "heels-on" position, arms extended with the wrists even with the arms and the gripping members 108*c* and 108*d* firmly grasped, the user 112 performs a pull phase of a stroke by extending their legs and retracting their arms until the legs are fully extended and the arms are fully retracted. FIG. 6*b*-1 shows the user having performed part of the pull phase. Had the user 112 been holding a bar which extended across the torso, the pull phase would have been complete. However, because the user 112 is holding, in each hand, a respective gripping member 108*c* and 108*d* secured, in turn, to the bar member 108*a*, the pull phase of the stroke may continue to an extended endpoint illustrated in FIG. 6*b*-2. The user 112 then completes the stroke by performing a flex phase by retracting their legs and extending their arms until the arms are fully extended and the legs are fully retracted as illustrated in FIG. 6*a*.

Figures 1, 6C:
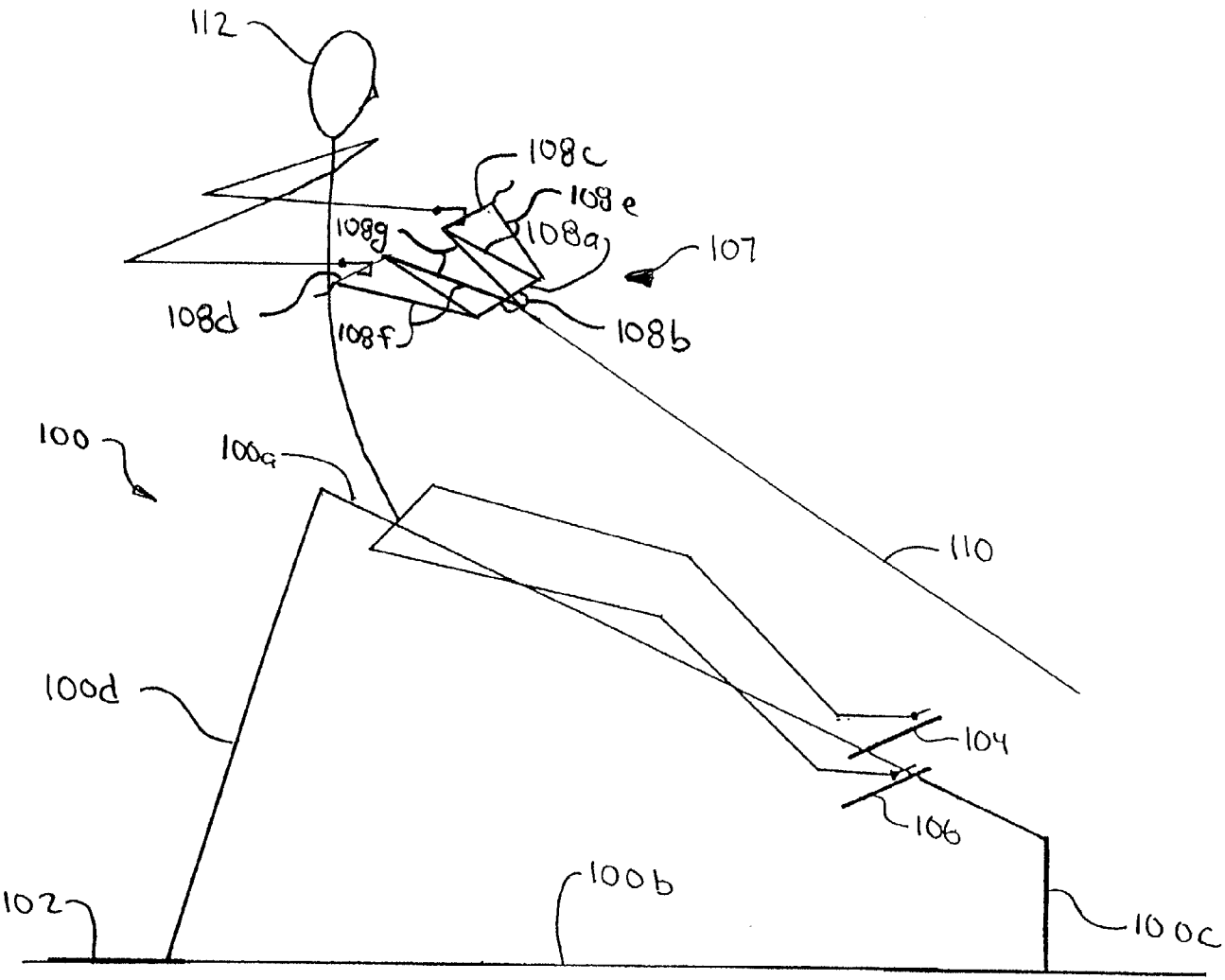
Figures 2, 6C:
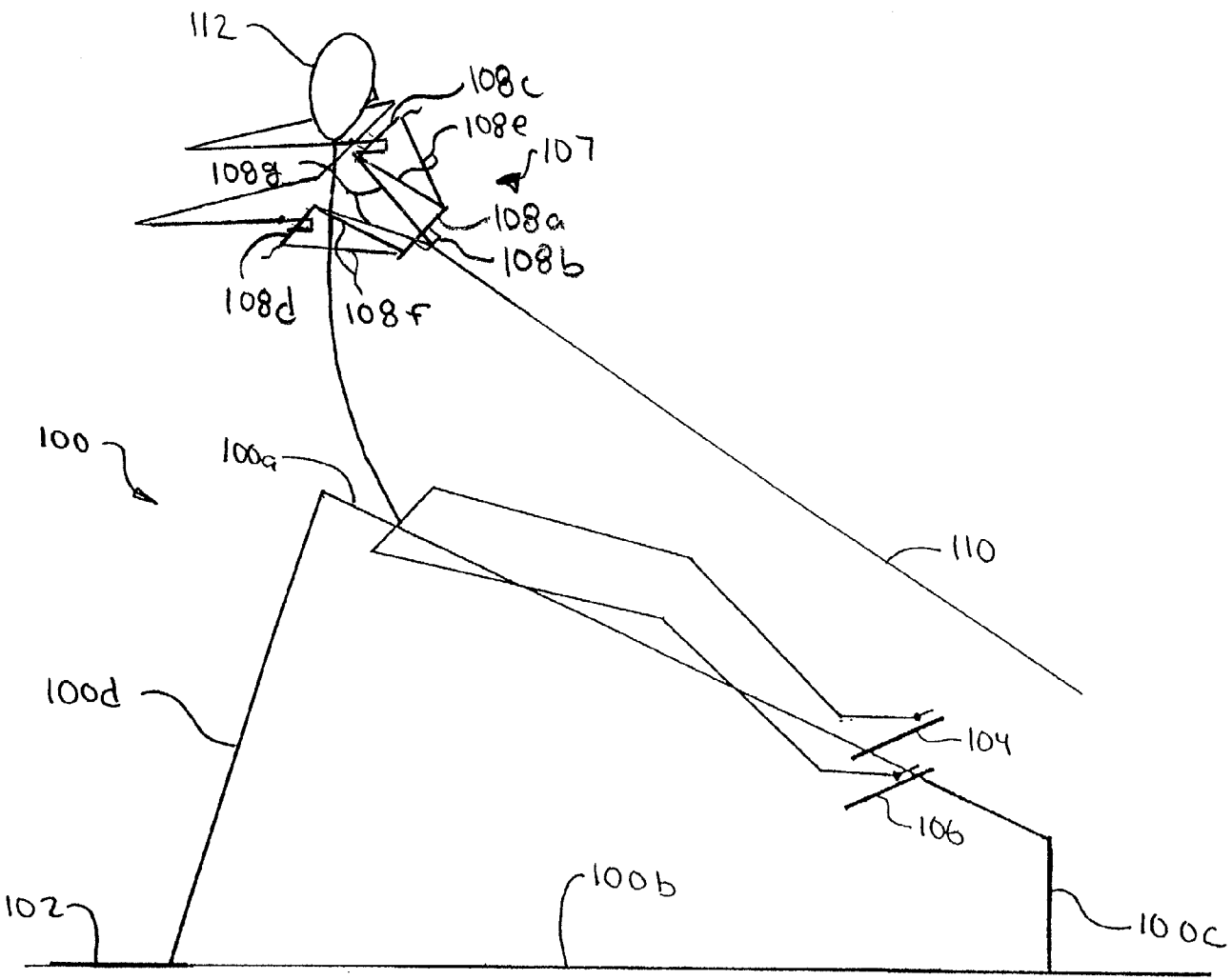
Figures 1, 6D:
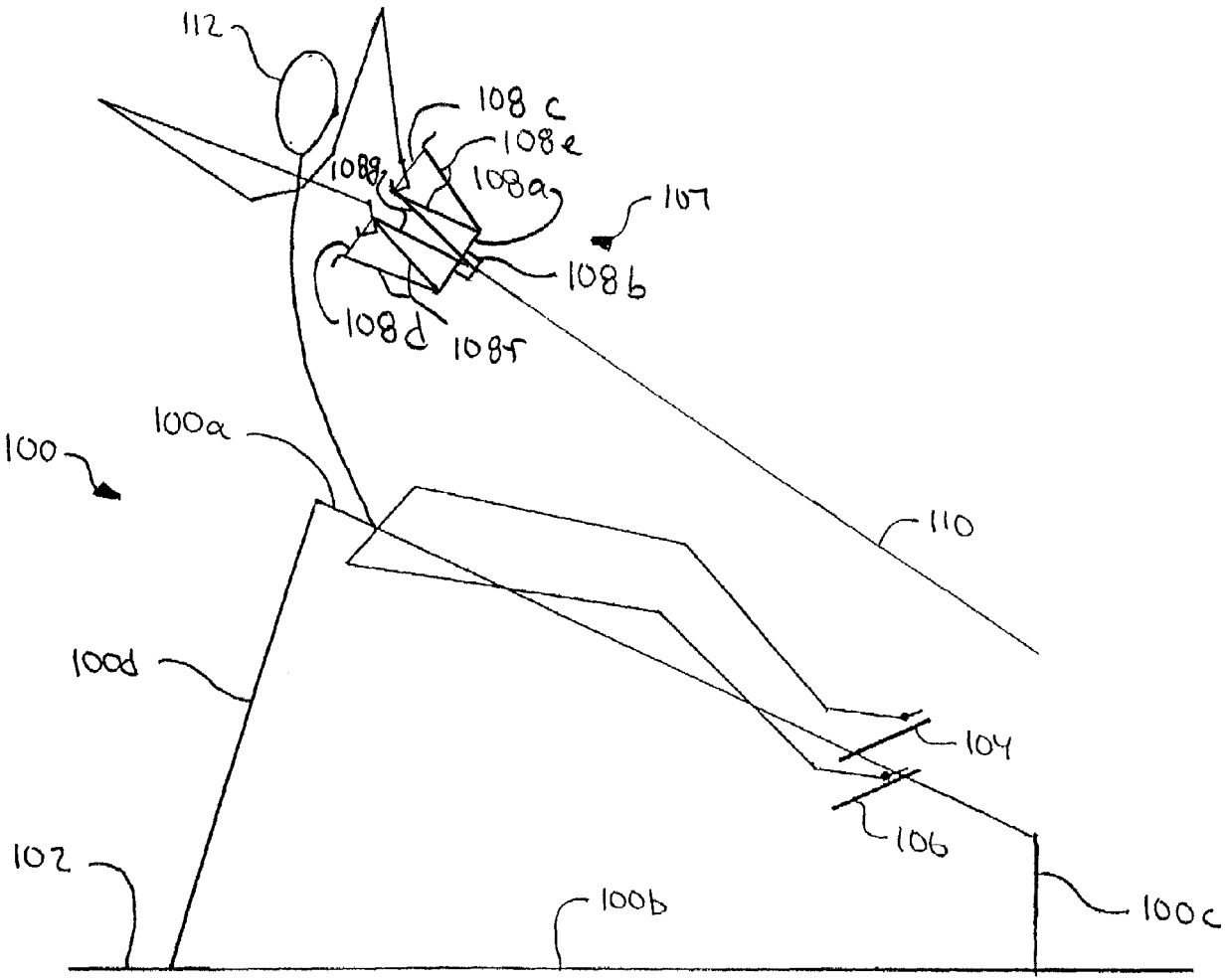
Figures 2, 6D:
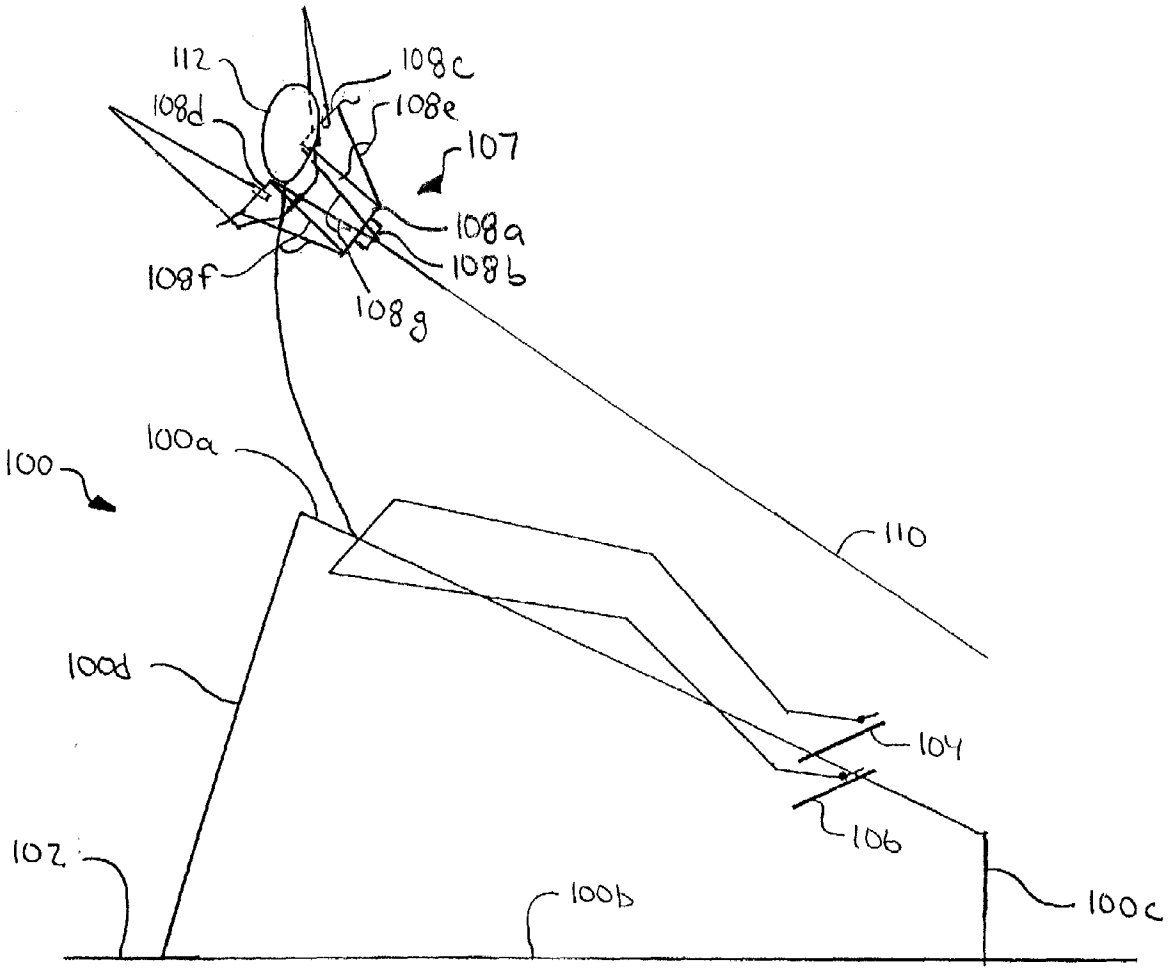

The pull phase illustrated in FIGS. 6*b*-1 and 6*b*-2 is generally referred to as a "low" pull phase because the arms are retracted such that the bar 108 is brought to a position generally near the waist. Depending on the particular muscle group to be trained, the user may select an alternate exercise protocol which includes, either in place of or in addition to the aforementioned at least one stroke in the low pull phase, at least one stroke having a "mid" (or torso) pull phase and/or at least one stroke having a "high" pull phase. In the mid pull phase, the arms are retracted such that the bar 108 is brought to a position generally near the chest as shown in FIGS. 6*c*-1 and 6*c*-2. More specifically, FIG. 6*c*-1 shows the user 112 having performed part of the mid pull phase. Had the user 112 been holding a bar which extended across the torso, the mid pull phase would have been complete. However, because the user 112 is holding, in each hand, a respective gripping member 108*c* and 108*d* secured, in turn, to the bar member 108*a*, the mid pull phase of the stroke may continue to an extended endpoint illustrated in FIG. 6*c*-2. By selecting an exercise protocol which includes a mid pull phase, major muscle emphasis is directed to the rhomboids and levator scapulae of the upper mid back and the long head of the triceps. In the high pull phase, the arms are retracted such that the bar 108 is brought to a position generally near the neck as shown in FIGS. 6*d*-1 and 6*d*-2. More specifically, FIG. 6*d*-1 shows the user 112 having performed part of the high pull phase. Had the user 112 been holding a bar which extended across the torso, the high pull phase would have been complete. However, because the user 112 is holding, in each hand, a respective gripping member 108*c* and 108*d* secured, in turn, to the bar member 108*a*, the pull phase of the stroke may continue to an extended endpoint illustrated in FIG. 6*d*-2. By selecting an exercise protocol, which includes a high pull phase, major muscle emphasis is directed to the trapezius and the scalenius of the neck.

Figure 6E:
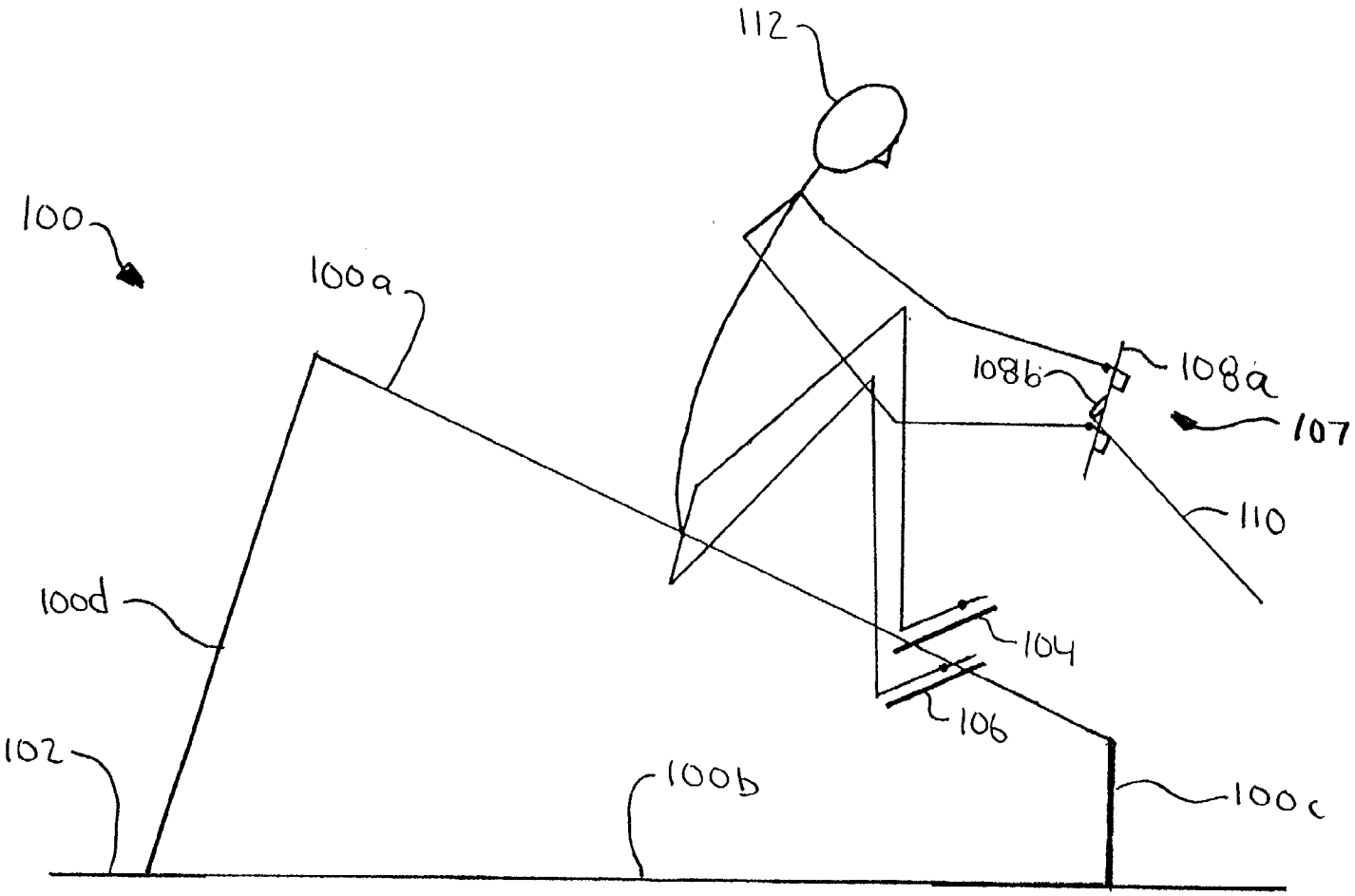
FIG. 6*e* is a schematic view of a multi-planar rowing machine in a declined position with the user at a start point for a heels-off, wrists-down, mid pull phase of a stroke.
Figure 6F:
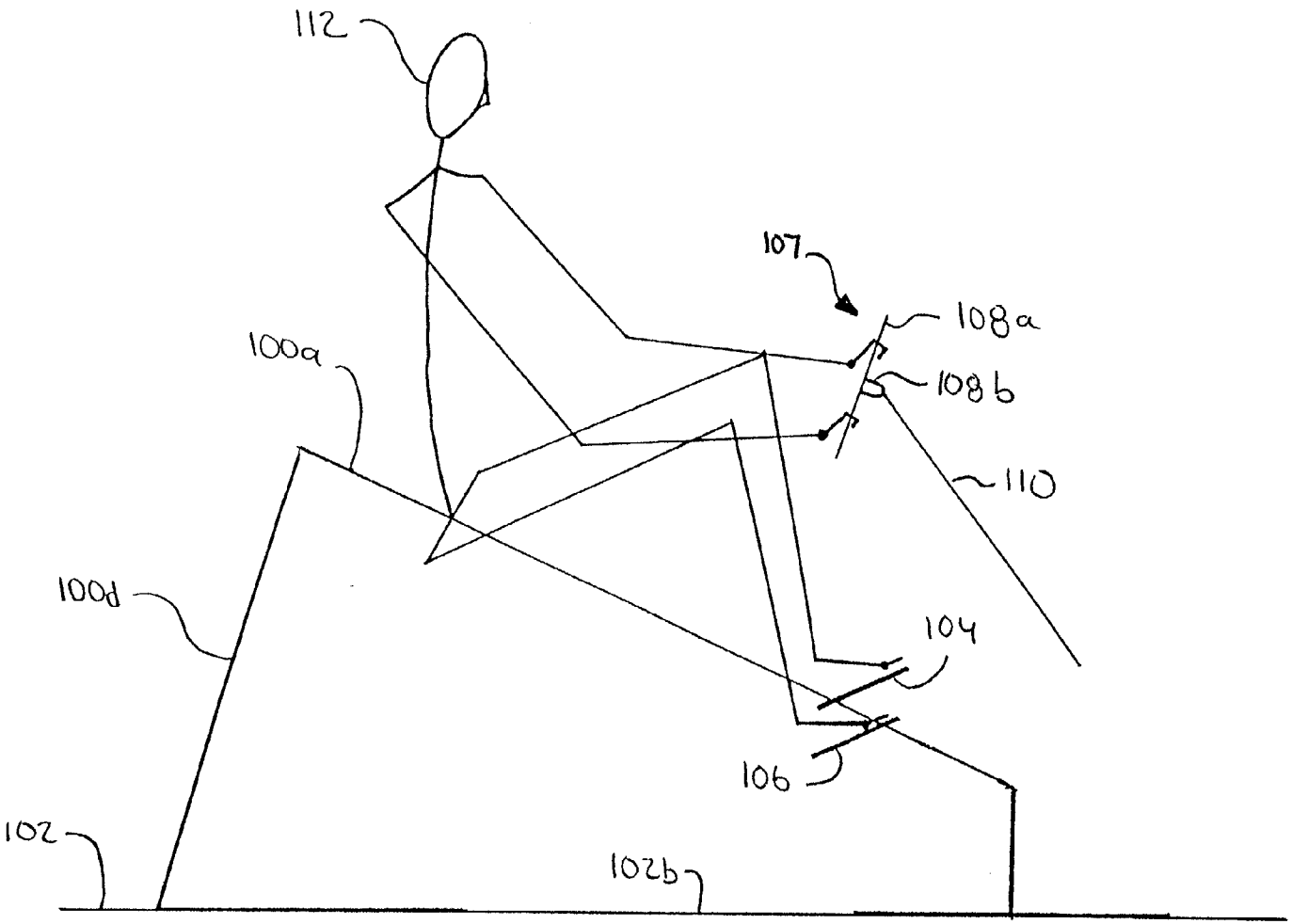
FIG. 6*f* is a schematic view of a multi-planar rowing machine in a declined position with the user at an intermediate point for a heels-off, wrists-down, mid pull phase of a stroke.
Figure 6G:
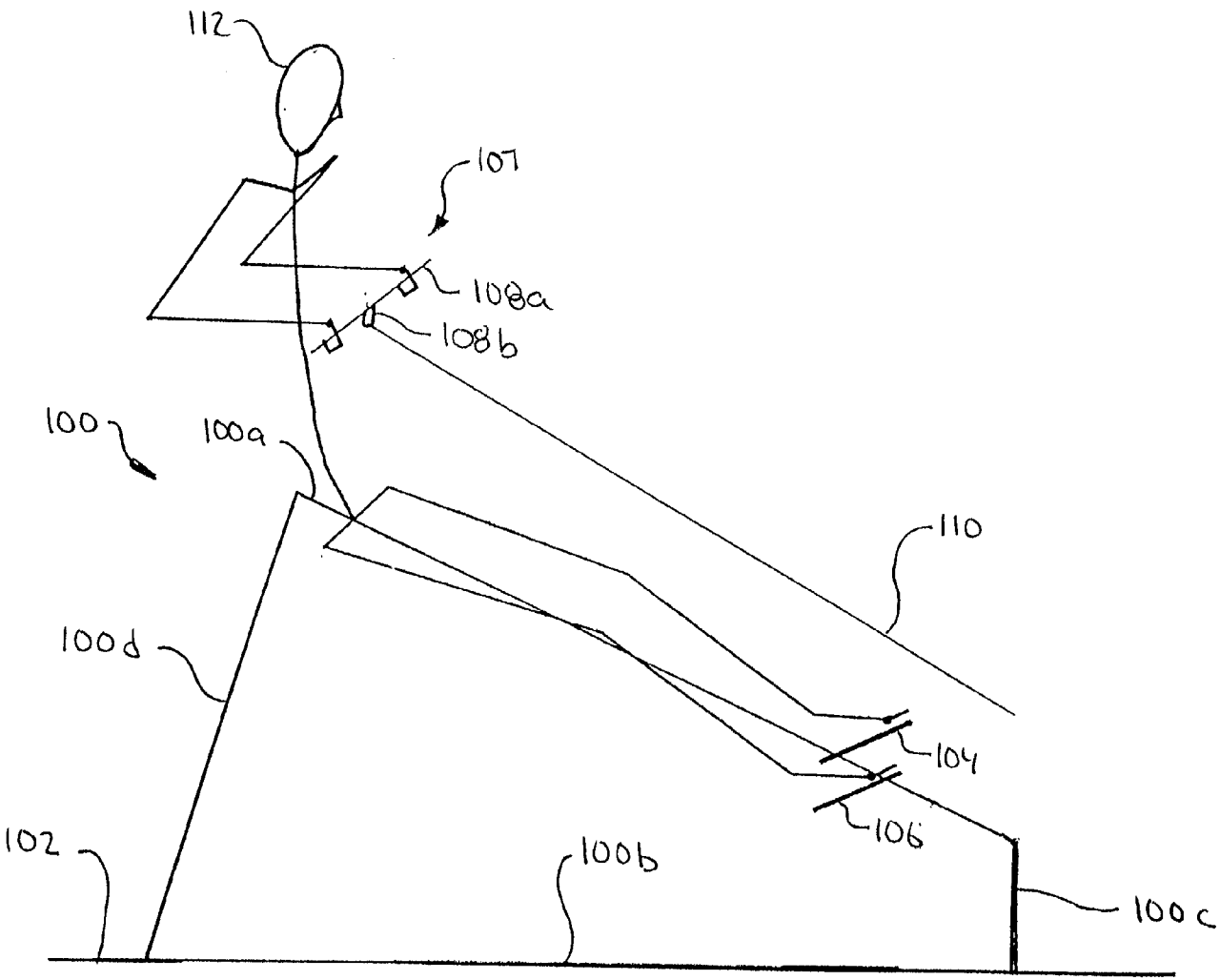
FIG. 6*g* is a schematic view of a multi-planar rowing machine in a declined position with the user at an end point for a heels-off, wrists-down, mid pull phase of a stroke.

In the exercise protocols hereinabove described, the cable attachment 114 faces away from the user 112. If desired, the user 112 may select a variant of the aforementioned exercise protocols by modifying the manner in which the handle assembly 107 is held during the stroke. By selecting such an exercise protocol, the user 112 may better emphasize training of the hand/wrist flexion. One such exercise protocol is illustrated in FIGS. 6*e* through 6*g*. Because the foregoing exercise protocol requires that the cable attachment no longer face away from the user 112 in the manner shown in FIGS. 6*a* through 6*d*-1 when the user holds the gripping members 108*c*, 108*d*, in order to perform these protocols, it is recommended that the gripping members 108*c*, 108*d* be inserted into the bar member 108*a* which, as previously set forth, is preferably configured as a generally tubular member sized to receive both of the gripping members 108*c*, 108*d* in an interior passageway thereof.

After inserting the gripping members 108*c*, 108*d* into the interior of the tubular bar member 108*a*, the tubular bar member 108*a* may now be used in a manner similar to a conventional bar. Accordingly, the user 112 may now grasp the tubular bar member 108*a* and turn their wrists downwardly about 1 to 1½ inches to place the wrists in a "wrists-down" position. By placing the wrists in this position, the cable attachment 108*b* is turned down about 90 degrees, thereby placing the cable attachment 108*b* in a first generally orthogonal relationship with the cable 110. The user 112, then initiates either a low pull, high pull or, as illustrated in FIGS. 6*f* and 6*g*, mid pull phase. As the user 112 performs a selected pull phase, the cable attachment 108 passively aligns with the cable 110 (see FIG. 6*f*) as the force of the legs and torso temporarily overwhelm the hand/wrist flexors. Toward the end of the pull phase, however, the combined force of the legs and torso declines and the smaller hand/wrist flexors begin to dominate, thereby enabling the user 112 to complete a dynamic hand/wrist flexion movement (see FIG. 6*g*) as soon as the hand/wrist flexors become dominant. Of course, the foregoing advantages can only be afforded by loss of those advantages derived from the extended portion of the pull phase achievable when the first and second gripping members 108*c* and 108*d* are used during the exercise protocol.

Figure 6H:
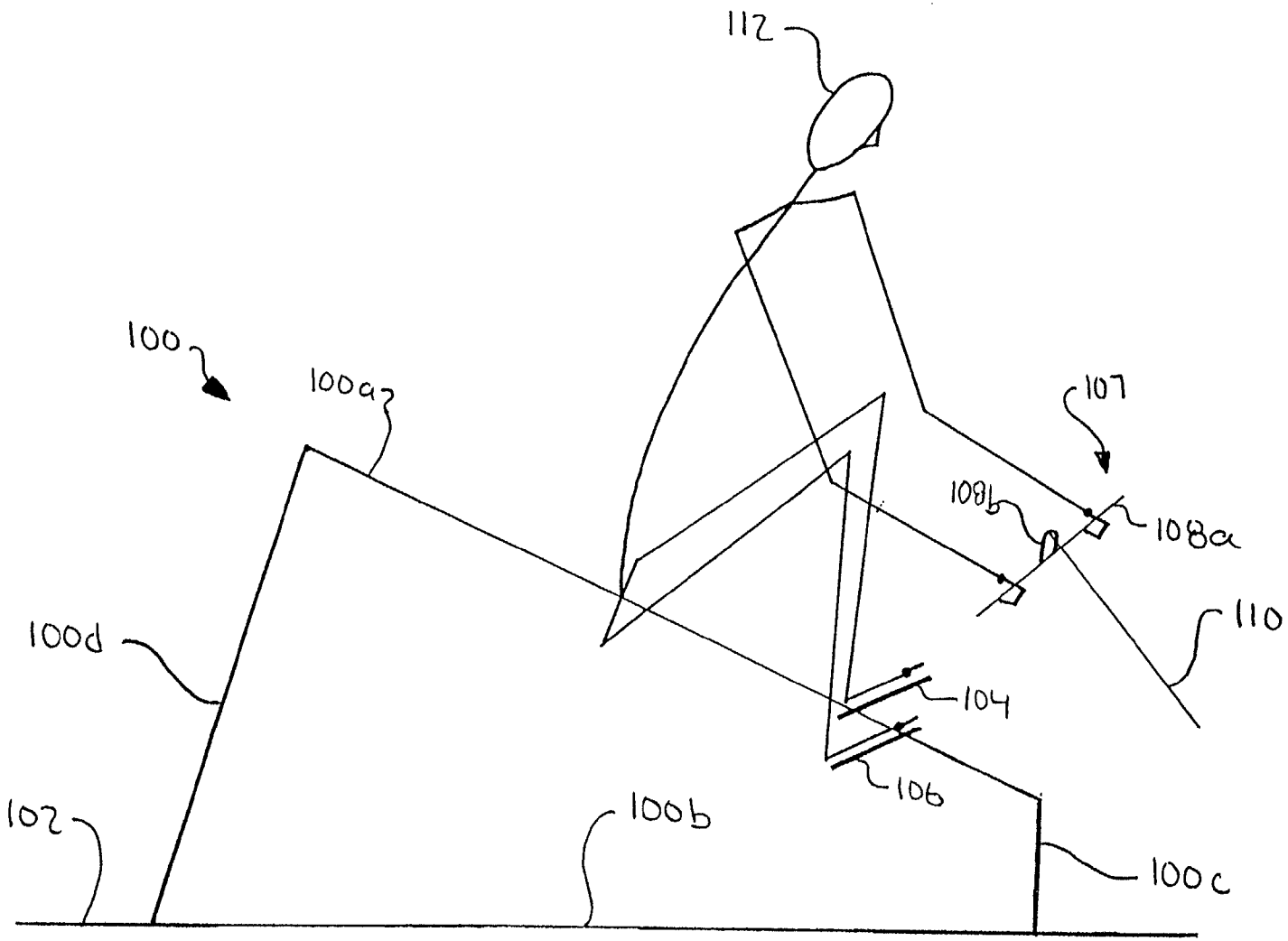
FIG. 6*h* is a schematic view of a multi-planar rowing machine in a declined position with the user at a start point for a toes-up, wrists-up, mid pull phase of a stroke.
Figure 6I:
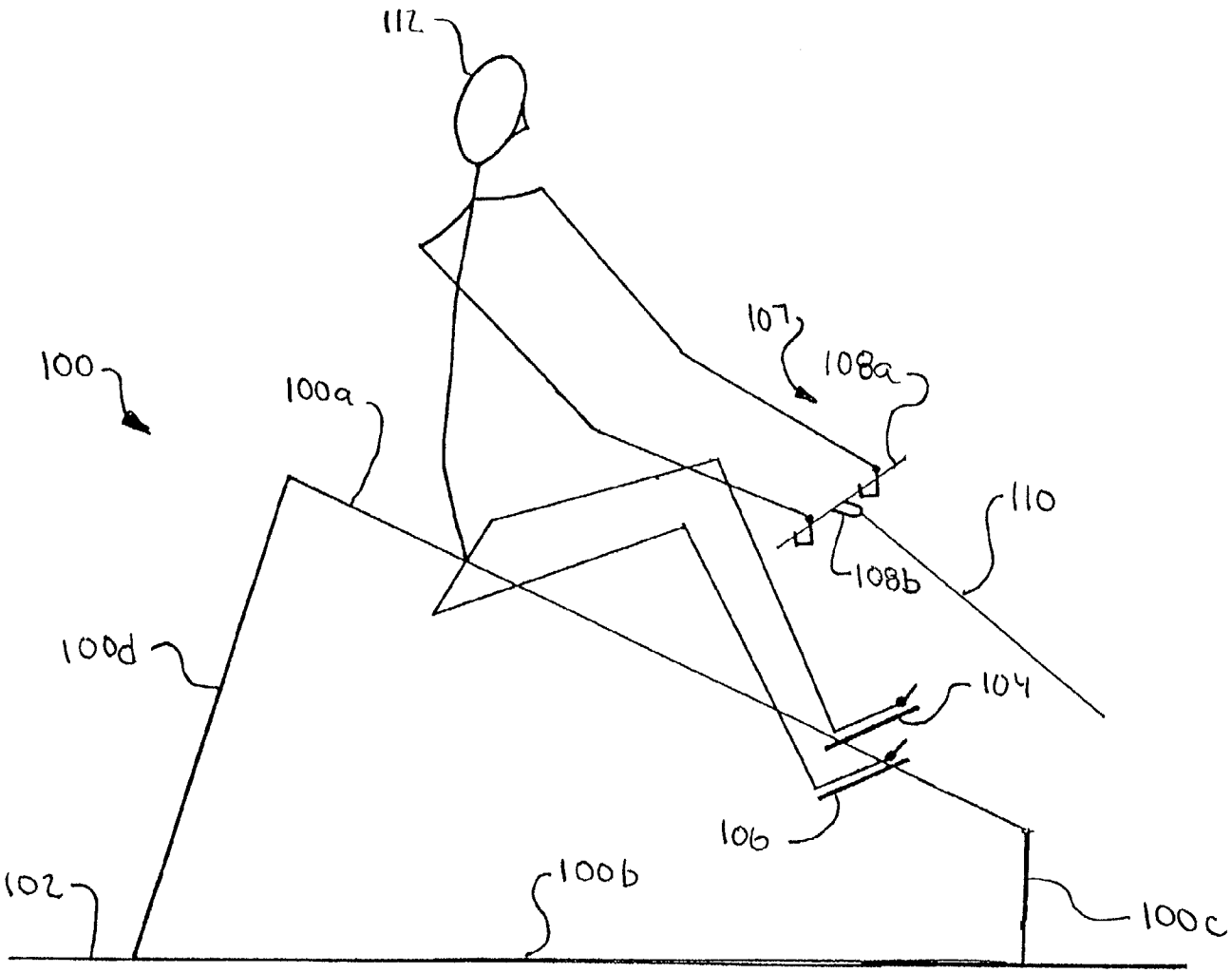
FIG. 6*i* is a schematic view of a multi-planar rowing machine in a declined position with the user at an intermediate point for a toes-up, wrists-up, mid pull phase of a stroke.
Figure 6J:
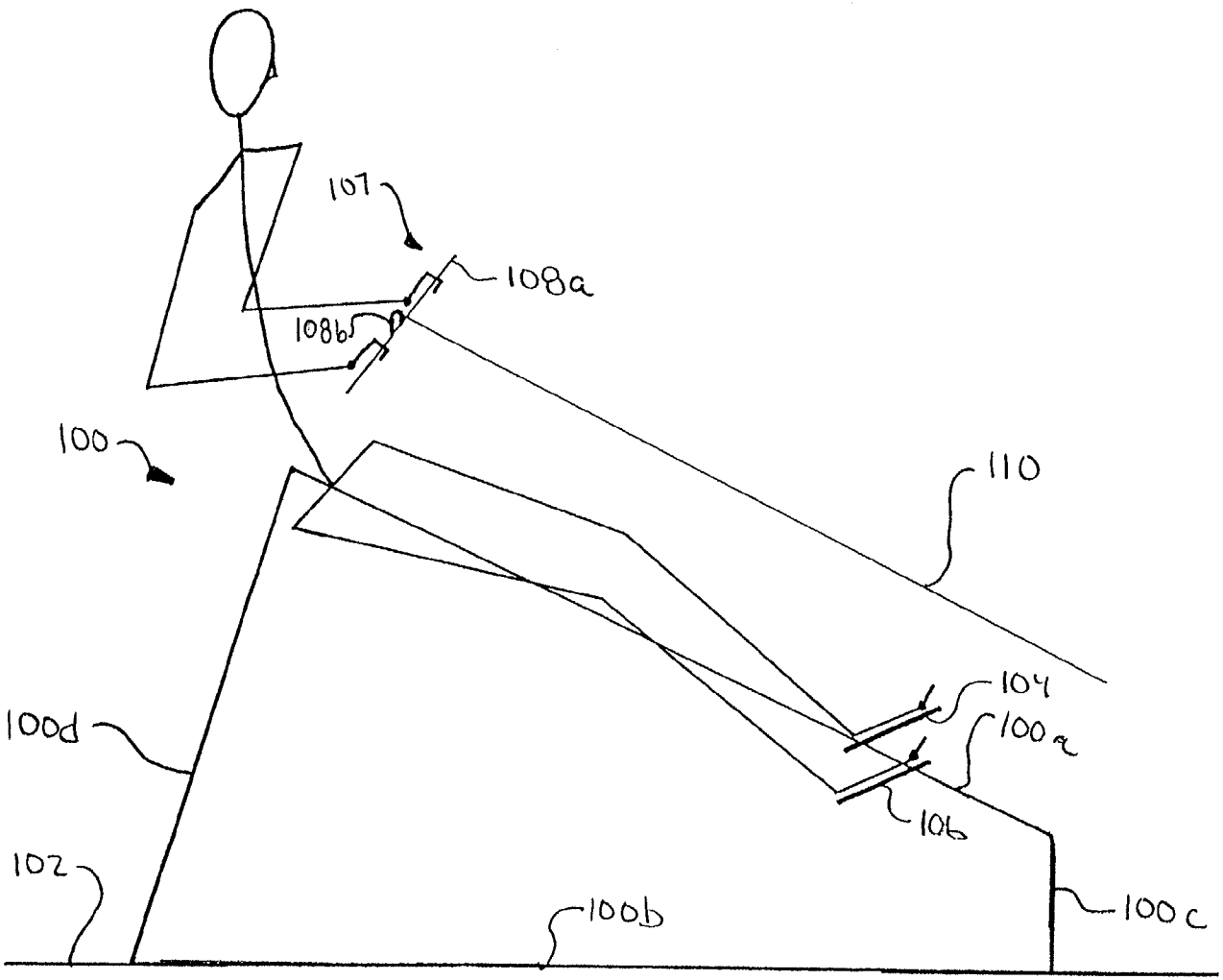
FIG. 6*j* is a schematic view of a multi-planar rowing machine in a declined position with the user at an end point for a toes-up, wrists-up, mid pull phase of a stroke.

The user may select still another variant of the aforementioned exercise protocols by yet again modifying the manner in which the tubular bar member 108*a* is held during a stroke performed after the first and second gripping members 108*c* and 108*d* have been fully inserted in the interior passageway of the tubular bar member 108*a*. By selecting such an exercise protocol, the user 112 may better emphasize training of the hand/wrist extension. Such an exercise protocol is illustrated in FIGS. 6*h* through 6*j*. As may now be seen, after grasping the tubular bar member 108*a*, the user 112 turns their wrists upwardly about 1 to 1½ inches to place the wrists in a "wrists-up" position. By placing the wrists in this position, the cable attachment 108*b* is turned up about 90 degrees, thereby placing the cable attachment 108*b* in a second generally orthogonal relationship with the cable 110. The user 112 then initiates either a low-pull, high-pull or, as illustrated in FIGS. 6*i* and 6*j*, a mid-pull phase. As the user 112 performs a selected pull phase, the cable attachment 108*b*4 passively aligns with the cable 110 (see FIG. 6*i*) as the force of the legs and torso temporarily overwhelm the hand/wrist extensors. Toward the end of the pull phase, however, the combined force of the legs and torso declines and the smaller hand/wrist extensors begin to dominate, thereby enabling the user 112 to complete a dynamic hand/wrist extension movement (see FIG. 6*j*) as soon as the hand/wrist extensors become dominant. Again, the foregoing advantages can only be afforded by loss of those advantages derived from the extended portion of the pull phase achievable when the first and second gripping members 108*c* and 108*d* are used during the exercise protocol.

If desired, the user 112 may further adjust the muscle groups to be trained by selecting variants of the aforementioned exercise protocols. One such variant involves a selection between the "heels-on" and "heels-off" position for the feet. The heels-on position is shown in FIG. 6*a* and, if desired, the user 112 may select an exercise protocol in which the entire stroke is performed in the heels-on position. Alternately, the user 112 may select an exercise protocol in which one or all of the strokes are performed in the heels-off position. In this exercise protocol, the user starts the stroke with the heels of their feet resting on the foot pads 104 and 106 as illustrated in FIG. 6*a*. As the user 112 extends their legs and retracts their arms into either a low, mid or high pull phase, the user 112 simultaneously lifts the heels of their feet off of the foot pads 104 and 106 as illustrated in FIGS. 6*b*–*d*. Subsequently, as the user retracts their legs and extends their arms in the flex phase, the user 112 simultaneously returns their heels onto the foot pads 104 and 106. The heels-off position better emphasizes training of the ankle/calf plantar flexion such that the gastrocnemius/soleus muscle of the calf predominates over the quadriceps during the pull stroke.

Another such variant of the aforementioned exercise protocols, which enable the user 112 to adjust the muscle groups to be trained involves a selection between the "toes-down" position and the "toes-up" position for the feet. The toes-down position is shown in FIG. 6*h* and, if desired, the user 112 may select an exercise protocol in which the entire stroke is performed in the toes-down position. Alternately, the user 112 may select an exercise protocol in which one or all of the strokes are performed in the toes-up position. In this exercise protocol, the user starts the stroke with the toes of their feet resting on the foot pads 104 and 106 as illustrated in FIG. 6*h*. As the user 112 extends their legs and retracts their arms into either a low, mid or high pull phase, the user 112 simultaneously lifts the toes of their feet off of the foot pads 104 and 106 as illustrated in FIGS. 6*i*–*j*. Subsequently, as the user retracts their legs and extends their arms in the flex phase, the user 112 simultaneously returns their toes onto the foot pads 104 and 106. The toes-up position better emphasizes training of the ankle/calf dorsa flexion such that the quadriceps and the anterior tibialis muscles predominate over the muscles of the calf during the pull stroke.

Figure 6K:
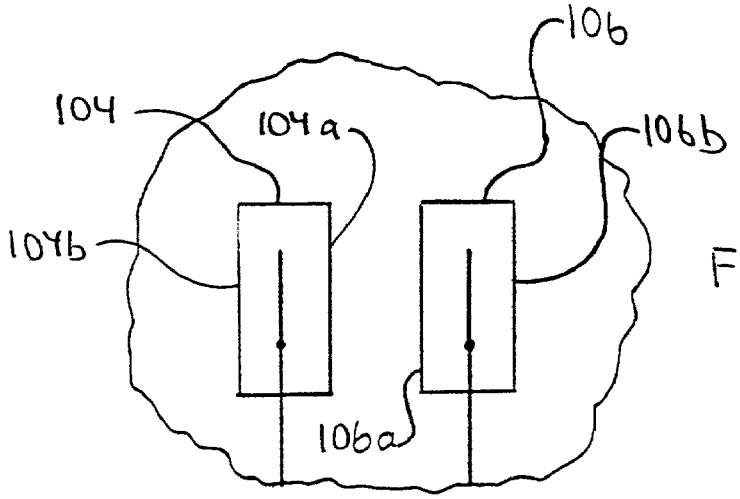
FIG. 6*k* is a partial top schematic view of a multi-planar rowing machine in a declined position with the user in a toes-straight position.
Figure 6L:
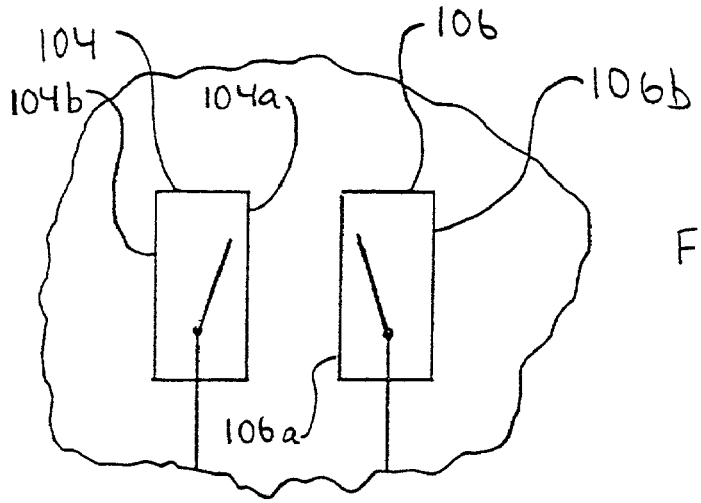
FIG. 6*l* is a partial top schematic view of a multi-planar rowing machine in a declined position with the user in a toes-in position.
Figure 6M:
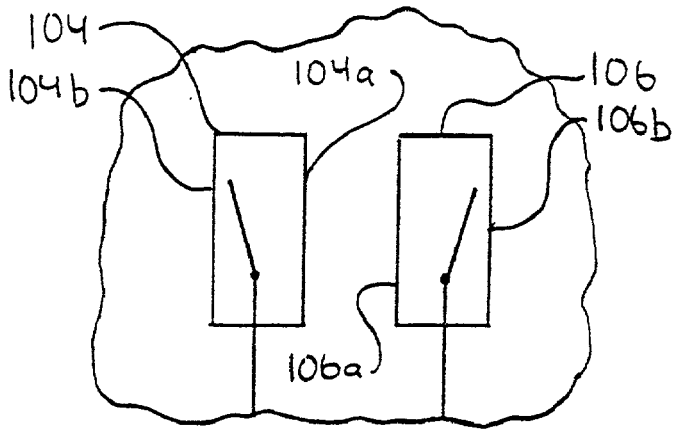
FIG. 6*m* is a partial top schematic view of a multi-planar rowing machine in a declined position with the user in a toes-out position.

Still another variant of the aforementioned exercise protocols, which enable the user 112 to adjust the muscle groups to be trained involves a selection between "toes-straight", "toes-in" ankle/knee/hip internal rotation and "toes-out" ankle/knee/hip external rotation positions for the feet. The toes-straight position is illustrated in FIG. 6*k* and is the position normally assumed by the user 112 when placing their feet on the foot pads 104 and 106. The toes-in position is illustrated in FIG. 61 and involves the user 112 turning their feet such that the toes point towards inner side surfaces 104*a* and 106*a* of foot pads 104 and 106. The toes-out position is illustrated in FIG. 6*m* and involves the user 112 turning their feet such that the toes point towards outer side surfaces 104*b* and 106*b* of foot pads 104 and 106. By selecting one of the toes-in or toes-out positions in combination with one of the aforementioned exercise protocols, the user 112 will affect training of the extensors.

Of course, it should be readily appreciated that the heels-on, the toes-down, and the toes-straight position are, in effect, the same position. Accordingly, in selecting a particular exercise protocol, the user 112 may only select a combination of: a) low pull, extended low pull, mid pull, extended mid pull, high pull, or extended high pull phases; b) wrists-even, wrists-up, or wrists down; and c) heels-on/toes-down/toes-straight, heels-on/toes-down/toes-in, heels-on/toes-down/toes-out, heels-on/toes-up/toes-straight, heels-on/toes-up/toes-in, heels-on/toes-up/toes-out, heels-off/toes-down/toes-straight, heels-off/toes-down/toes-in, heels-off/toes-down/toes-out, heels-off/toes-up/toes-straight, heels-off/toes-up/toes-in or heels-off/toes-up/toes-out positions for a stroke. Successive strokes may mirror the combination selected for the first stroke or, if desired, may be comprised of other selectable combinations.

Still other variants of the aforementioned exercise protocols suitable for use with one or more of the aforementioned combinations involve the user depressing the shoulders prior to performing a low-pull phase of a stroke, performing an isometric muscle hold for approximately two seconds between pull and flex phases of a low-pull stroke, performing an isometric muscle hold for approximately two seconds between pull and flex phases of a mid-pull stroke and performing an isometric muscle hold for approximately two seconds between pull and flex phases of a high-pull stroke. The isometric holds are used to develop chronic reflex tonus in the upper back and/or involved muscles and further to promote muscle mass gains.

Figure 7A:
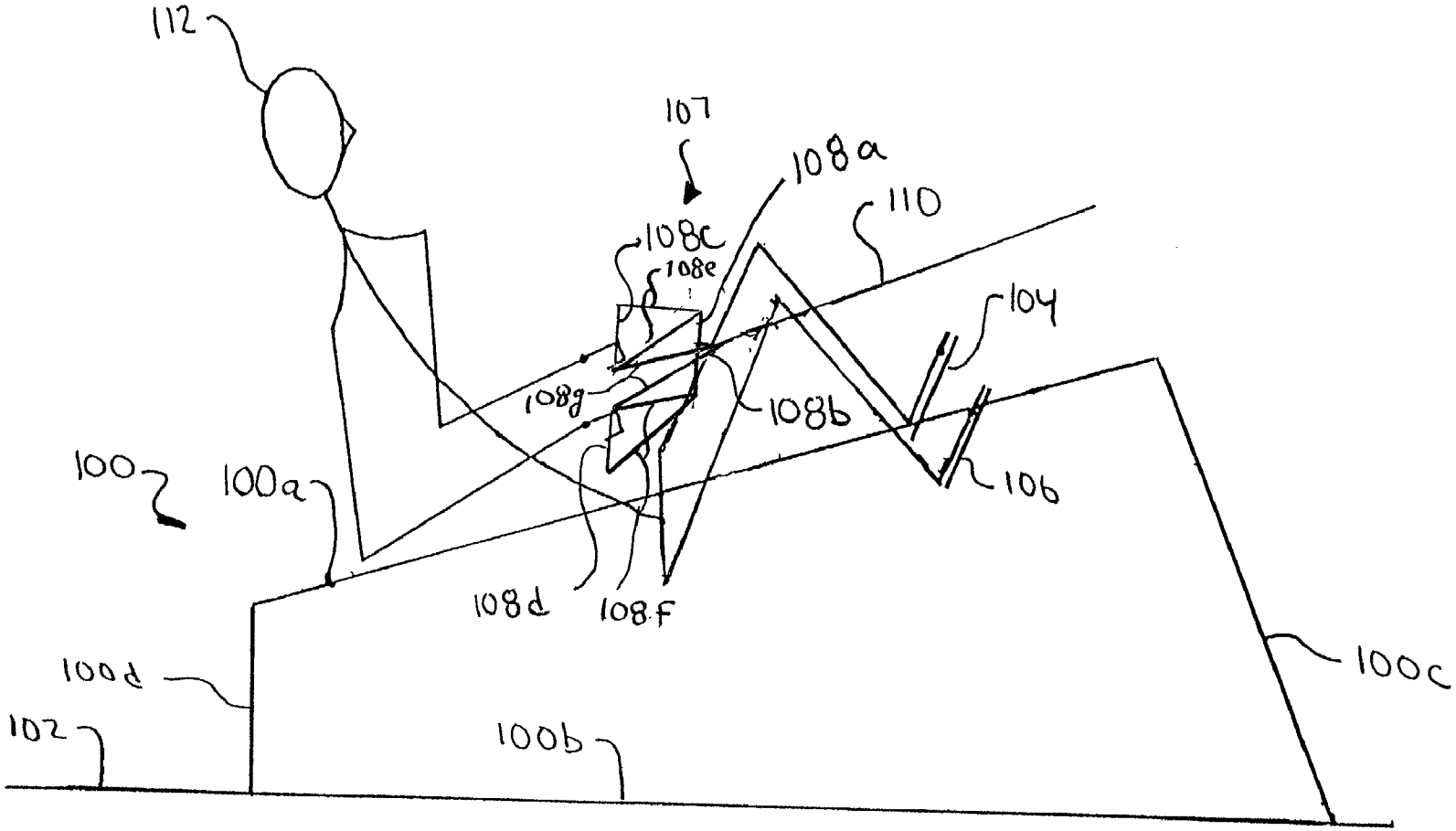
FIG. 7*a* is a schematic view of a multi-planar rowing machine in an inclined position and a user at a start point for a pull phase of a stroke.
Figures 1, 7B:
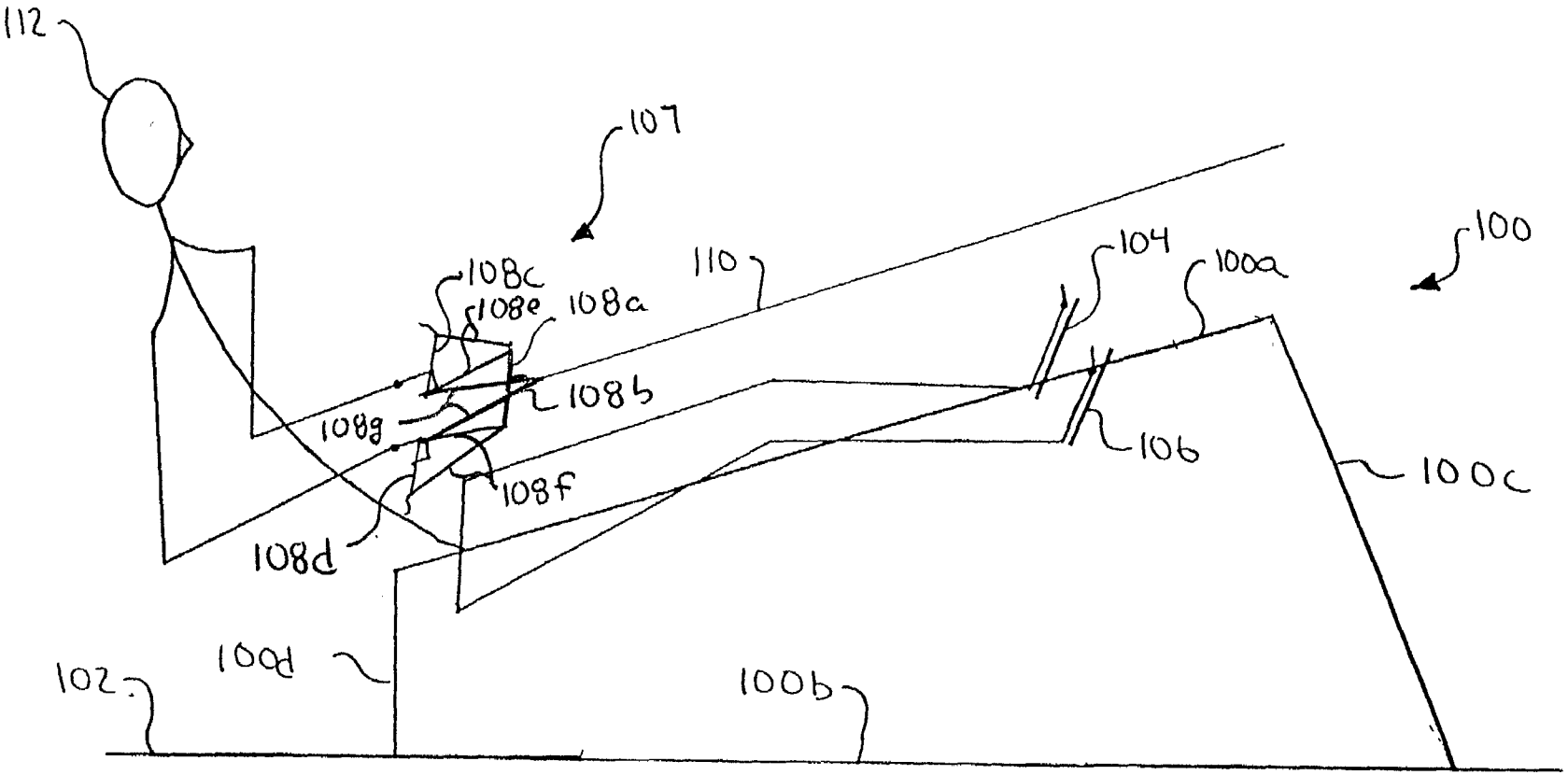
Figures 2, 7B:
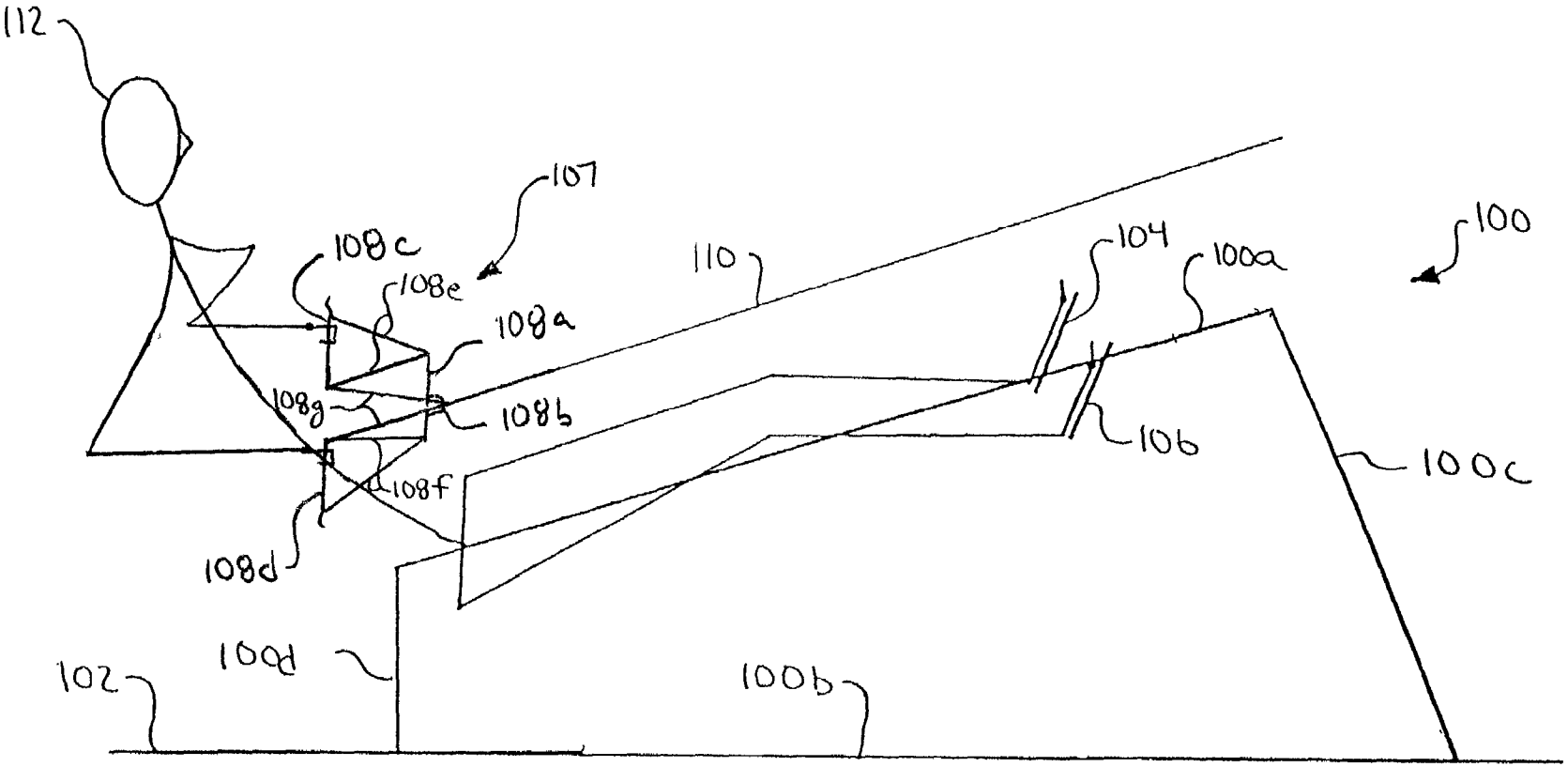
Figures 1, 7C:
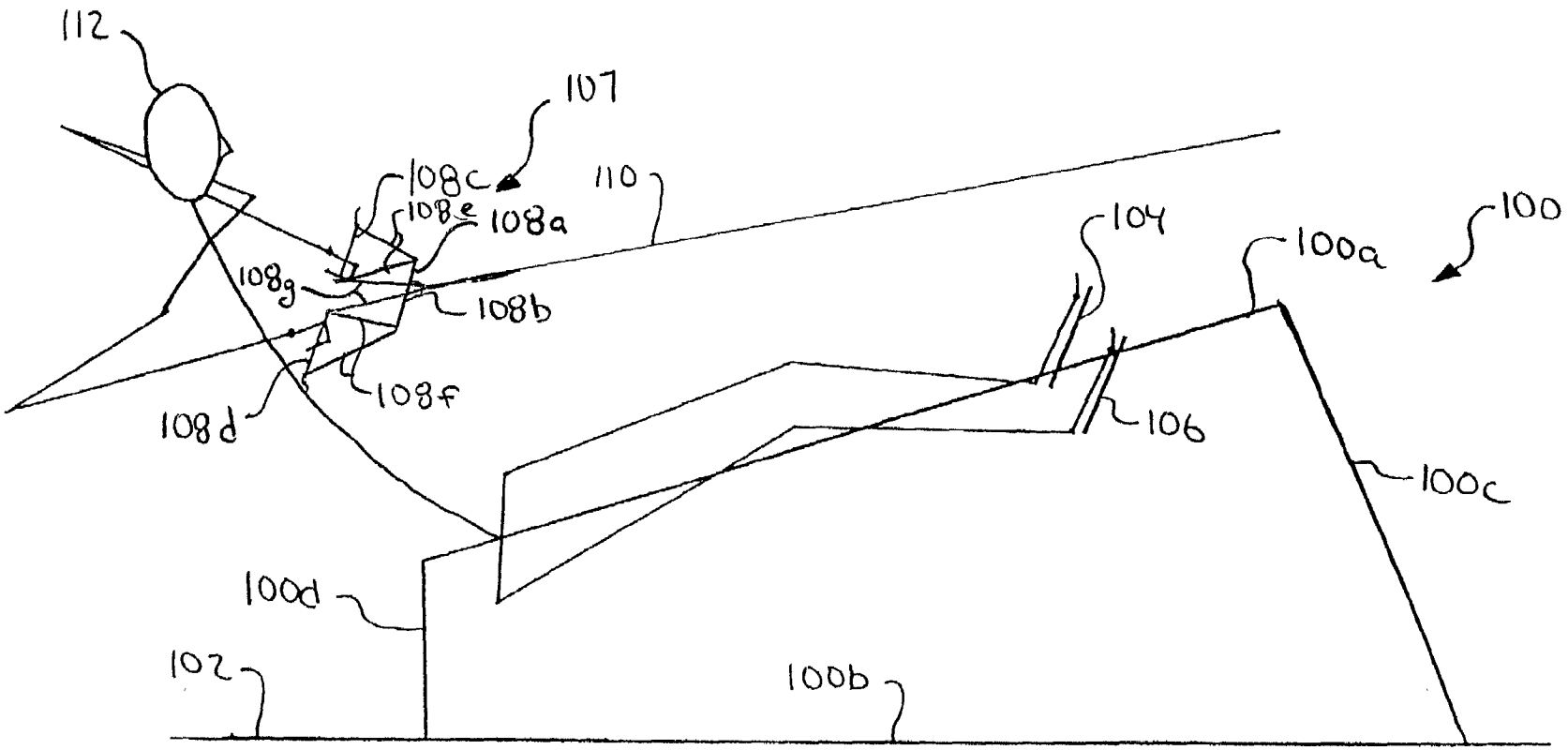
Figures 2, 7C:
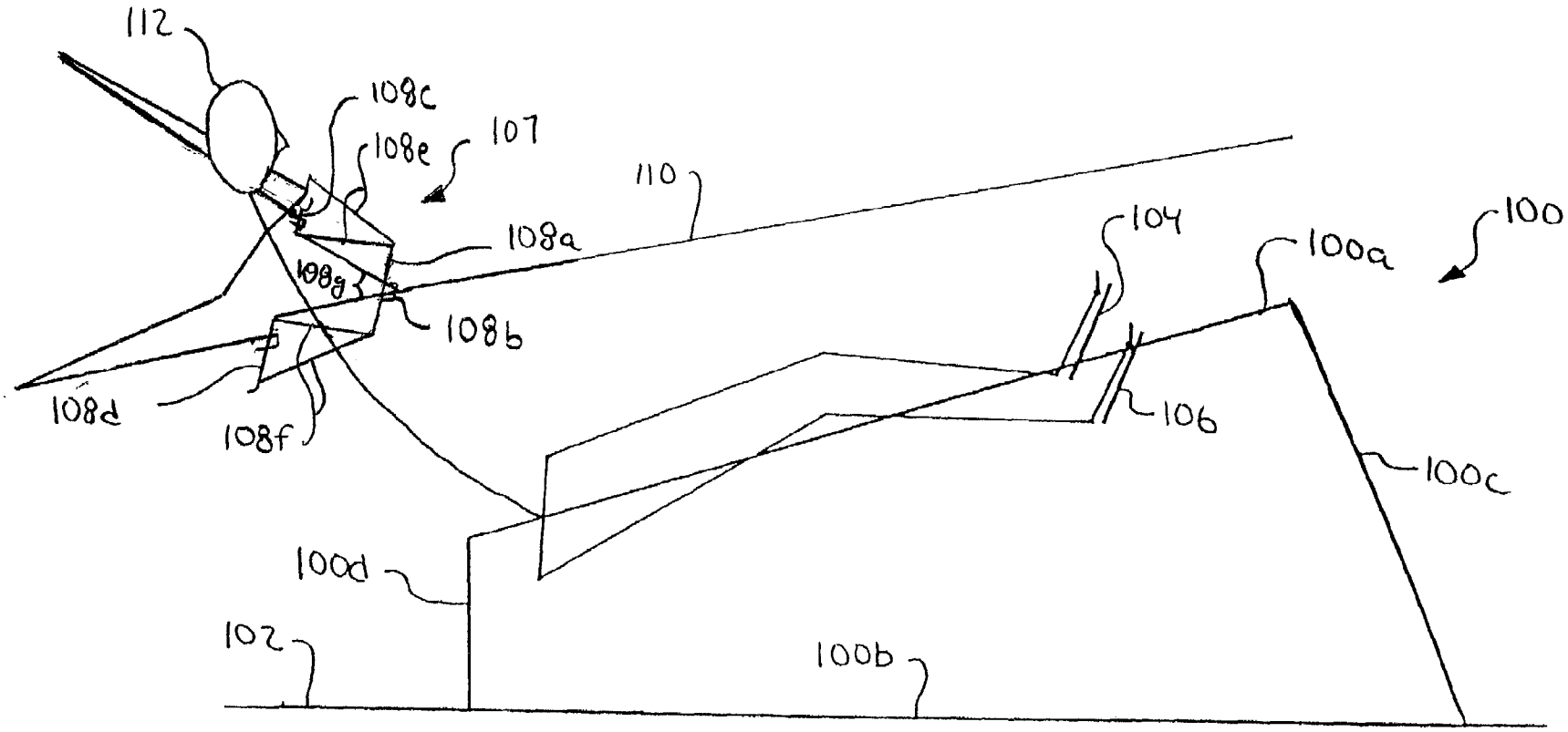
Figures 1, 7D:
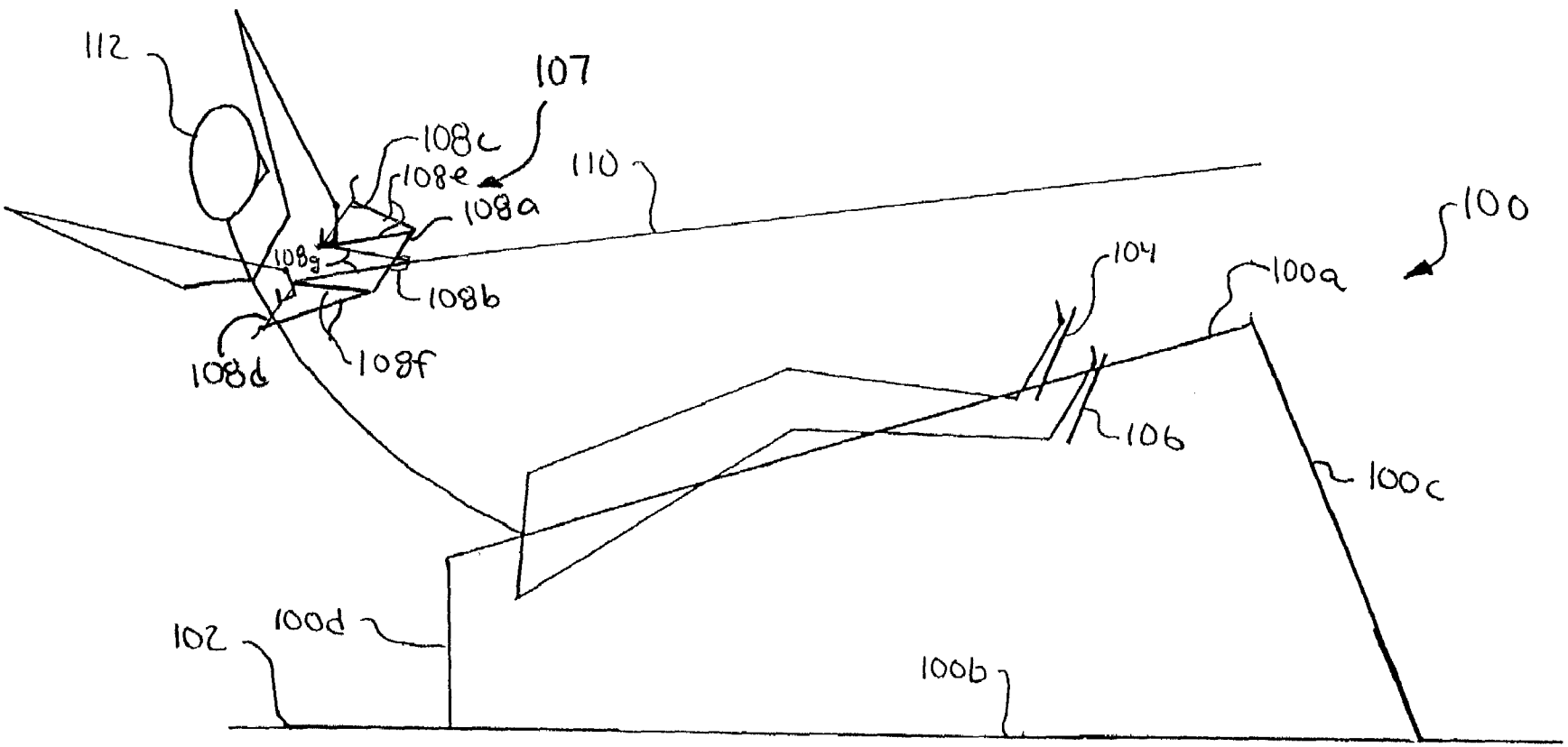
Figures 2, 7D:
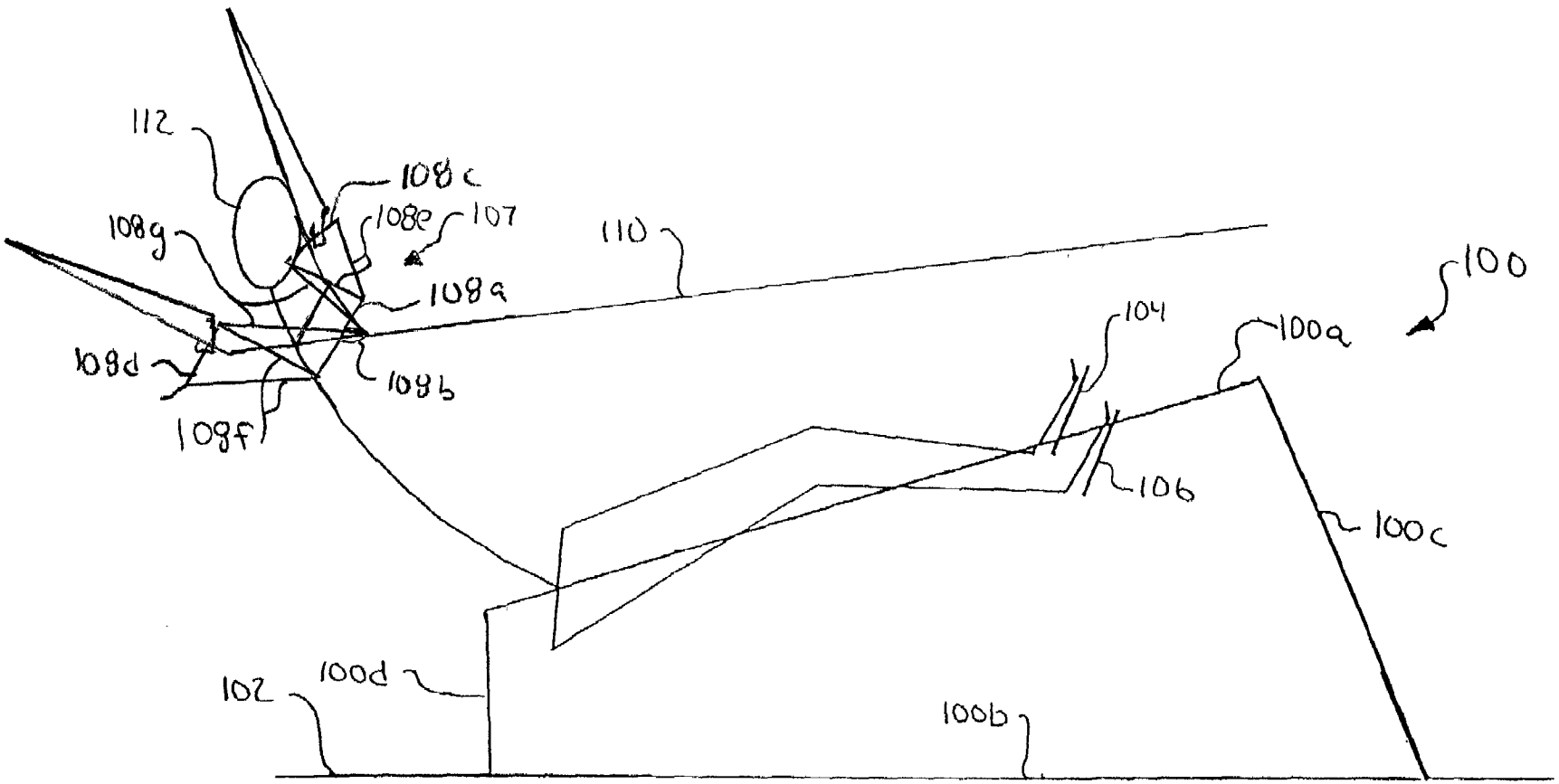

Referring next to FIGS. 7*a*–7*e*, operation of the multi-position rowing machine 100 in the inclined position will now be described in greater detail. Once the multi-position rowing machine 100 is put in the inclined position (preferably 16 inches above the full-horizontal position if the user 112 has frequently used the multi-planar rowing machine 100 or is in good physical condition), the user 112 starts a pull phase of a stroke from the position illustrated in FIG. 7*a* and ends the pull phase of the stroke in the position illustrated in FIG. 7*b*-2 (if the user 112 performs a low pull phase), the position illustrated in FIG. 7*c*-2 (if the user 112 performs a mid pull phase) or the position illustrated in FIG. 7*d*-2 (if the user 112 performs a high pull phase). More specifically, FIGS. 7*b*-1 and 7*b*-2 illustrate a toes-up, heels-on, wrists-even low pull phase, FIGS. 7*c*-1 and 7*c*-2 illustrate a toes-up, heels-on, wrists-even mid pull phase, and FIGS. 7*d*-1 and 7*d*-2 illustrate a toes-up, heels-off, wrists-even high pull phase—all in an inclined stroke axis. Had the user 112 been holding a bar which extended across the torso, the low pull phase would have been complete when the user 112 reached the position illustrated in FIG. 7*b*-1. However, because the user 112 is holding, in each hand, a respective gripping member 108*c* and 108*d* secured, in turn to the bar member 108*a*, the torso of the user fits within the space separating the gripping members 108*c* and 108*d*, the user may continue the pull phase of the stroke until reaching an extended endpoint illustrated in FIG. 7*b*-2. Similarly, when performing a mid pull phase, the user 112 may continue the pull phase past the prior end point illustrated in FIG. 7*c*-1 to the extended end point illustrated in FIG. 7*c*-2. Finally, when performing a high pull phase, the user 112 may continue the pull phase past the prior end point illustrated in FIG. 7*d*-1 to the extended end point illustrated in FIG. 7*d*-2.

The major body segments trained by performing a selected exercise protocol with the multi-planar rowing machine 100 in the inclined position include the anterior tibialis of the foreleg, the hamstrings of the thigh and the abdominals of the torso. By sustaining a selected exercise protocol in the inclined position, chronic reflex tonus of the abdominal muscles, which effectively counters chronic postural tonus in spinal erectors, is developed. Of course, in addition to the aforementioned body segments, by selecting the mid pull phase, the user 112 would add emphasis to the rhomboids and levator scapulae of the upper mid back and the long head of the triceps, by selecting the high pull phase, the user 112 would add emphasis to the trapezius and the scalenius of the neck, by selecting the heel-off position, the user 112 would add emphasis to ankle/calf plantar flexion, by selecting the wrist-down position, the user 112 would add emphasis to the hand/wrist flexion, by selecting the wrist-up position, the user 112 would add emphasis to the hand/wrist extensors, by selecting the toes-up position, the user 112 would add emphasis to the ankle/calf dorsa flexion. Finally, by selecting one of the toes-in or toes-out positions in combination with one of the aforementioned exercise protocols, the user 112 will affect training of the flexors and better emphasize the lateral hamstrings (if the toes-in position is selected) or the medial hamstrings (if the toes-out position is selected).

Figure 7E:
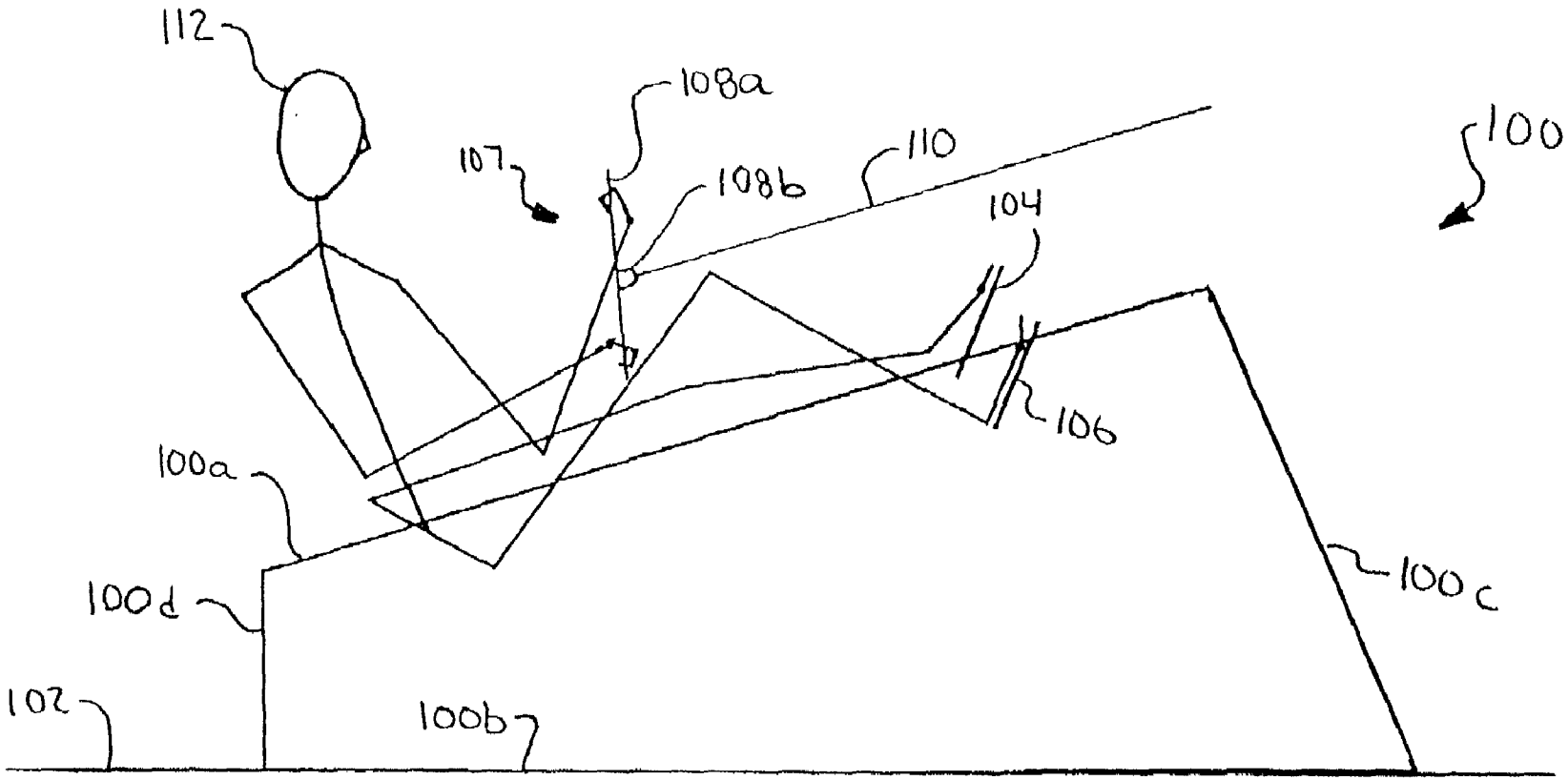
FIG. 7*e* is a schematic view of a multi-planar rowing machine in an inclined position with the user at an end point for a rotate-pull phase of a stroke.
Figure 8A:
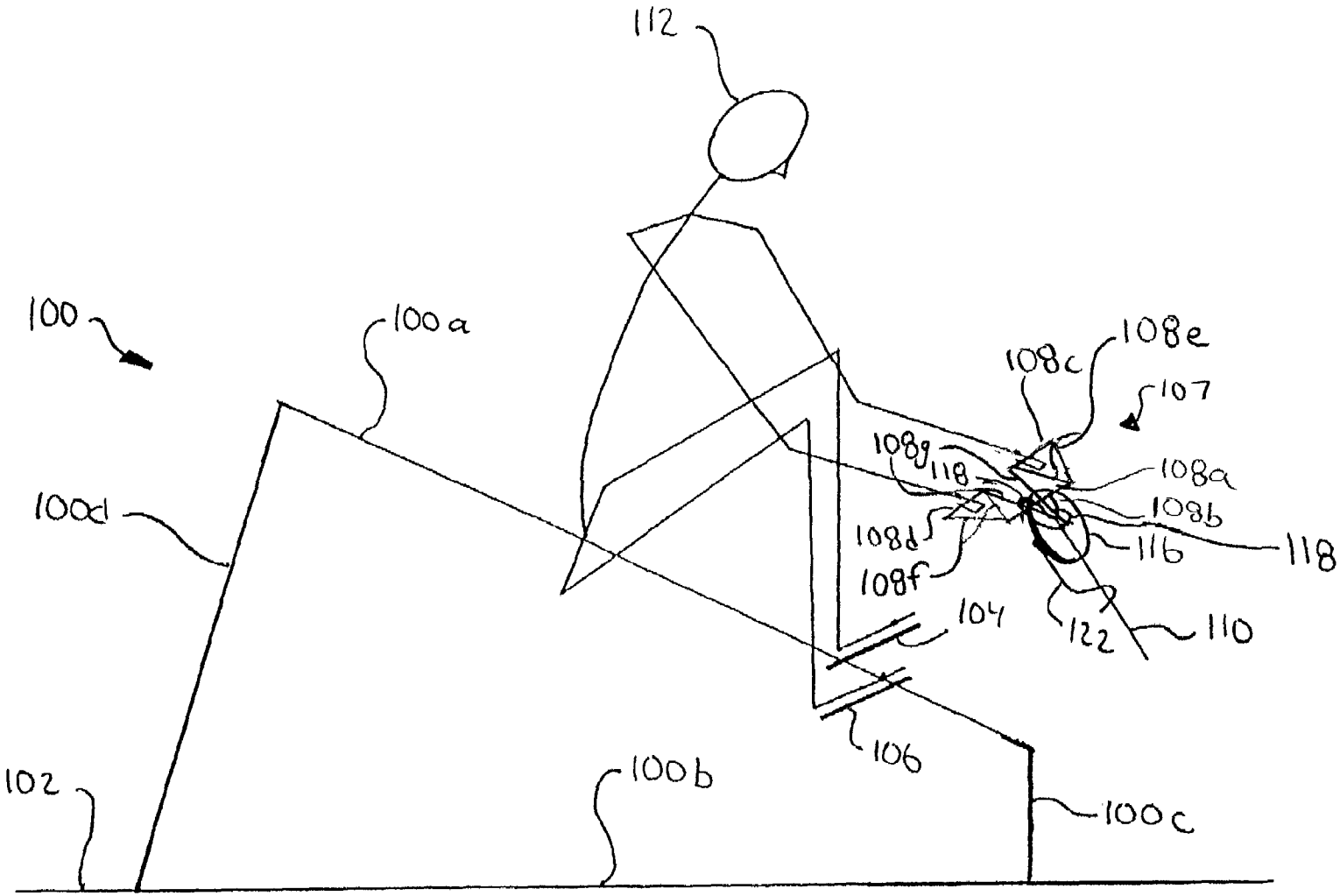
FIG. 8*a* is a schematic view of a multi-planar rowing machine in a declined position and a user at a start point of a pull phase of a stroke using a weighted bar.
Figures 1, 8B:
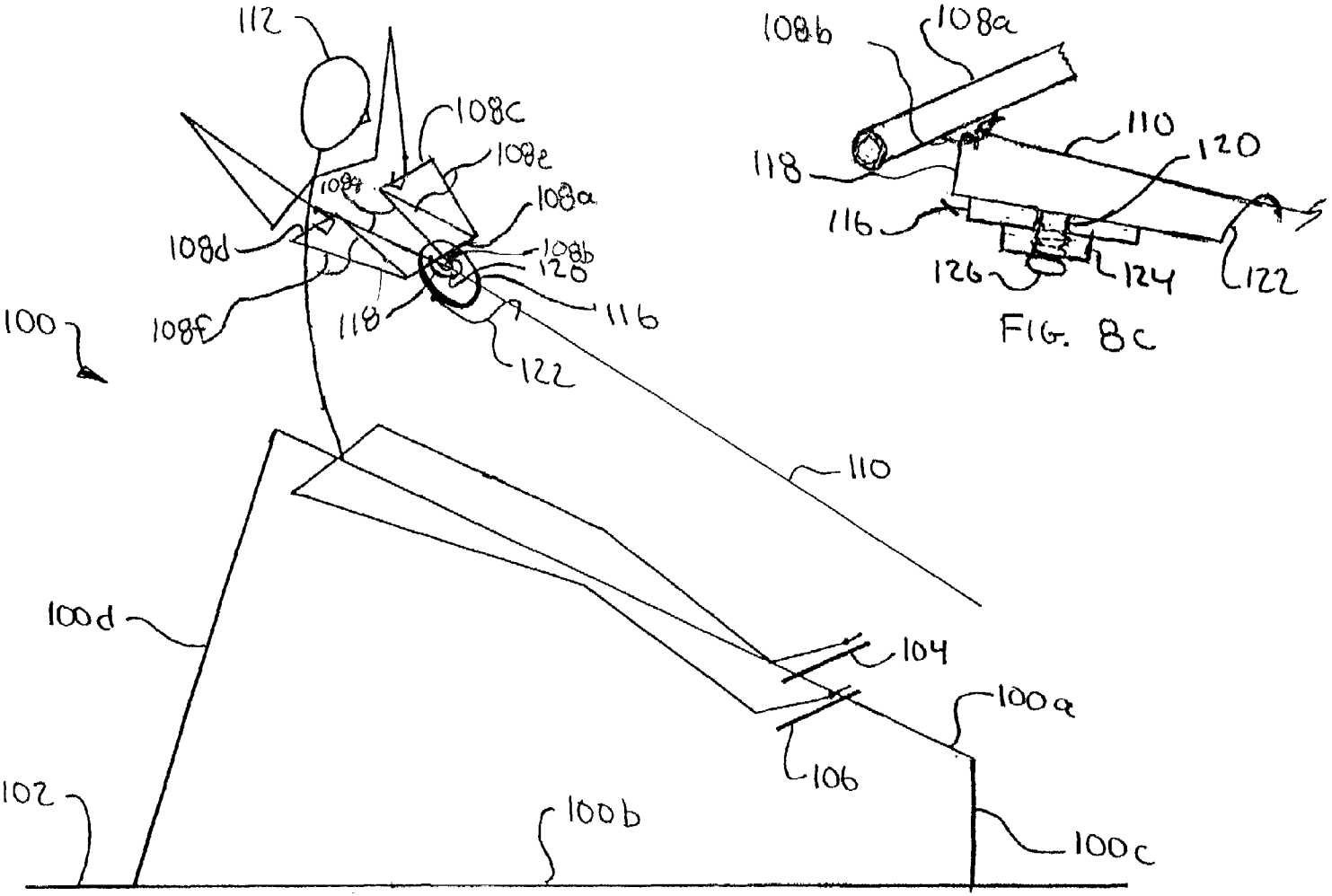
Figures 2, 8B:
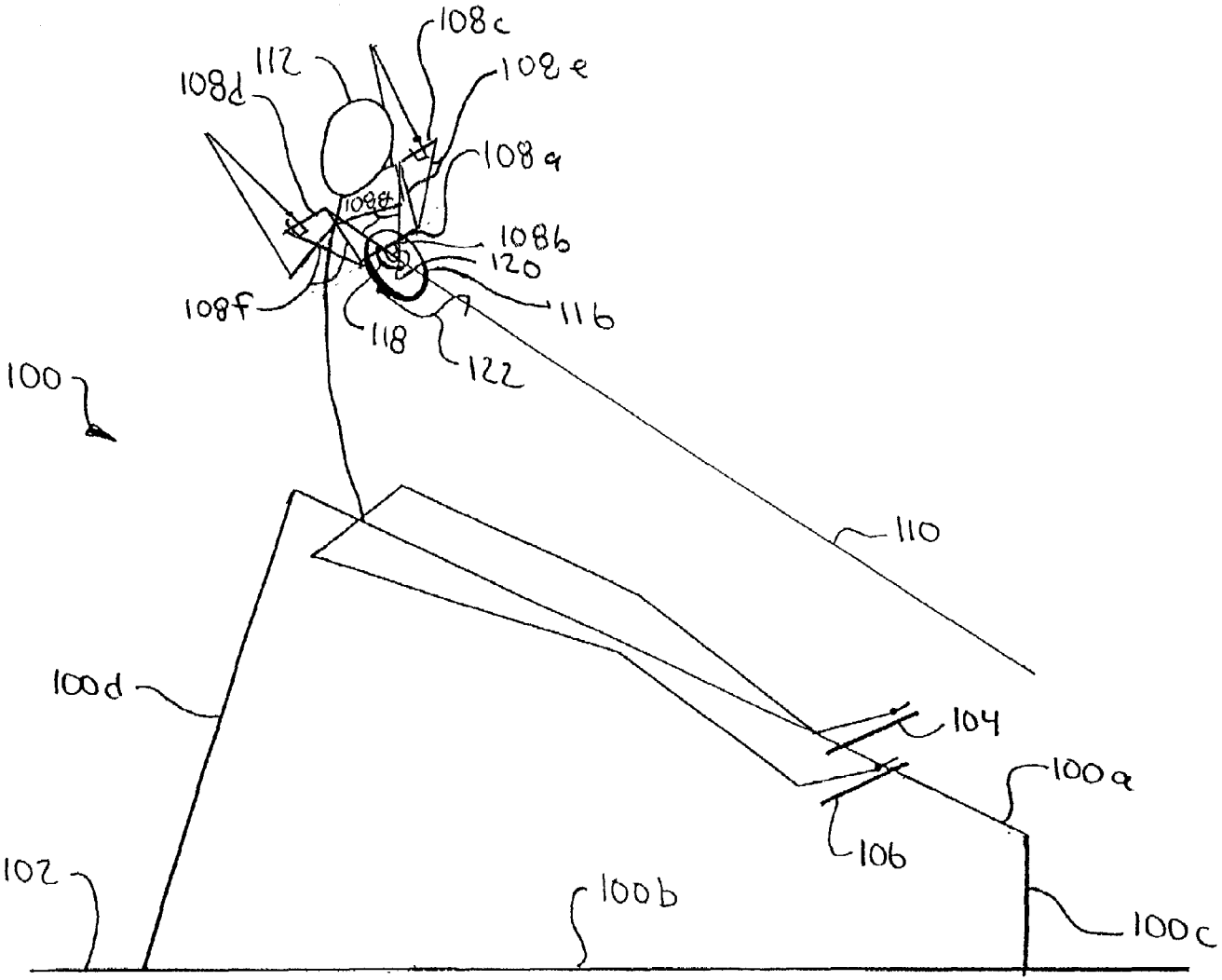

Yet another exercise protocol, which includes a rotate-pull phase may be seen by reference to FIG. 7*e*. To perform this exercise protocol with the handle assembly 107, the tubular bar member 108*a* is grasp, either with the gripping members 108*c* and 108*d* inserted into the tubular bar member 108*a* or with the gripping members 108*c* and 108*d* dangling therebelow. After grasping the tubular bar member 108*a*, the user 112 begins a pull phase. During this pull phase, the user 112 rotates the bar 108 in a clockwise direction until, at the end of the pull phase, a left end of the tubular bar member 108*a* is generally aligned with the shoulder while a right end of the tubular bar member 108 is generally aligned with the waist. At the end of the aforementioned rotational motion, the user moves the right pelvis forward and up while moving the left pelvis rearward and down. As a result, during the rotate-pull phase of the stroke, the right leg moves into a weight bearing flexed position while the left leg remains in an unweighted extended position. The major body segments trained by performing this exercise protocol include the left abdomen and the lower lateral back. Emphasis on the right side may be obtained by performing this exercise protocol with reversed rotations of the tubular bar member 108*a* and the pelvis. Of course, if the user 112 should so desire, the aforementioned exercise protocol may be performed with the gripping members 108*c* and 108*d* dangling freely below the tubular bar member 107*a*. Furthermore, while the exercise protocol provides all of the aforementioned advantages, such advantages are only achieved by loss of those advantages derived from the extended portion of the pull phase achievable only when the first and second gripping members 108*c* and 108*d* are used during the exercise protocol.

As before, other variants of the aforementioned exercise protocols suitable include the user 112 depressing the shoulders prior to performing a low pull phase of a stroke, performing an isometric muscle hold for approximately two seconds between pull and flex phases of a low pull stroke, performing an isometric muscle hold for approximately two seconds between pull and flex phases of a mid pull stroke and performing an isometric muscle hold for approximately two seconds between pull and flex phases of a high pull stroke.

It should be noted that, by performing a selected exercise protocol with the multi-position rowing machine 100 in the inclined position provides significant benefits to users suffering from back pain. More specifically, by firing the abdominal muscles into torso flexion—the reciprocal antagonists—the back extensor muscles relax, thereby allowing torso flexion to occur. Thus, the higher the intensity of abdominal muscle contraction, the greater the level of back extensor muscle relaxation. This provides a technique to the exerciser with back pain to release muscle spasm, with attendant pain relief, in back extensor musculature.

Referring next to FIGS. 8*a*, 8*b*-1 and 8*b*-2, an alternate embodiment of both the multi-position rowing machine 100 and additional exercise protocols suitable for use when the multi-position rowing machine is in the declined position will now be described in greater detail. In particular, FIGS. 8*a*, 8*b*-1 and 8*b*-2 show weighting at or near the tubular bar member 108*a*. Specifically, a weight plate 116 has been added to the underside of the tubular bar member 108*a*. A first hook member 118 couples the weight plate 116 to the tubular bar member 108*a* and a second hook member 122 couples the weight plate to the cable 110. It is contemplated that the weight of the weight plate 116 should preferably be adjustable between the range of two and twenty pounds. To adjust the weight of the weight plate 116, additional weight plates (not shown) may be added beneath the weight plate 116, for example, by sliding the additional weight plates onto a bolt mechanism 120 to which the weight plate 116 is secured and which projects downwardly from the general center of a lower side surface of the weight plate 116 and securing the additional weight plates to the bolt 120 using a nut mechanism. The bolt 120 is used to couple the first and second hook members 118 and 122 to the weight plate 116. One embodiment of the weighted bar mechanism may be seen by reference to FIG. 8*c*. In this embodiment, additional weight has been placed on the tubular bar member 108*a* by placing weight plate 124 beneath weight plate 116 and then securing the two to the bolt 120 using nut 126.

By adding the weight plate 116 to the underside of the tubular bar member 108*a*, additional loading is provided throughout the rowing motion. This provides additional training to shoulder elevator and torso extensor body segments with emphasis on the trapezius and spinal erector muscles. While, from the illustrated start point, the user 112 may select an exercise protocol, which incorporates a low pull, a mid pull or a high pull phase, by selecting the high-pull phase illustrated in FIG. 8*b*-1, particular emphasis is directed to the trapezius muscles. Put simply, the added weight enhances the exercise stimulus experienced by the user in any of the variation of exercise protocols described herein, but in particular wrist extensors and elbow flexors. It is understood that other apparatus may be effectively used to secure additional weight at, or near, the tubular bar member 108*a*. Furthermore by adding the weight to the tubular bar member 108*a* as opposed to a conventional bar, the user 112 may also obtain the additional advantages derived from being able to continue the pull phase from the traditional end point illustrated in FIG. 8*b*-1 to the extended end point illustrated in FIG. 8*b*-2.

Figure 9A:
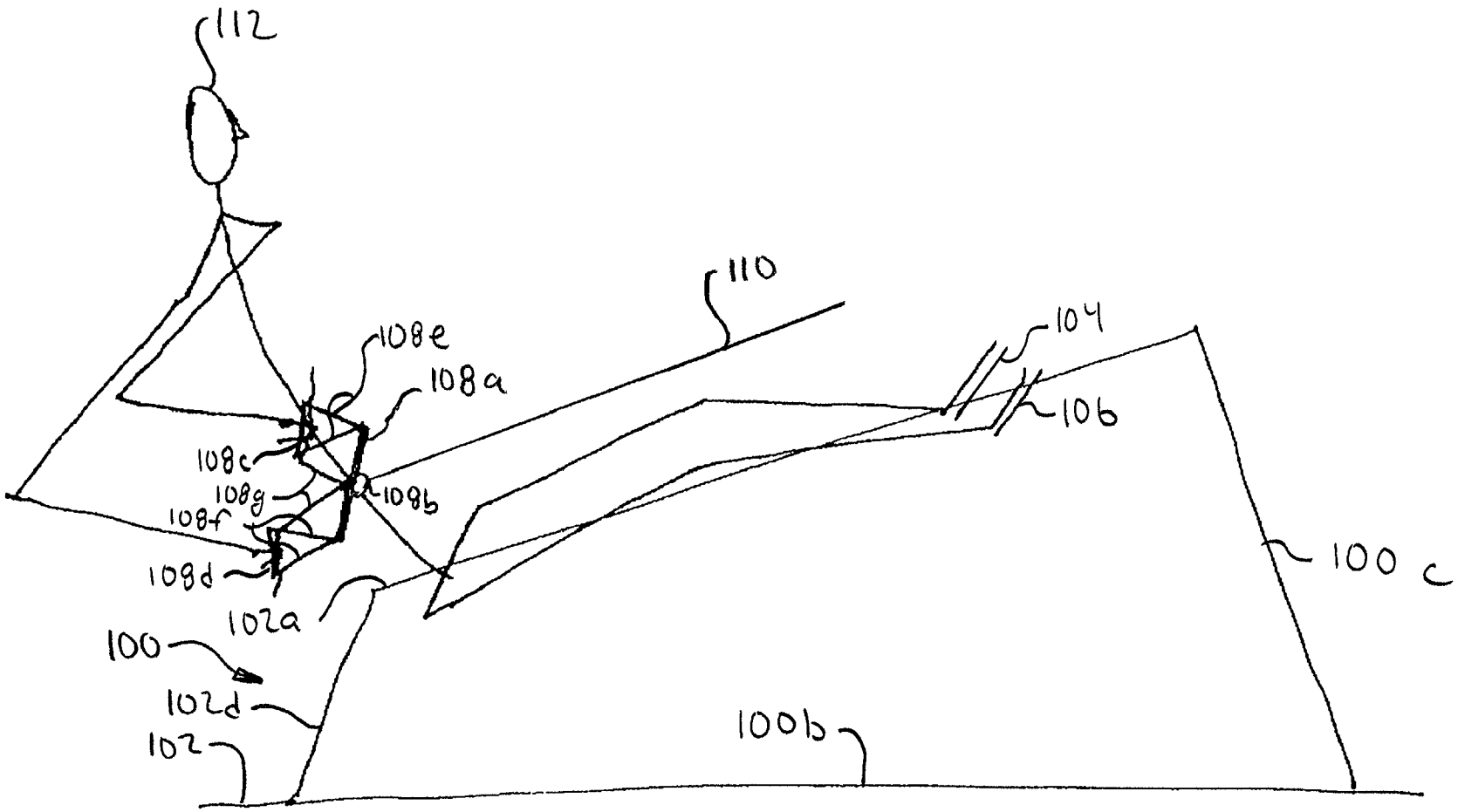
FIG. 9*a* is a schematic view of a multi-planar rowing machine in an inclined position with a user at an extended end point for a low pull phase with full shoulder extension and partial supination of hand/wrist.
Figure 9B:
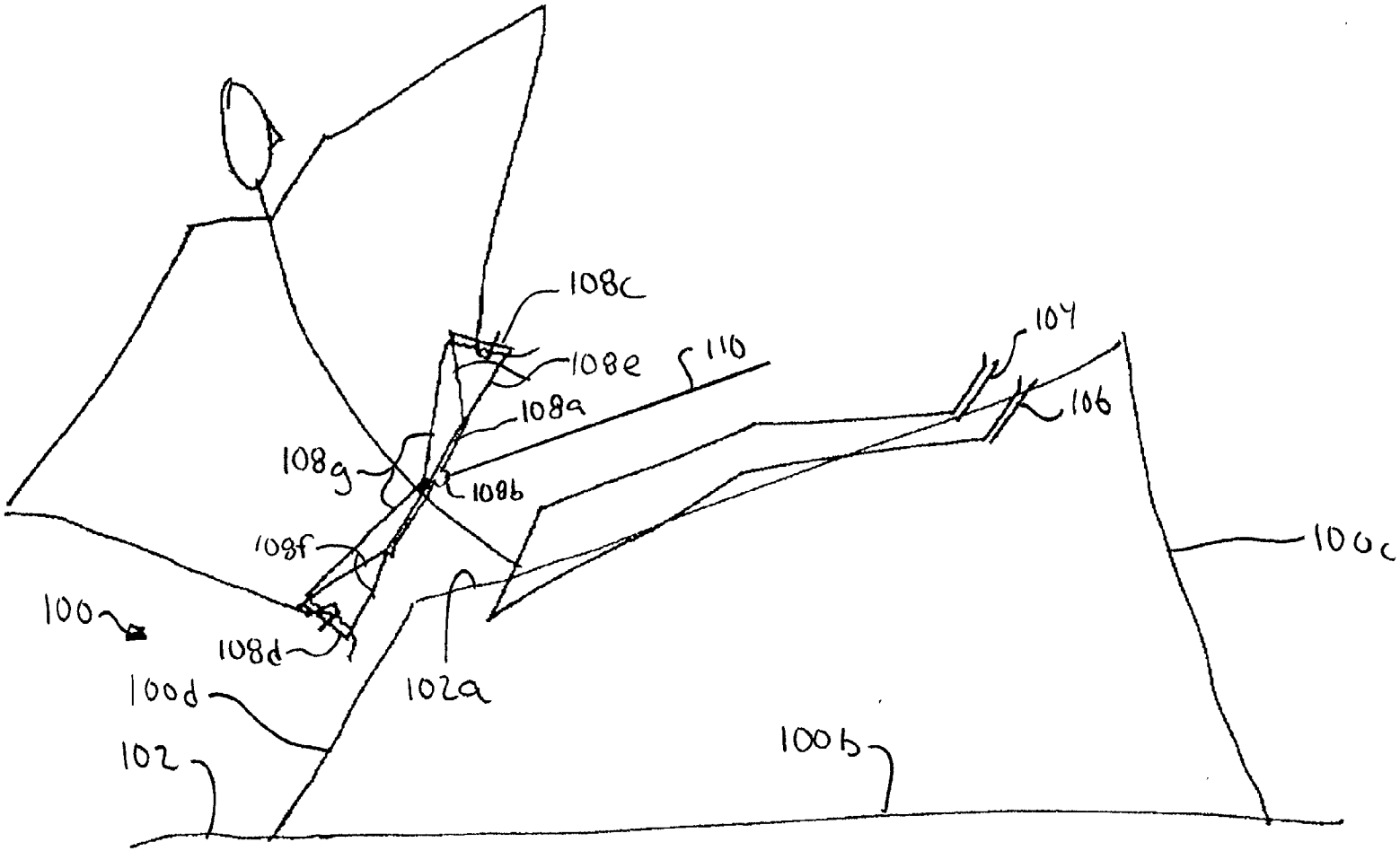
FIG. 9*b* is a schematic view of a multi-planar rowing machine in an inclined position with a user at an extended end point for a low pull phase with internal shoulder rotation plus supination/flexion/ulnar deviation of hand/wrist.
Figure 9C:
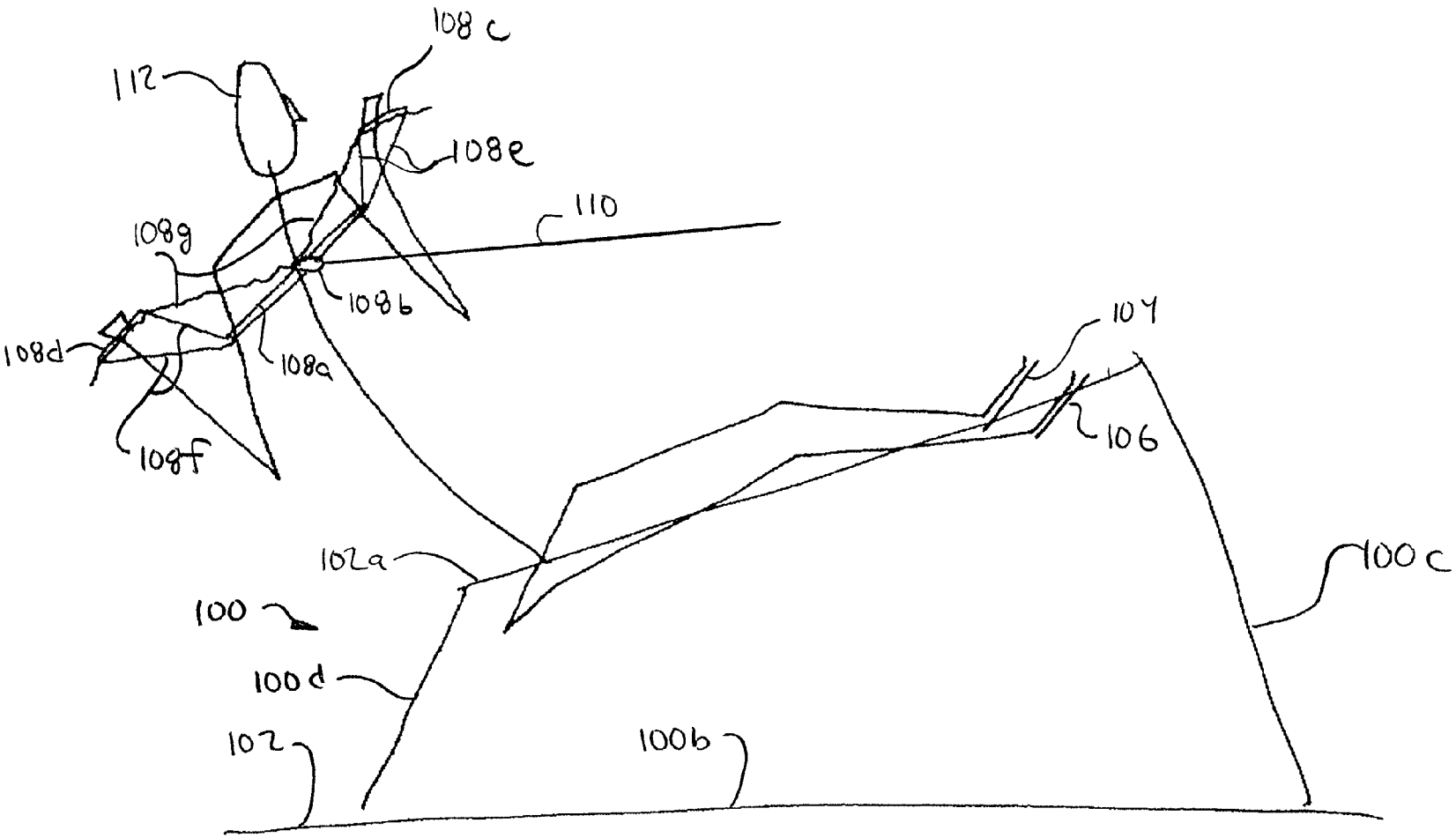
FIG. 9*c* is a schematic view of a multi-planar rowing machine in an inclined position with a user at an extended end point for a high pull phase with external shoulder rotation plus supination/extension/radial or ulnar deviation of hand/wrist.
Figure 9D:
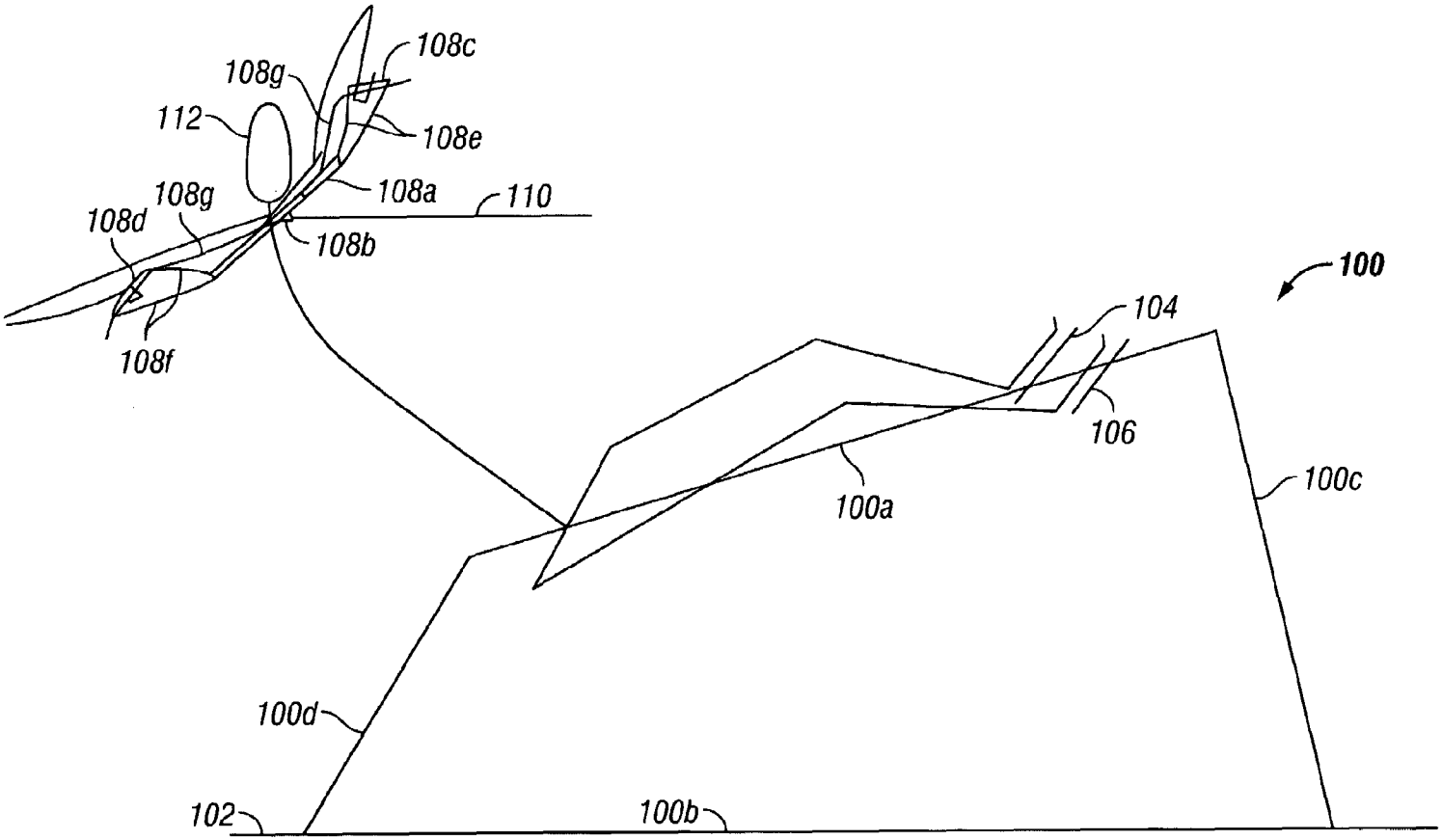
FIG. 9*d* is a schematic view of a multi-planar rowing machine in an inclined position with a user at an extended end point for a high pull phase with shoulder elevation/external rotation plus pronation/flexion of hand/wrist.
Figure 9E:
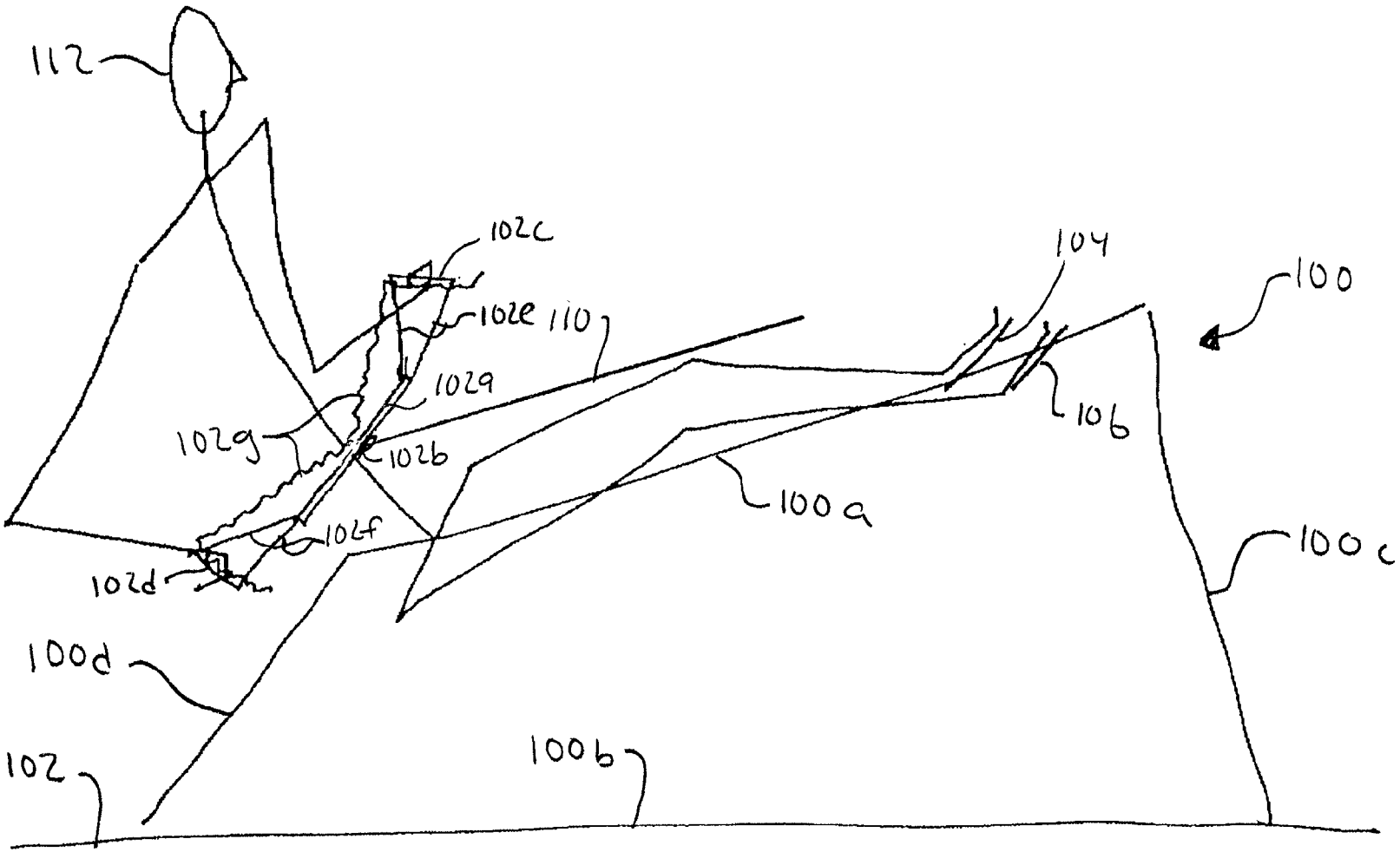
FIG. 9*e* is a schematic view of a multi-planar rowing machine in an inclined position with a user at an extended end point for a low pull phase with external shoulder rotation plus supination/extension/radial deviation of hand/wrist on a left side and with internal shoulder rotation plus pronation/flexion/ulnar deviation of hand/wrist plus extension of elbow on a right side thereof.

Referring next to FIGS. 9*a*–*e*, various ones of the movements possible using the handle assembly of FIG. 2*d* in combination with a multi-planar rowing machine 100 will now be described in greater detail. In FIG. 9*a*, the user 112 is at an extended end point for a low pull phase similar to that shown in FIG. 7*b*-2. Here, however, the user 112 has enhanced the extended pull phase with a full shoulder extension in combination with a partial supination of the hand/wrist. In FIG. 9*b*, the user 112 has again completed a low pull phase to an extended end point. For this pull phase, however, the user 112 has enhanced the extended pull phase with an internal shoulder rotation in combination with supination/flexion/ulnar deviation of the hand/wrist. In FIG. 9*c*, the user 112 has completed a high pull phase to an extended end point and enhanced the extended high pull phase with external shoulder rotation in combination with supination/extension/radial or ulnar deviation of the hand/wrist. In FIG. 9*d*, the user 112 has again completed a high pull phase to an extended end point. For this extended pull phase, however, the user 112 has enhanced the extended high pull phase with shoulder elevation/external rotation in combination with pronation/flexion of the hand/wrist. Finally, in FIG. 9*e*, the user has completed a low pull phase to an extended end point. Here, the user 112 has enhanced the extended high pull phase with external shoulder rotation plus supination/extension/radial deviation of the hand/wrist on the left side and with internal shoulder rotation plus pronation/flexion/ulnar deviation of the hand/wrist plus extension of elbow on the right side. To achieve a balanced exercise protocol, the aforementioned enhanced extended low pull phase would be alternated with an extended high pull phase enhanced with internal shoulder rotation plus pronation/flexion/ulnar deviation of the hand/wrist plus extension of elbow on the left side and with external shoulder rotation plus supination/extension/radial deviation of the hand/wrist on the right side.

Thus, there has been described and illustrated herein, a handle assembly, suitable for use with either an associated single plane, single phase rowing machine exercise apparatus or a multi-planar, two phase rowing machine exercise apparatus and exercise protocols for use in conjunction with a multi-planar rowing machine exercise apparatus selectively positioned in either inclined or declined stroke axis planes and a handle assembly which enables the user to achieve an extended pull phase when performing the exercise protocols. However, those skilled in the art should recognize that numerous modifications and variations may be made in the apparatus and techniques disclosed herein without departing substantially from the spirit and scope of the invention. Accordingly, it is intended that the scope of the present invention only be limited by the terms of the claims appended hereto.

What is claimed is:

1. A handle assembly for a rowing machine, comprising:

a main body portion, said main body portion configured for attachment to a retractable cable;

a first gripping member;

a first non-tensile flexible attachment member, said first non-tensile flexible attachment member coupling said first gripping member to said main body portion;

a second gripping member;

a second non-tensile flexible attachment member, said second non-tensile flexible attachment member coupling said second gripping member to said main body portion; and a tensile flexible attachment member coupled to said first gripping member and said second gripping member and configured for attachment to said retractable cable.

2. The handle assembly of claim 1, wherein said tensile flexible attachment member is comprised of a first segment coupled to said first gripping member and a second segment coupled to said second gripping member and wherein said tensile flexible attachment member and configured for attachment to said retractable cable at said juncture of said first and second segments thereof.

3. The handle assembly of claim 2, and further comprising:

a first locking member, said first locking member coupling said first segment of said tensile flexible attachment member to said first gripping member; and a second locking member, said second locking member coupling said second segment of said tensile flexible attachment member to said second gripping member.

4. The handle assembly of claim 3, wherein:

said first gripping member further comprises a first interior surface which defines a first interior passageway, said first locking member coupling said first segment of said flexible tensile attachment member to said first interior surface; and said second gripping member further comprises a second interior surface which defines a second interior passageway, said second locking member coupling said second segment of said flexible tensile attachment member to said second interior surface.

5. The handle assembly of claim 4, and further comprising a securing member mounted to an exterior side surface of said main body portion, said securing member used to attach said main body portion to said retractable cable.

6. The handle assembly of claim 2, and further comprising:

a clamping structure mounted to an interior side surface of said main body portion, said clamping structure clamping said first and second non-tensile flexible attachment members to said main body portion;

wherein said first non-tensile flexible attachment member and said clamping structure couples said first gripping member to said main body portion and wherein said second non-tensile flexible attachment member and said clamping structure couples said second gripping member to said main body portion.

7. The handle assembly of claim 6, wherein:

said first and second gripping members each having an interior passageway defined by an exterior side surface thereof;

said first non-tensile flexible attachment member has first and second ends respectively coupled to said clamping structure and extends, along its length, through said interior passageway defined by said first gripping member; and said second non-tensile flexible attachment member has first and second ends respectively coupled to said clamping structure and extends, along a portion of its length, through said interior passageway defined by said second gripping member.

8. A handle assembly for a rowing machine, comprising:

a body member having first and second securing structures, said first securing structure configured for attachment to a retractable cable of a rowing machine;

a first gripping member;

a first non-tensile flexible attachment member, said first non-tensile flexible attachment member coupling said first gripping member to said second securing structure;

a second gripping member;

a second non-tensile flexible attachment member, said second non-tensile flexible attachment member coupling said second gripping member to said second securing structure; and a tensile flexible attachment member comprised of first and second segments, said first segment coupled to said first gripping member and said second segment coupled to said second gripping member, said tensile flexible attachment member configured for attachment, to said retractable cable, at a juncture of said first and second segments thereof.

9. The handle assembly of claim 8, wherein:

said first gripping member is comprised of a first sidewall which defines a first interior passageway;

said first non-tensile flexible attachment member extending, from a first end coupled to said second securing structure, through said interior passageway defined by said first sidewall, to a second end coupled to said second securing structure;

said second gripping member is comprised of a second sidewall which defines a second interior passageway;

said second non-tensile flexible attachment member extending, from a first end coupled to said second securing structure, through said second interior passageway defined by said second sidewall, to a second end coupled to said second securing structure.

10. The handle assembly of claim 9, and further comprising a first locking member, said first locking member coupling said first segment of said tensile flexible attachment to said first sidewall of said first gripping member; and a second locking member said second locking member coupling said second segment of said tensile flexible attachment member to said second sidewall of said second gripping member.

11. The handle assembly of claim 8, and further comprising:

a first clamp structure for removably securing said first and second ends of said first non-tensile flexible attachment member to said second securing structure; and a second clamp structure for removably securing said first and second ends of said second non-tensile flexible attachment member to said second securing structure.

12. The handle assembly of claim 1, and further comprising:

a first locking member, said first locking member coupling said first segment of said tensile flexible attachment to said first gripping member; and a second locking member, said second locking member coupling said second segment of said tensile flexible attachment member to said second gripping member.

13. The handle assembly of claim 12, wherein:

said first gripping member further comprises a first interior surface which defines a first interior passageway, said first locking member coupling said first segment of said flexible tensile attachment member to said first interior surface; and said second gripping member further comprises a second interior surface which defines a second interior passageway, said second locking member coupling said second segment of said flexible tensile attachment member to said second interior surface.

14. A handle assembly for a rowing machine, comprising:

a main body portion having first and second ends;

a first securing member coupled to said main body portion, said first securing member configured for attachment to a retractable cable of a rowing machine;

a second securing member coupled to said main body portion at a point roughly midway between said first and second ends thereof;

a first gripping member;

a first non-tensile flexible attachment member, said first non-tensile flexible attachment member coupling said first gripping member to said second securing member;

a second gripping member; and a second non-tensile flexible attachment member, said second non-tensile flexible attachment member coupling said second gripping member to said second securing member;

a tensile flexible attachment member comprised of first and second segments, said first segment coupled to said first gripping member and said second segment coupled to said second gripping member, said tensile flexible attachment member configured for attachment, to said retractable cable, at a juncture of said first and second segments thereof;

wherein said juncture of said first and second segments of said tensile flexible attachment member, said first securing member and said second securing member are generally aligned with one another; and wherein, when a user of said rowing machine grasps said first and second gripping members and performs an exercise routine which includes a pull phase of a stroke, said first non-tensile flexible attachment member, said main body portion and said second non-tensile flexible attachment member define a space in which a portion of said user is received during said pull phase.

15. The handle assembly of claim 14, wherein said space defined by said first non-tensile flexible attachment member, said main body portion and said second non-tensile flexible attachment member has a general U shape.

16. A rowing machine, comprising:

a support structure;

a rail member coupled to said support structure, said support structure supporting said rail member above a surface;

a user support, said user support slidably coupled to said rail member;

a handle structure; and a retractable cable having a first end coupled to said handle structure and a second end coupled to said support structure;

said handle structure further comprising:

a central body member;

a first securing member coupled to said central body member, said first securing member securing said retractable cable to said central body member;

a second securing member coupled to said central body member;

a first gripping member;

a first non-tensile flexible attachment member, said first flexible attachment member coupling said first gripping member to said second securing member;

a second gripping member;

a second non-tensile flexible attachment member, said second flexible attachment member coupling said second gripping member to said second securing structure; and a tensile flexible attachment member comprised of first and second segments said first segment coupled to said first gripping member and said second segment coupled to said second gripping member, said tensile flexible attachment member further coupled to said retractable cable at a juncture of said first and second segments;

wherein said juncture of said first and second segments of said tensile flexible attachment member, said first securing member and said second securing member are generally aligned with one another.

17. The rowing machine of claim 16, wherein said support structure supports said rail member in a plane generally parallel to said surface.

18. The rowing machine of claim 16, wherein said support structure is movable between a first position in which said rail member is generally parallel to said surface and a second position in which said rail member is in a declined position relative to said surface.

19. The rowing machine of claim 16, wherein said support structure is movable between a first position in which said rail member is generally parallel to said surface and a second position in which said rail member is in an inclined position relative to said surface.

* * * * *